US009659426B2

(12) United States Patent
Bauer

(10) Patent No.: US 9,659,426 B2
(45) Date of Patent: May 23, 2017

(54) DISPENSER FOR ROLLING PRODUCT AND DISPENSER CARTRIDGES

(71) Applicant: Giraffx Design, LLC, Lake Worth, FL (US)

(72) Inventor: Jamie D. Bauer, Greenacres, FL (US)

(73) Assignee: Giraffx Design, LLC, Lake Worth, FL (US)

( * ) Notice: Subject to any disclaimer, the term of this patent is extended or adjusted under 35 U.S.C. 154(b) by 61 days.

(21) Appl. No.: 14/472,362

(22) Filed: Aug. 28, 2014

(65) Prior Publication Data

US 2015/0001237 A1 Jan. 1, 2015

Related U.S. Application Data

(60) Provisional application No. 61/871,692, filed on Aug. 29, 2013, provisional application No. 61/871,705,
(Continued)

(51) Int. Cl.

| | |
|---|---|
| ***B65H 1/00*** | (2006.01) |
| ***G07F 11/28*** | (2006.01) |
| ***A47F 1/08*** | (2006.01) |
| ***A47F 1/04*** | (2006.01) |
| ***B65D 71/36*** | (2006.01) |
| ***B65D 5/72*** | (2006.01) |

(52) U.S. Cl.
CPC ..... *G07F 11/28* (2013.01); *A47F 1/04* (2013.01); *A47F 1/087* (2013.01); *B65D 5/725* (2013.01);
(Continued)

(58) Field of Classification Search
CPC . G07F 11/28; A47F 1/087; A47F 1/04; B65D 71/36; B65D 2571/00141;
(Continued)

(56) References Cited

U.S. PATENT DOCUMENTS

| | | | |
|---|---|---|---|
| 902,347 | A | 10/1908 | Tillinghast |
| 1,291,420 | A | 1/1919 | Cough |
| 1,898,056 | A | 2/1933 | Johnson |
| 2,382,191 | A | 8/1945 | Weichselbaum |
| 2,996,344 | A | 8/1961 | Garman |
| 3,055,293 | A | 9/1962 | Lariccia |
| 3,178,242 | A | 4/1965 | Ellis et al. |
| 3,203,554 | A | 8/1965 | Pendergrast, Jr. et al. |
| 3,300,115 | A | 1/1967 | Schauer |
| 3,784,022 | A | 1/1974 | Beesley, Jr. |

(Continued)

FOREIGN PATENT DOCUMENTS

| | | | |
|---|---|---|---|
| EP | 1539607 | B1 | 3/2009 |
| JP | 07124041 | A | 5/1995 |

(Continued)

OTHER PUBLICATIONS

International Search Report and Written Opinion for International Application No. PCT/US2014/027165. Issued on May 26, 2014.

(Continued)

*Primary Examiner* — Rakesh Kumar

(57) ABSTRACT

A serpentine dispenser and cartridge system provides simplified stocking and restocking, as well as jam-free dispenser feeding. A cartridge priming flap allows a cartridge be inverted and inserted into a dispenser while products in the cartridge are prevented from falling out. Cartridge opening is completed by holding an priming flap while pushing the cartridge into the dispenser. In other embodiments, a dispenser wedge applies pressure on rolling products, forcing a retaining flap open, as the cartridge is pushed into the dispenser. The wedge can also constrain rolling products to exit the cartridge in an order that prevents jamming.

14 Claims, 103 Drawing Sheets

Related U.S. Application Data filed on Aug. 29, 2013, provisional application No. 61/871,711, filed on Aug. 29, 2013.

(52) U.S. Cl.
CPC ..... *B65D 71/36* (2013.01); *B65D 2571/0066* (2013.01); *B65D 2571/00141* (2013.01); *B65D 2571/00574* (2013.01); *B65D 2571/00728* (2013.01)

(58) Field of Classification Search
CPC .. B65D 2571/00574; B65D 2571/0066; B65D 2571/00728
USPC ..... 221/197, 31, 32, 309; 229/122
See application file for complete search history.

(56) References Cited

U.S. PATENT DOCUMENTS

| | | | | |
|---|---|---|---|---|
| 3,923,159 | A | 12/1975 | Taylor et al. | |
| 4,228,903 | A | 10/1980 | Eckert | |
| 4,435,026 | A | 3/1984 | Johnson | |
| 4,598,828 | A | 7/1986 | Young et al. | |
| 4,823,982 | A | 4/1989 | Aten et al. | |
| 4,915,571 | A | 4/1990 | Toshihiko et al. | |
| 5,289,943 | A | 3/1994 | Powell | |
| 5,314,078 | A | 5/1994 | Morikiyo et al. | |
| 5,328,258 | A | 7/1994 | Scalise | |
| 5,390,821 | A | 2/1995 | Markel | |
| D363,174 | S | 10/1995 | Fletcher | |
| 5,462,198 | A | 10/1995 | Schwimmer | |
| 5,540,315 | A | 7/1996 | Haiki et al. | |
| 5,788,117 | A * | 8/1998 | Zimmanck | A47F 1/08 211/59.2 |
| 5,836,478 | A | 11/1998 | Weiss | |
| 5,878,862 | A | 3/1999 | Dewsnap | |
| 5,894,942 | A | 4/1999 | Miyashita et al. | |
| 6,253,930 | B1 | 7/2001 | Freidus et al. | |
| 6,991,116 | B2 | 1/2006 | Johnson et al. | |
| 7,207,447 | B2 | 4/2007 | Medcalf et al. | |
| 7,552,857 | B2 | 6/2009 | Harrelson | |
| 7,717,321 | B2 | 5/2010 | Spivey, Sr. et al. | |
| 7,922,437 | B1 | 4/2011 | Loftin et al. | |
| 7,992,747 | B2 | 8/2011 | Bauer | |
| 8,047,400 | B1 | 11/2011 | Luberto | |
| 8,127,980 | B2 | 3/2012 | Spivey, Sr. et al. | |
| 8,162,206 | B2 | 4/2012 | Harrelson | |
| 8,302,809 | B1 | 11/2012 | Bogdziewicz, III et al. | |
| 8,308,023 | B2 * | 11/2012 | Gelardi | A47F 1/087 221/31 |
| 8,322,543 | B2 | 12/2012 | Gelardi et al. | |
| 8,448,815 | B2 | 5/2013 | Sholl et al. | |
| 8,550,261 | B2 | 10/2013 | Loftin et al. | |
| 8,628,003 | B2 | 1/2014 | Thomas et al. | |
| 8,668,114 | B2 * | 3/2014 | Gelardi | A47F 1/087 211/59.2 |
| 8,833,601 | B2 * | 9/2014 | Zacherle | A47F 1/087 221/30 |
| 2004/0200789 | A1 | 10/2004 | Woodbury | |
| 2005/0127015 | A1 | 6/2005 | Medcalf et al. | |
| 2006/0091191 | A1 | 5/2006 | DeBusk | |
| 2006/0180488 | A1 | 8/2006 | Spivey, Sr. et al. | |
| 2007/0007221 | A1 | 1/2007 | Mann | |
| 2009/0212066 | A1 | 8/2009 | Bauer | |
| 2009/0308885 | A1 | 12/2009 | Sainato et al. | |
| 2010/0072150 | A1 | 3/2010 | Takashima et al. | |
| 2010/0096401 | A1 | 4/2010 | Sainato et al. | |
| 2010/0187295 | A1 | 7/2010 | Spivey, Sr. et al. | |
| 2010/0252619 | A1 | 10/2010 | Harrelson | |
| 2011/0121010 | A1 | 5/2011 | Loftin et al. | |
| 2011/0121011 | A1 | 5/2011 | Gelardi et al. | |
| 2012/0018391 | A1 | 1/2012 | Gelardi et al. | |
| 2012/0074160 | A1 | 3/2012 | Thomas et al. | |
| 2012/0074164 | A1 | 3/2012 | Walling et al. | |
| 2012/0097694 | A1 | 4/2012 | Gelardi | |
| 2012/0104082 | A1 | 5/2012 | Spivey, Sr. et al. | |
| 2012/0211510 | A1 | 8/2012 | Gelardi et al. | |
| 2012/0211522 | A1 | 8/2012 | Gelardi et al. | |
| 2012/0217213 | A1 | 8/2012 | Thomas | |
| 2012/0217261 | A1 | 8/2012 | Bailey et al. | |
| 2012/0223090 | A1 | 9/2012 | Thomas et al. | |
| 2012/0228247 | A1 | 9/2012 | Loftin et al. | |
| 2012/0261432 | A1 | 10/2012 | Walling | |
| 2012/0279893 | A1 | 11/2012 | Gelardi et al. | |
| 2012/0285976 | A1 | 11/2012 | Bogdziewicz, III et al. | |
| 2012/0285977 | A1 | 11/2012 | Bates et al. | |
| 2012/0318817 | A1 | 12/2012 | Zacherle et al. | |
| 2012/0325839 | A1 | 12/2012 | Bates et al. | |
| 2013/0020341 | A1 | 1/2013 | Bogdziewicz, III et al. | |
| 2013/0062360 | A1 | 3/2013 | Bogdziewicz, III et al. | |
| 2013/0062361 | A1 | 3/2013 | Loflin et al. | |
| 2013/0105509 | A1 | 5/2013 | Gelardi et al. | |
| 2013/0134119 | A1 | 5/2013 | Loftin et al. | |
| 2013/0134177 | A1 | 5/2013 | Loftin | |
| 2013/0221017 | A1 | 8/2013 | Zacherle et al. | |
| 2013/0221020 | A1 | 8/2013 | Zacherle et al. | |
| 2013/0233813 | A1 | 9/2013 | Zacherle et al. | |
| 2013/0248468 | A1 | 9/2013 | Burton et al. | |
| 2013/0270203 | A1 | 10/2013 | Burton et al. | |
| 2013/0277321 | A1 | 10/2013 | Zacherle | |
| 2013/0277385 | A1 | 10/2013 | Zacherle | |
| 2014/0001200 | A1 | 1/2014 | Bates et al. | |
| 2014/0054310 | A1 | 2/2014 | Loftin et al. | |
| 2014/0061217 | A1 | 3/2014 | Fortuna et al. | |
| 2014/0076922 | A1 | 3/2014 | Binshtok et al. | |
| 2014/0102942 | A1 | 4/2014 | Thomas et al. | |
| 2014/0103056 | A1 | 4/2014 | Thomas et al. | |
| 2015/0001244 | A1 * | 1/2015 | Bauer | A47F 1/04 221/197 |

FOREIGN PATENT DOCUMENTS

| | | | | |
|---|---|---|---|---|
| JP | 11346880 | A | 12/1999 | |
| JP | 2008080058 | A | 4/2008 | |
| JP | 2013537443 | A | 10/2013 | |
| JP | 2013540663 | A | 11/2013 | |
| WO | 2011063117 | A1 | 5/2011 | |
| WO | 2012012201 | A1 | 1/2012 | |
| WO | 2012012677 | A1 | 1/2012 | |
| WO | 2012040053 | A1 | 3/2012 | |
| WO | 2012044461 | A1 | 4/2012 | |
| WO | 2012082233 | A1 | 6/2012 | |
| WO | 2012115727 | A1 | 8/2012 | |
| WO | 2012115728 | A1 | 8/2012 | |
| WO | 2012118776 | A1 | 9/2012 | |
| WO | 2013036439 | A1 | 3/2013 | |
| WO | 2013036443 | A1 | 3/2013 | |
| WO | 2013078113 | A2 | 5/2013 | |
| WO | 2013081810 | A1 | 6/2013 | |
| WO | 2013081814 | A1 | 6/2013 | |
| WO | 2013126215 | A1 | 8/2013 | |
| WO | 2013126218 | A1 | 8/2013 | |
| WO | 2013158434 | A1 | 10/2013 | |
| WO | 2013162942 | A1 | 10/2013 | |
| WO | 2013163014 | A1 | 10/2013 | |
| WO | WO 2013162942 | A1 * | 10/2013 | A47F 1/087 |

OTHER PUBLICATIONS

International Search Report and Written Opinion for International Application No. PCT/US2014/053372. Issued on Dec. 12, 2014.
International Search Report and Written Opinion for International Application No. PCT/US2014/053417. Issued on Nov. 21, 2014.
International Search Report and Written Opinion for International Application No. PCT/US2014/053432. Issued on Nov. 14, 2014.

* cited by examiner

Slotted Cut Score Perforations

"Zipper" Cut Perforations

Fold Score Only 100
110
120
A
1
3
2r
r
w
15
16
14
90
11
12
130
Slotted Cut Score Perforations
"Zipper" Cut Perforations
Fold Score Only

DISPENSER FOR ROLLING PRODUCT AND DISPENSER CARTRIDGES

REFERENCE TO RELATED APPLICATIONS

This application claims one or more inventions which were disclosed in Provisional Application No. 61/871,705, filed Aug. 29, 2013, entitled "Product Dispenser With An S-Shaped Down Chute"; Provisional Application No. 61/871,692, filed Aug. 29, 2013, entitled "Dispenser For Rolling Product And Dispenser Cartridges"; and, Provisional Application No. 61/871,711, filed Aug. 29, 2013, entitled "Dispenser With Wedge For Rolling Products". The benefit under 35 USC §119(e) of the United States provisional applications is hereby claimed, and the aforementioned applications are hereby incorporated herein by reference.

BACKGROUND OF THE INVENTION

Field of the Invention

The invention pertains to the field of product dispensers and cartridges for stocking them. More particularly, the invention pertains to serpentine self-opening product dispensers and cartridges for rolling products.

Description of Related Art

A dispenser with a cartridge containing multiple rolling product packages, Bauer (U.S. Pat. No. 7,992,747, for example), accommodates a variety of different bulk packed product shipping cartons [henceforth referred to as "cartridge(s)"] with a variety of can counts or arrangements packed therein. As shown in prior art FIGS. 98 and 99, and in the patent cited above, the cartridges may be packed with a single row of cans therein. As further shown in prior art FIGS. 1 and 2, it is often desirable to stack cans two or more wide in the cartridge 10 in its shipping orientation (with the cans vertical therein), or two or more rows (lower row 1, upper row 2) high in the "at use" position (when the cartridge 10 is inside the dispenser 20 as shown in prior art FIGS. 4-18).

This second configuration is most commonly known from cartridges 10 for canned soda and other carbonated beverages; however almost any product packed in cans, bottles, or other configuration capable of rolling can be so packaged. This is also true for stacks of nested cans, as shown in prior art FIG. 3, where each nested stack functions the same as if it was a single can. One skilled in the art of dispensers 20 and bulk shipping cartridges 10 will therefore appreciate that the operation of dispensers 20 and cartridges 10 described herein applies equally to rows of single cans, stacks of nested cans, and any packaging configuration that is capable of rolling. Henceforth, "can" or "cans" includes, but is not limited to, a conventional metal can or cans, a stack of nested cans, stacks of nested cans, and any other packaging form that is capable of rolling. Such bulk shipping cartridges 10 and associated dispensers 20 are more flexible for retailers or brand marketers and assist with the efficient management of supply chains and sales.

Referring to prior art FIGS. 4-11, a dispenser 20 is shown with a cartridge 10 holding area 24, an exit port 45, a down chute 30, a lower feed ramp 40, and a cartridge loading ramp 35. When a pre-filled cartridge 10 is inserted into the cartridge holding area 24 (FIG. 4) of completely empty matching dispenser 20, such as shown in prior art FIGS. 4-11, products (cans in lower row 1 and upper row 2) generally load and feed through the dispenser 20, and are dispensed to shoppers according to design expectations.

Prior art FIG. 4 shows a prior art cartridge 10 being loaded into a prior art dispenser 20 cartridge holding area 24 after an opening has been made in the bottom of the rear end of the cartridge 10 to allow cans to exit the cartridge 10 through through the cartridge opening an a dispenser exit port 45.

A sequence of events after loading is shown in prior art FIGS. 5-11 in detail. Starting with prior art FIG. 5, the first four cans 1, 2, 3, 4 (henceforth, "can" or "cans" includes, but is not limited to, a conventional metal can or cans, a stack of nested cans, stacks of nested cans, and any other packaging form that is capable of rolling) that exit the cartridge 10 during feeding are critical to the proper operation of the cartridge 10 and dispenser 20 system. It has been found that, after these first four cans 1, 2, 3, 4, exit the cartridge 10 the balance of cans in the cartridge 10 have sufficient room to move inside the cartridge 10 so that no jamming occurs thereafter. The exiting of these first four cans 1, 2, 3, 4, no matter the size or weight of the cans, therefore determines the efficient and reliable feeding of all the cans from the cartridge 10 into and through the dispenser 20 to a product selection location 25 where they can be selected by the consumer.

Referring again to prior art FIG. 5, immediately after the cartridge 10 is loaded into the dispenser 20, can 1 is free to exit the cartridge 10, drop vertically downward through the exit port 45, roll along the down chute 30, and then roll along the lower feed ramp 40 to the product selection area 25. Similarly, as shown in prior art FIG. 6, can 2 is generally free to also follow can 1, falling vertically downward from the cartridge 10, through the exit port 45, into the dispenser 20, and roll to the product selection area 25.

However, experience has shown that successful feeding of cans 3, 4 is largely due to the impacts and vibrations caused by the first cans 1, 2 transiting the dispenser. Impacts and vibrations dislodge products lodged in the cartridge 10 or stuck in between the dispenser down chute 30 and loading ramp 35, as illustrated in prior art FIGS. 7, 8, and 10 for example. Thus, reliable dispenser feeding is more a matter of chance rather than a result of a truly functional dispenser 20/cartridge 10/can 1, 2, 3, 4 interaction.

As shown in prior art FIGS. 7 and 8, after cans 1 and 2 exit the cartridge 10, cans 3 and 4 may be positioned such that they cause a feed jam. While the impact of cans 1 and 2 with the down chute 30 (prior art FIG. 7), or the product selection area 25 (prior art FIG. 8) may cause sufficient vibration in the dispenser 20 to dislodge the feed jam, this is by no means guaranteed and is not always the case. However, assuming such impacts do occur and free can 4 (prior art FIG. 9), it is then free to roll along the down chute 30 to the product selection area 25, and can 3 follows suit (prior art FIG. 10), followed by the rest of the cans in the cartridge 10 until the dispenser 20 is full of product (prior art FIG. 11).

Referring now to prior art FIGS. 12-18, while restocking the dispenser 20 by inserting a new cartridge 10 full of cans into the cartridge holding area 24 when the lower feed ramp 40 is not empty, there is insufficient can 1, 2, 3, 4 movement to cause such impacts and vibrations. The sequence of events in this circumstance is similar to the events illustrated in prior art FIGS. 5-8, that occur when filling an empty dispenser 20.

Prior art FIG. 12 shows a full cartridge 10 being inserted into the cartridge holding area 24 of a dispenser 20 that remains partially filled with previously loaded cans. Immediately after inserting the cartridge 10 (prior art FIG. 13), can 1 is free to move through the exit port 45, and roll along the down chute 30, but only until it contacts the rearmost previously loaded can in the lower channel. As shown in prior art FIG. 14, can 2 drops immediately down behind can 1, and can 4 is biased to roll over can 3. This restocking situation thus shortens the distance cans 1 and 2 move in the dispenser, which significantly reduces the previously described impacts and vibrations. As shown in prior art FIG. 15, when a can is removed from the product selection area 25, can 1 and can 2 move along the down chute 30, with can 4 biased to follow by rolling over the top of can 3. At this point, shown in prior art FIGS. 15-16, can 3 and can 4 are in a position that may potentially result in a jam. While the cans remaining in the dispenser 20 lower feed ramp 40 may still be selected, the jam (prior art FIG. 17) prevents product movement from the cartridge 10 through the exit port 45.

As a result of this sequence of events, products tend to jam either inside the cartridge 10 prior to exiting the exit port 45, as shown in prior art FIGS. 12-17, or within the down chute 30 of the dispenser (prior art FIG. 18), depending on the various relationships between the exit port 45 size, the can diameter, the down chute 30 configuration, and other factors. Such jams are unacceptable because dispensing cans to shoppers becomes unreliable and increases, rather than decreases, the manual labor and time needed to maintain the system, as presently occurs with similar prior art dispensers in stores.

Additionally, for a dispenser which displays and dispenses rolling product packages to be stocked/loaded, or restocked/reloaded, using bulk packed cartridges 10 of generally cylindrical products, the cartridges 10 must be both easy and safe to open and load into the dispensers 20. In order to effectively reduce stocking/restocking time and labor, this process must also be accomplished quickly.

Prior art cartridges 10 employ a simple tear tab and removable flap opening that is removed by the stocking person prior to loading the cartridge 10 into the dispenser 20. However, in order to load the cartridge 10 into the dispenser 20, the cartridge 10 must be inverted after removing the flap, so that the opening is in the downward and a rearward facing position.

When the opened cartridge 10 is in the inverted position, products simply fall out if the stocking person does not hold their hand over the opening during cartridge 10 inversion and insertion. This necessary action by the stock person is difficult and danger prone in busy commercial environments. If the stock person forgets to cover the opening, or their hand slips off the opening, the least that may happen is that products will fall out of the cartridge 10 and onto the floor, denting them and rendering them unsalable. However, heavy canned products may also fall out of the cartridge 10 and hit the stock person, causing injury. This possibility is especially of concern if the cartridge 10 is being lifted into an overhead dispenser 20, from which a falling can could hit the stock person in the head. Further, neat, rapid, and efficient displaying, dispensing, and restocking devices and methods encourage retailers to perform restocking during the business day. During business hours, when shoppers are present, stocking and restocking mishaps could also affect a shopper or child, which is a liability concern that retailers obviously desire to avoid.

SUMMARY OF THE INVENTION

A bulk packed cartridges for rolling products and serpentine dispenser system provides for simplified and safer stocking and restocking of the dispenser, as well as jam-free feeding of rolling products (e.g., cans) from a cartridge through the dispenser. In various embodiments, a pre-opening flap (henceforth referred to as "priming flap") and retaining flap allow a cartridge containing rolling products to be inverted and prepared for insertion into a dispenser while rolling products in the cartridge are prevented from falling out of the cartridge, without additional action by a stock clerk. In some embodiments the priming flap is held against a dispenser resting surface by a stock person with one hand, while pushing the cartridge into the dispenser with another hand, causing the retaining flap to be removed from the cartridge and create a functional opening in the cartridge. In alternative embodiments, a tab is provided on the resting surface to engage a slot in the priming flap. Thus, the tab thus holds the priming flap against the resting surface so the stock person can push the cartridge into the dispenser with one hand only.

In some embodiments, a sprung impedance ridge on a cartridge loading ramp forces rolling products in the cartridge to load into the dispenser in an order that prevents jamming. In alternative embodiments, a substantially S-shaped down chute constrains movement of rolling products exiting the cartridge such that movement of some rolling products remaining in the cartridge is impeded while other rolling products exit the cartridge in an order that prevents jamming.

In other self-opening embodiments, a dispenser wedge is provided that enters a slot in the cartridge and applies downward pressure on rolling products in the cartridge, causing a perforated retaining flap in the cartridge bottom to open, as the cartridge is pushed into the dispenser with one hand. In some embodiments, the wedge also impedes movement of some rolling products in the cartridge until other rolling products have exited the cartridge in an order that prevents jamming. In still other embodiments, a substantially S-shaped down chute is combined with the self-opening wedge and slotted cartridge to constrain rolling products to exit the cartridge in an order that prevents jamming.

DETAILED DESCRIPTION OF THE INVENTION

Improved product dispensers and cartridges preferably provide a dispensing system that biases, or forces, cans contained in a bulk packed cartridge to dispense in a natural or preferred sequence that will prevent jamming of the critical first four cans in the cartridge. Additionally, a cartridge that facilitates dispenser stocking without danger of product prematurely exiting the cartridge reduces risk to personnel, and simplifies the stocking process thereby saving time and expense.

Figure 1:
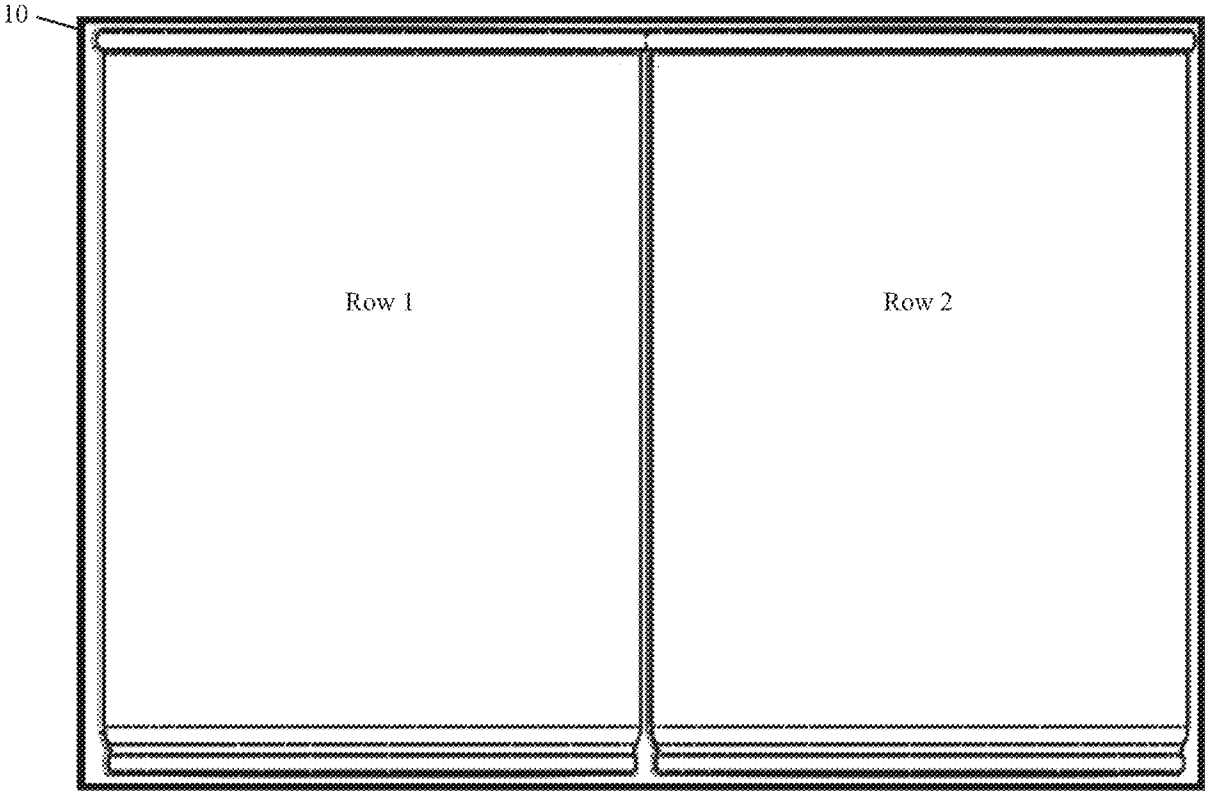
FIG. 1 PRIOR ART
FIG. 1 shows an open end view of a prior art double row product cartridge.
Figure 2:
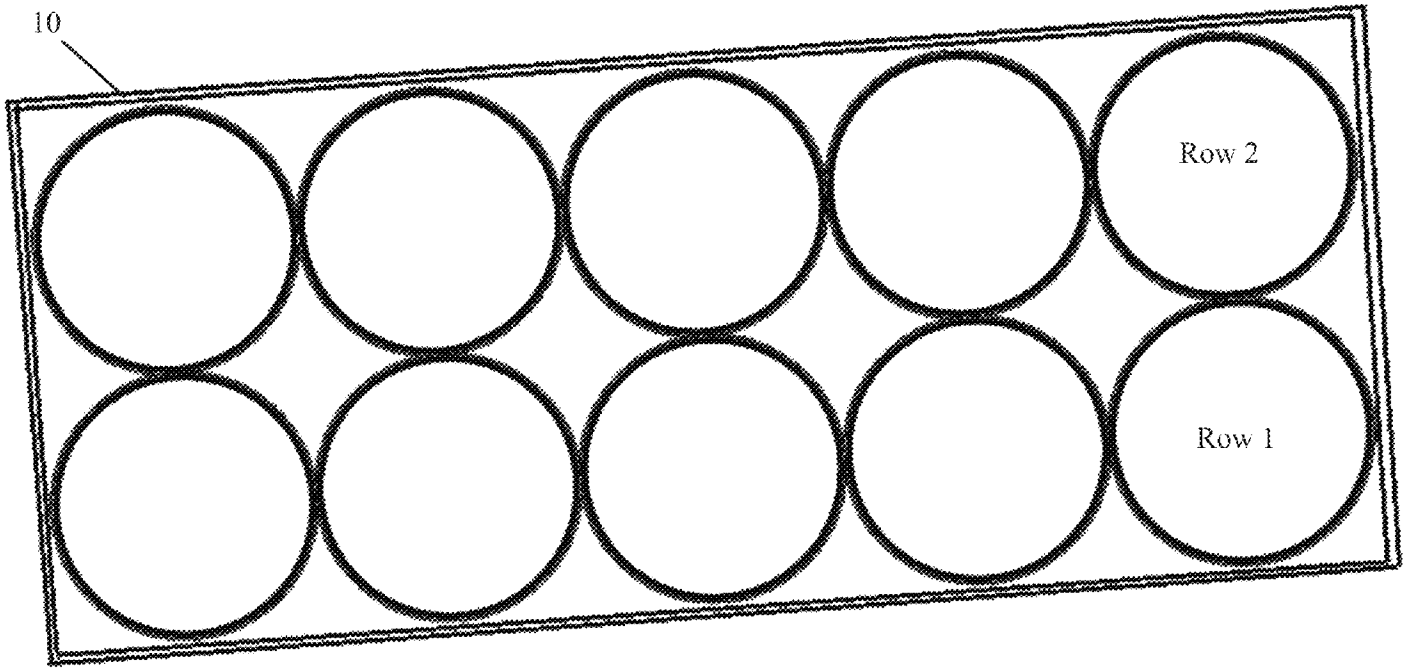
FIG. 2 PRIOR ART
FIG. 2 shows an open side view of a prior art double row product cartridge.
Figure 3:
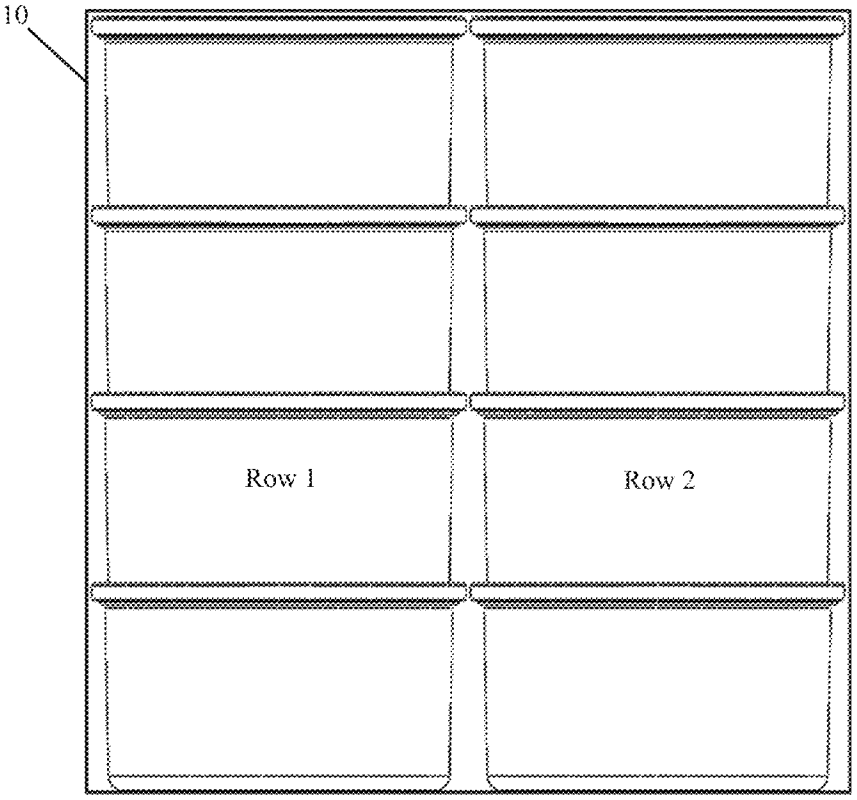
FIG. 3 PRIOR ART
FIG. 3 shows an open side view of a prior art stacked double row product cartridge.
Figure 4:
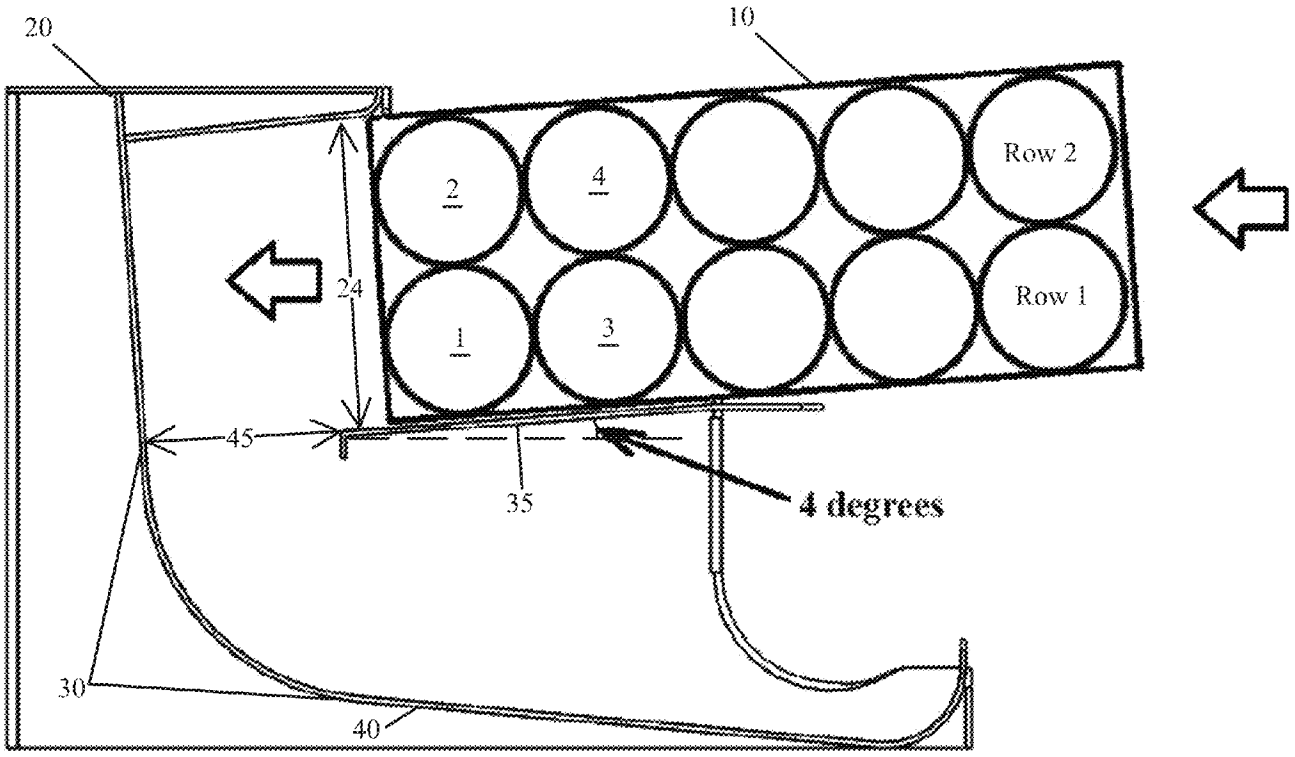
FIG. 4 PRIOR ART
FIG. 4 shows an open side view of a prior art double row product cartridge partially inserted in a prior art product dispenser.
Figure 5:
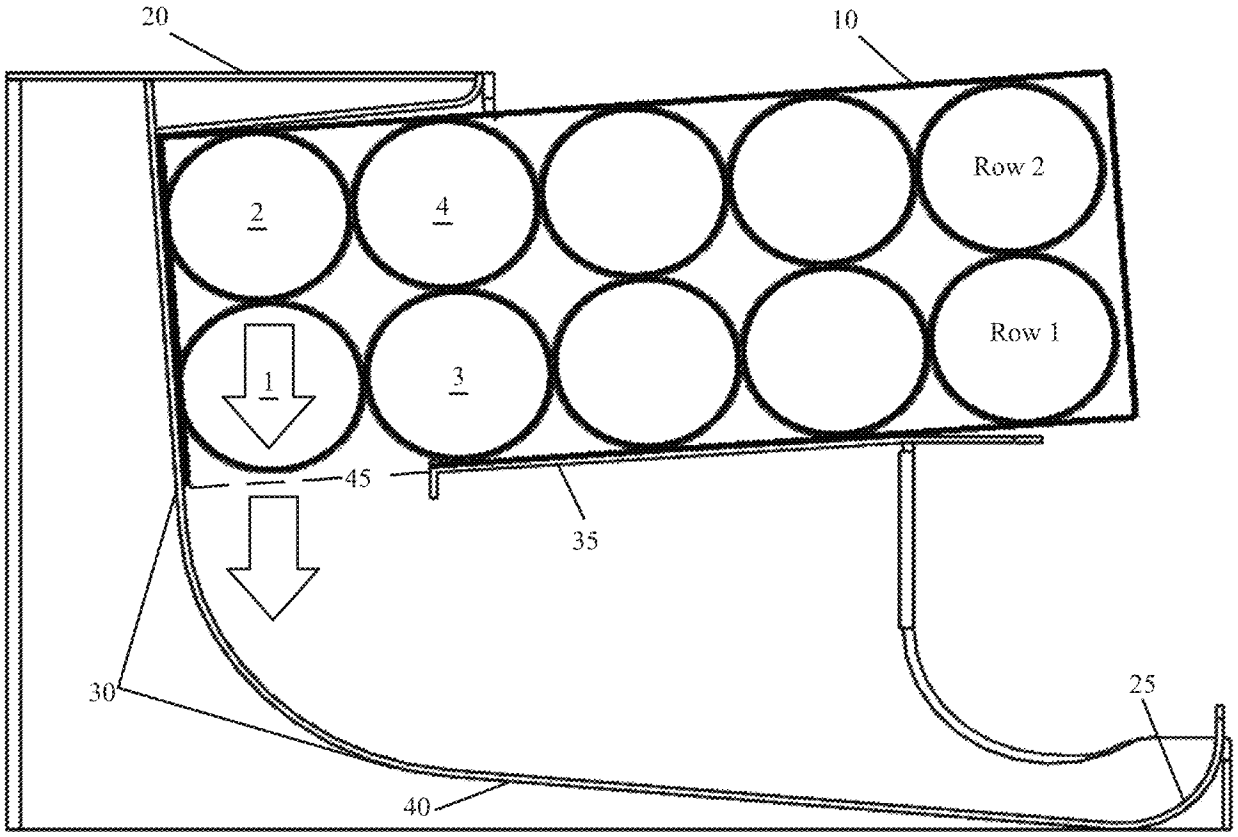
FIG. 5 PRIOR ART
FIG. 5 shows an open side view of a prior art double row product cartridge in a prior art dispenser with a down chute prior to dispensing cans from the cartridge.
Figure 6:
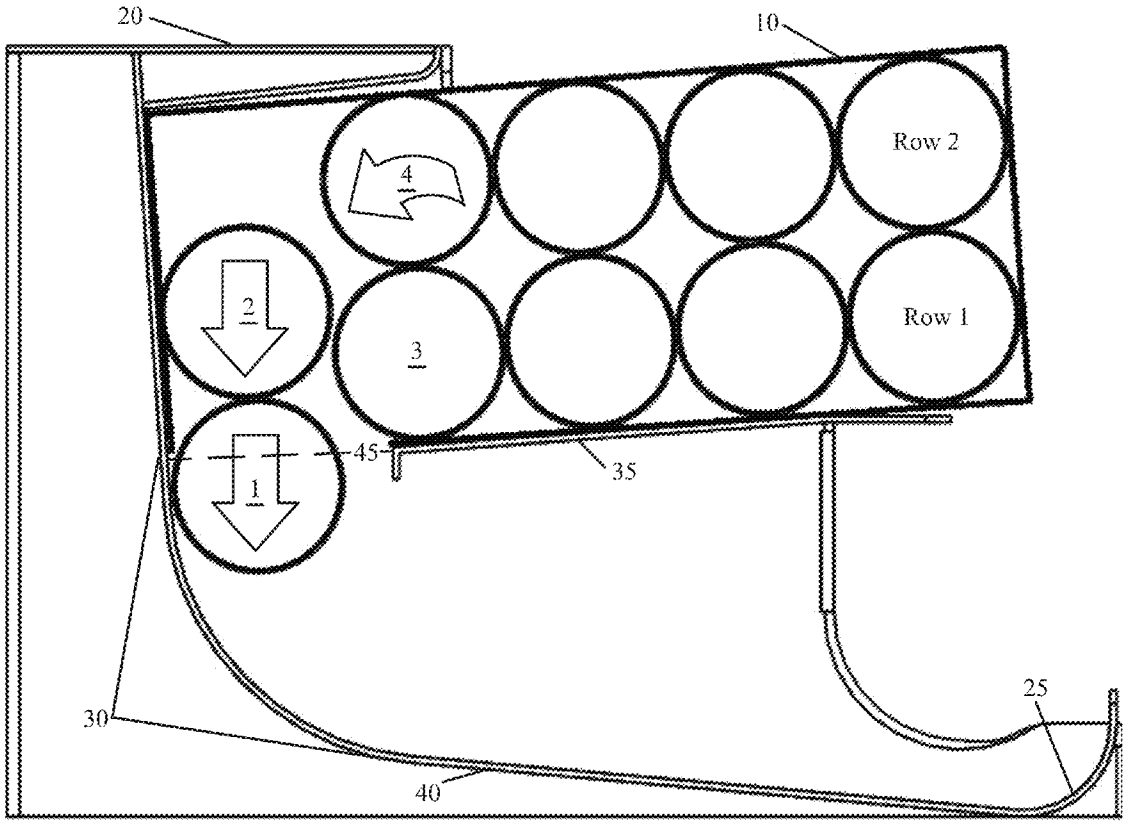
FIG. 6 PRIOR ART
FIG. 6 shows an open side view of a prior art double row product cartridge at the start of a typical dispensing sequence, with the first cans in each row of product moving toward the prior art dispenser down chute.
Figure 7:
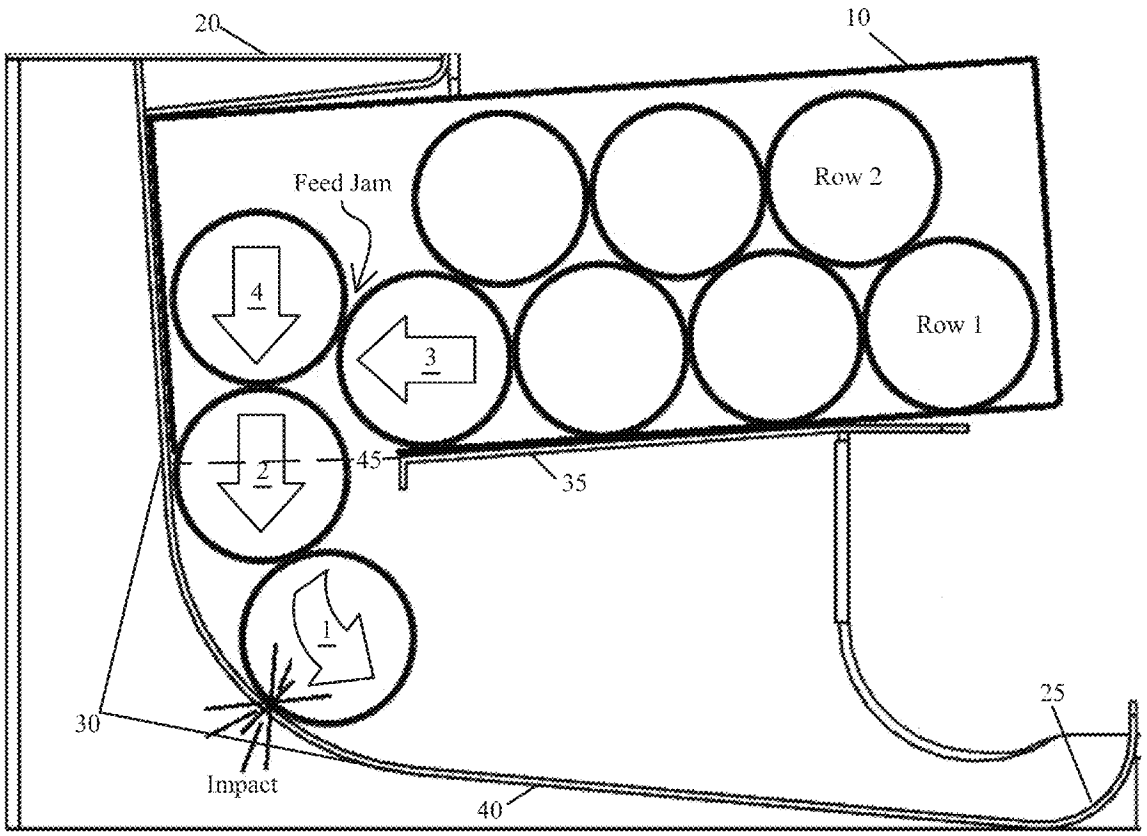
FIG. 7 PRIOR ART
FIG. 7 shows an open side view of a prior art double row product cartridge after the first cans in each row of product have entered the prior art dispenser down chute, and the second can of the second row has started to move toward the down chute.
Figure 8:
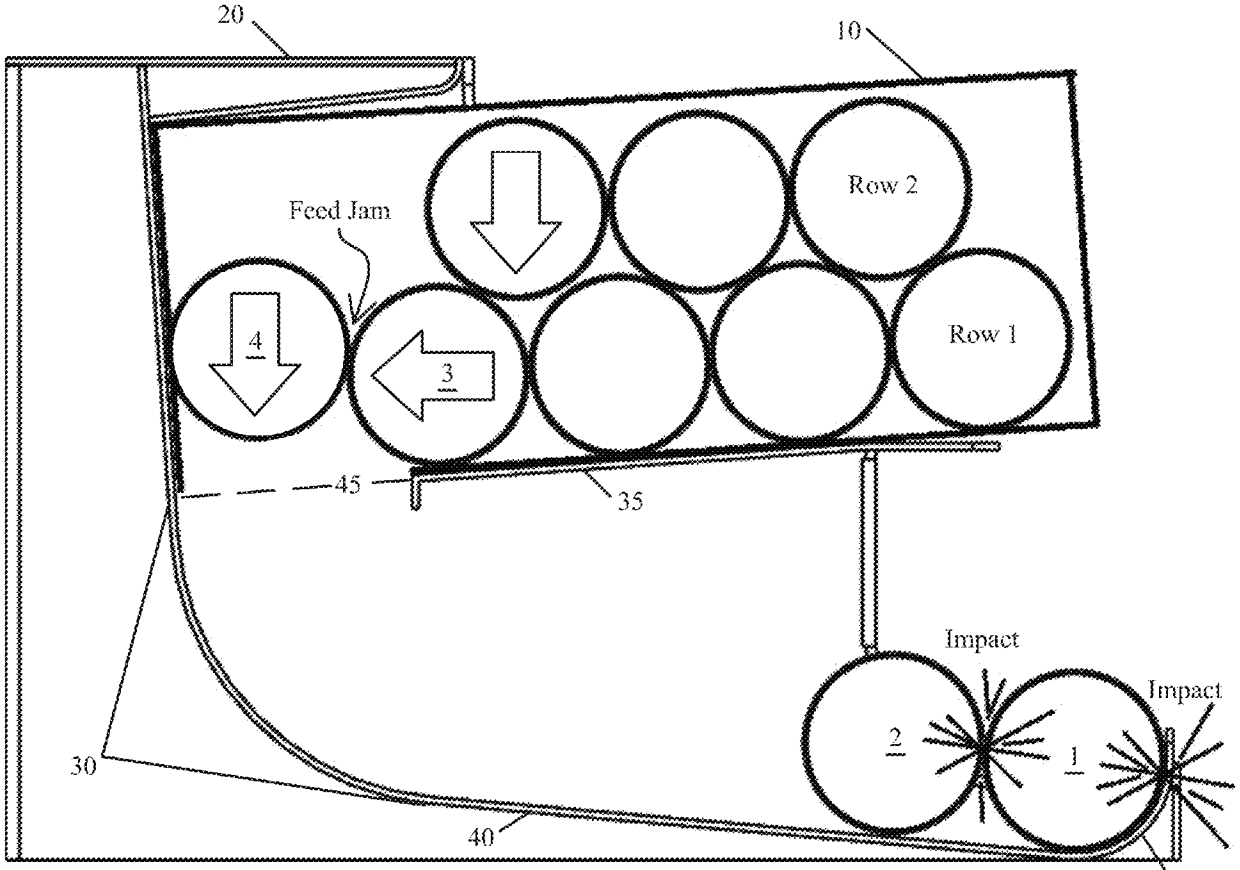
FIG. 8 PRIOR ART
FIG. 8 shows an open side view of a prior art double row product cartridge in which the second can of the second row of product contained in the cartridge has caused a feed jam inside the cartridge.
Figure 9:
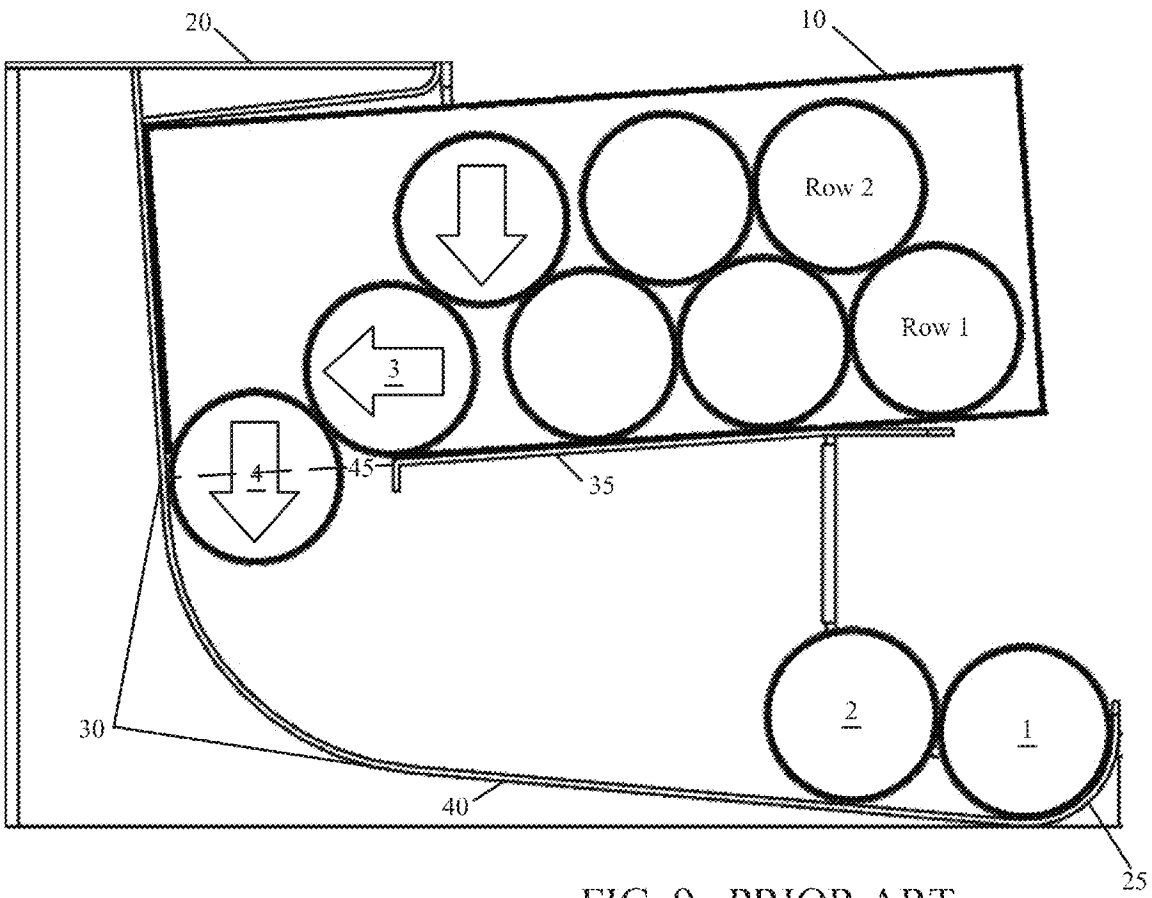
FIG. 9 PRIOR ART
FIG. 9 shows an open side view of a prior art double row product cartridge in which the feed jam inside the cartridge has been cleared and the second can in the second row of product in the cartridge has moved into the prior art dispenser down chute.
Figure 10:
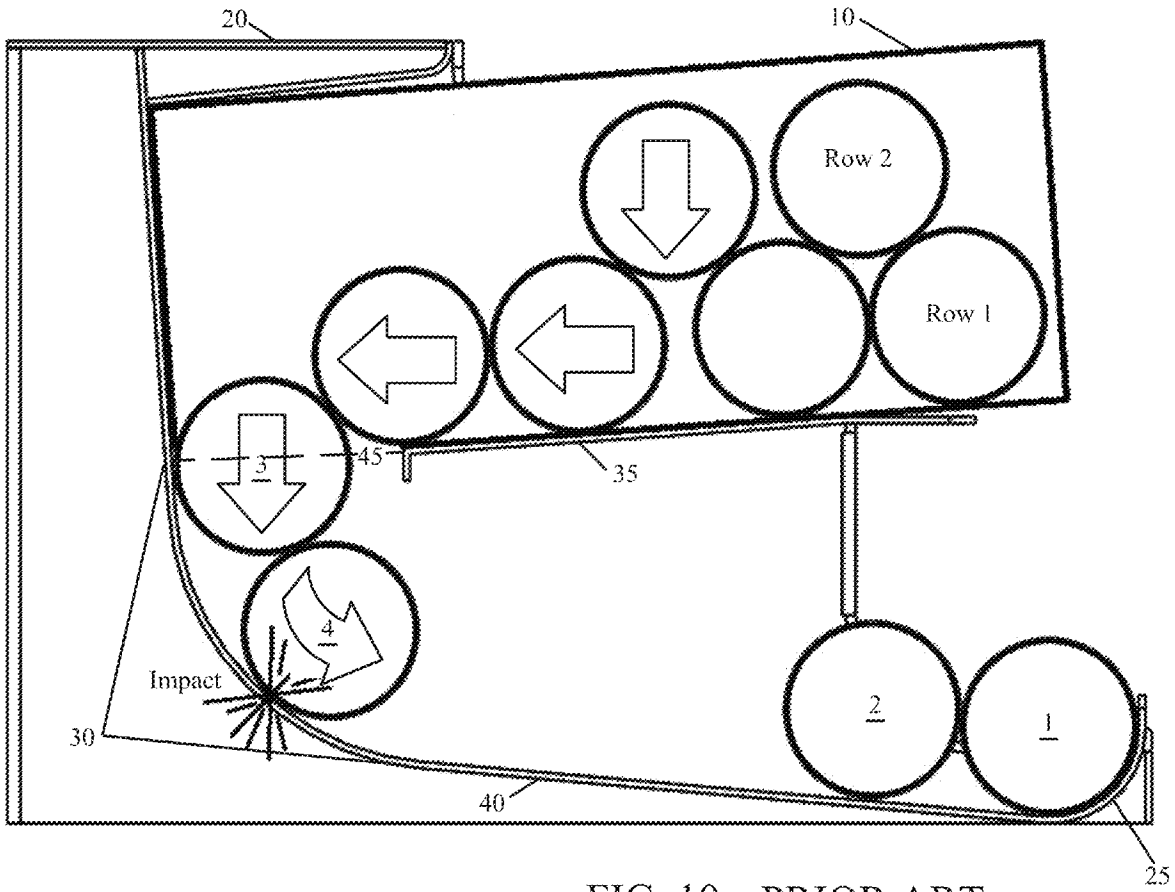
FIG. 10 PRIOR ART
FIG. 10 shows an open side view of a prior art double row product cartridge in which the feed jam inside the cartridge has been cleared and the second can and third can in the first row of product in the cartridge are free to feed normally into the prior art dispenser down chute.
Figure 11:
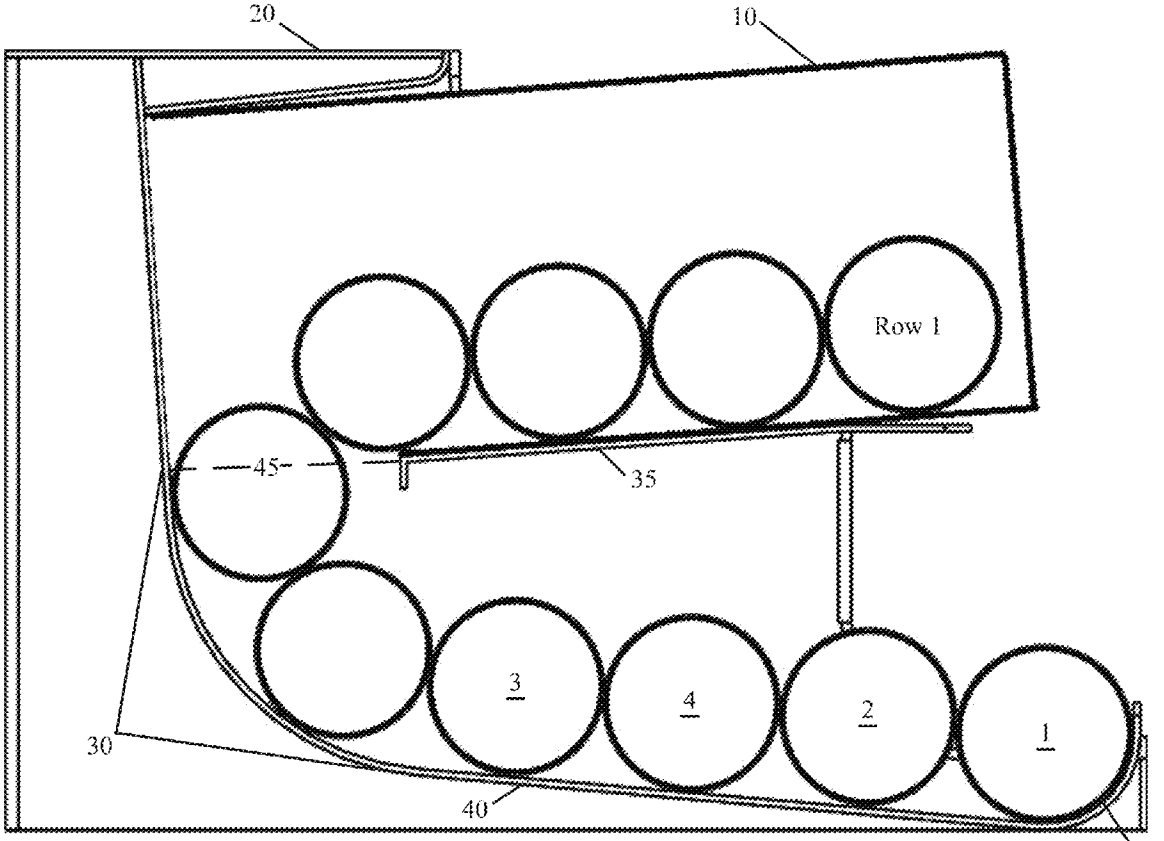
FIG. 11 PRIOR ART
FIG. 11 shows an open side view of a prior art double row product cartridge in which the lower feed ramp of the prior art dispenser has been filled with cans, and the cans remaining in the cartridge are free to feed normally.
Figure 12:
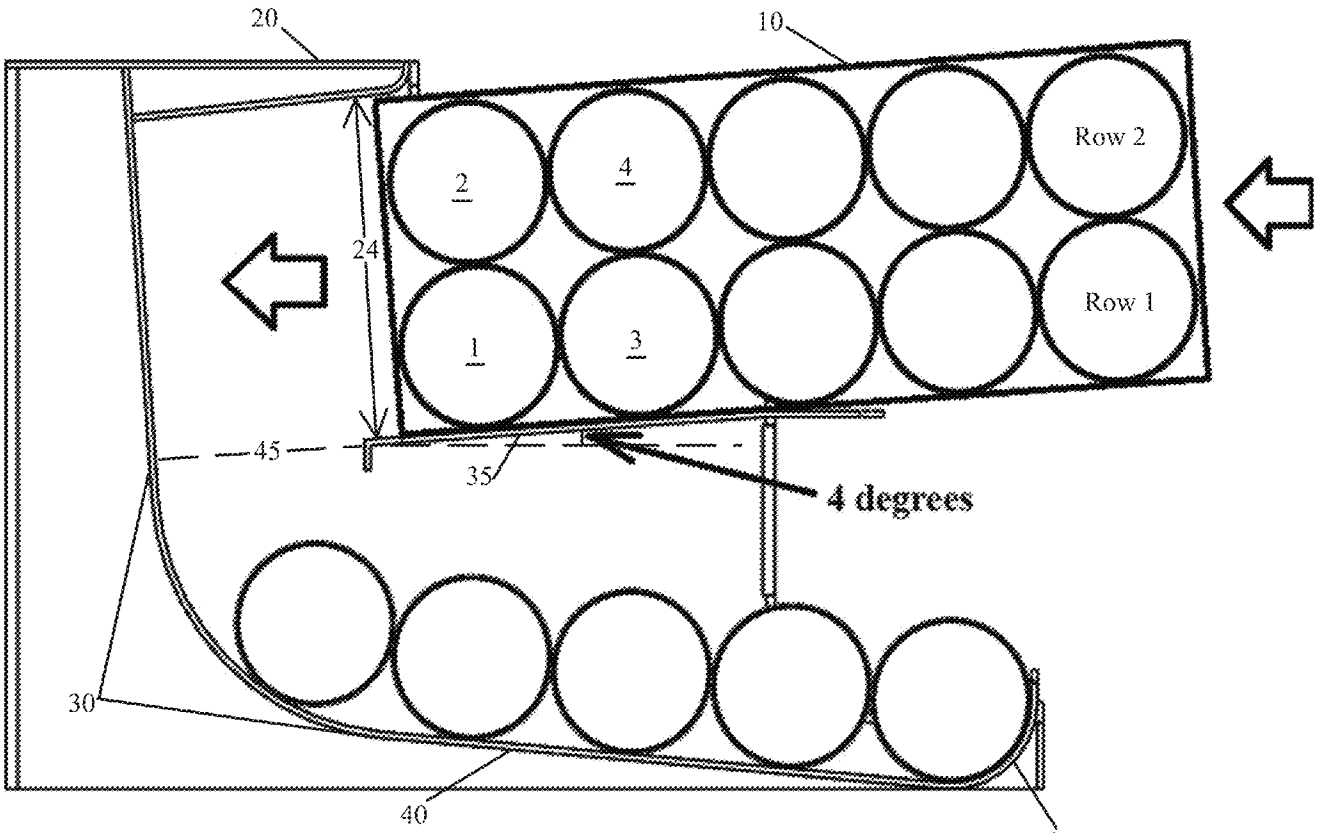
FIG. 12 PRIOR ART
FIG. 12 shows an open side view of a full prior art double row product cartridge partially inserted into a prior art dispenser that is partially full.
Figure 13:
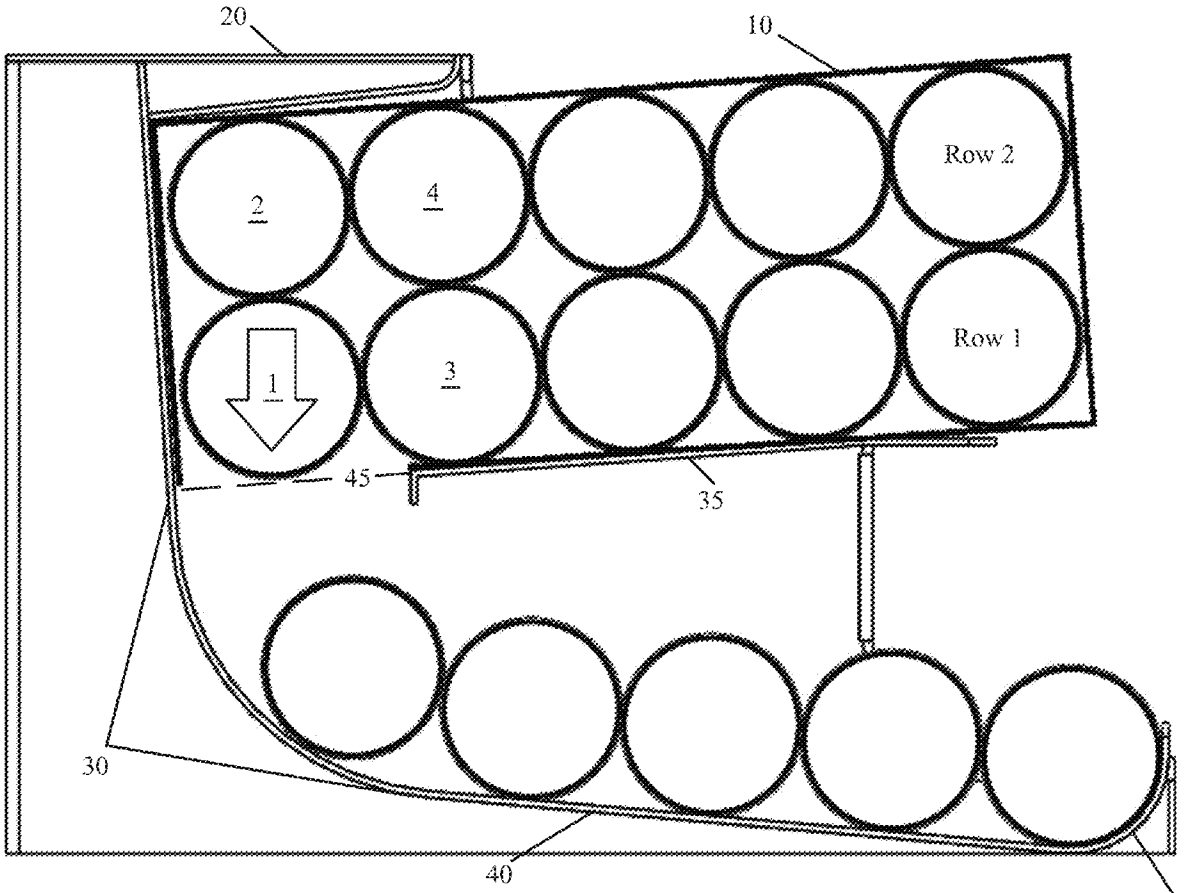
FIG. 13 PRIOR ART
FIG. 13 shows an open side view of a prior art double row product cartridge in a prior art dispenser with a down chute and a lower feed ramp partially full of cans prior to dispensing cans from the cartridge.
Figure 14:
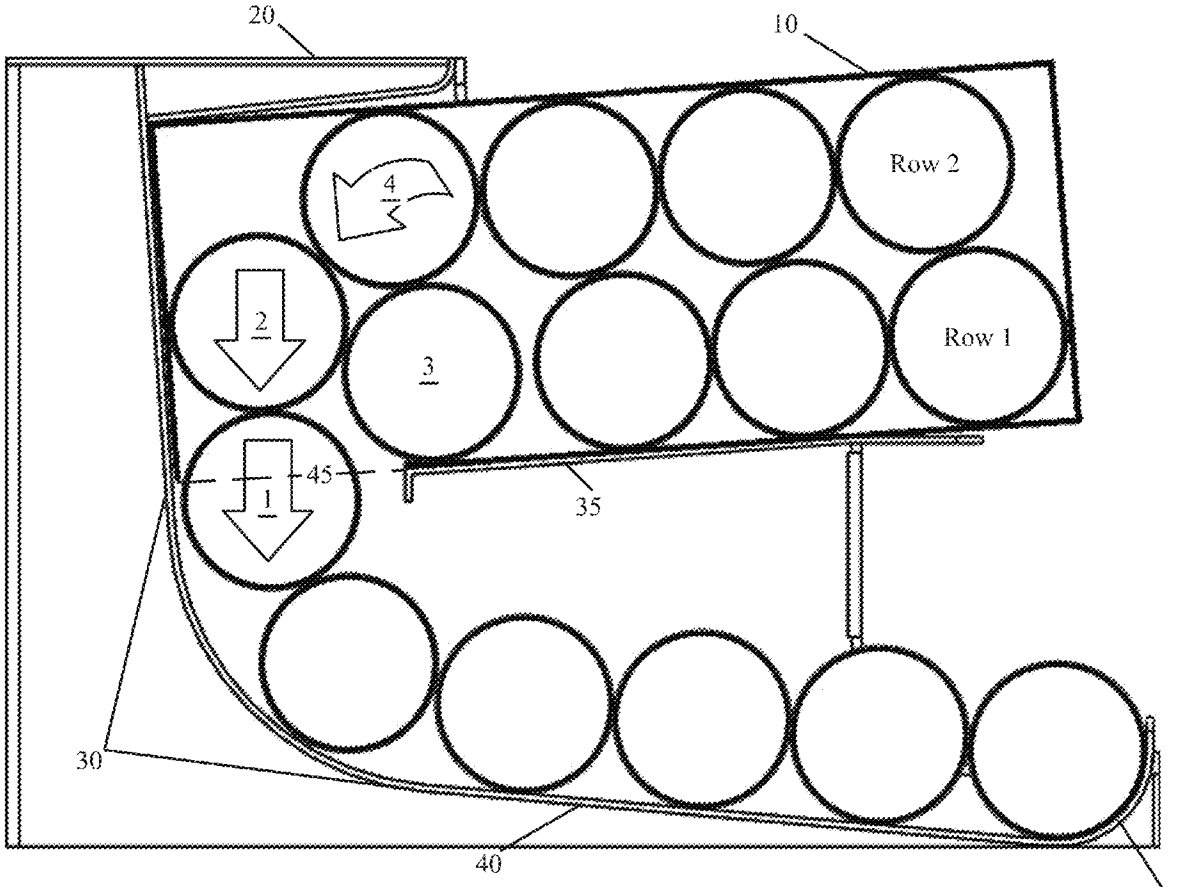
FIG. 14 PRIOR ART
FIG. 14 shows an open side view of a prior art double row product cartridge and partially full prior art dispenser, while the first cans in the first and second rows of product in the cartridge move toward the down chute.
Figure 15:
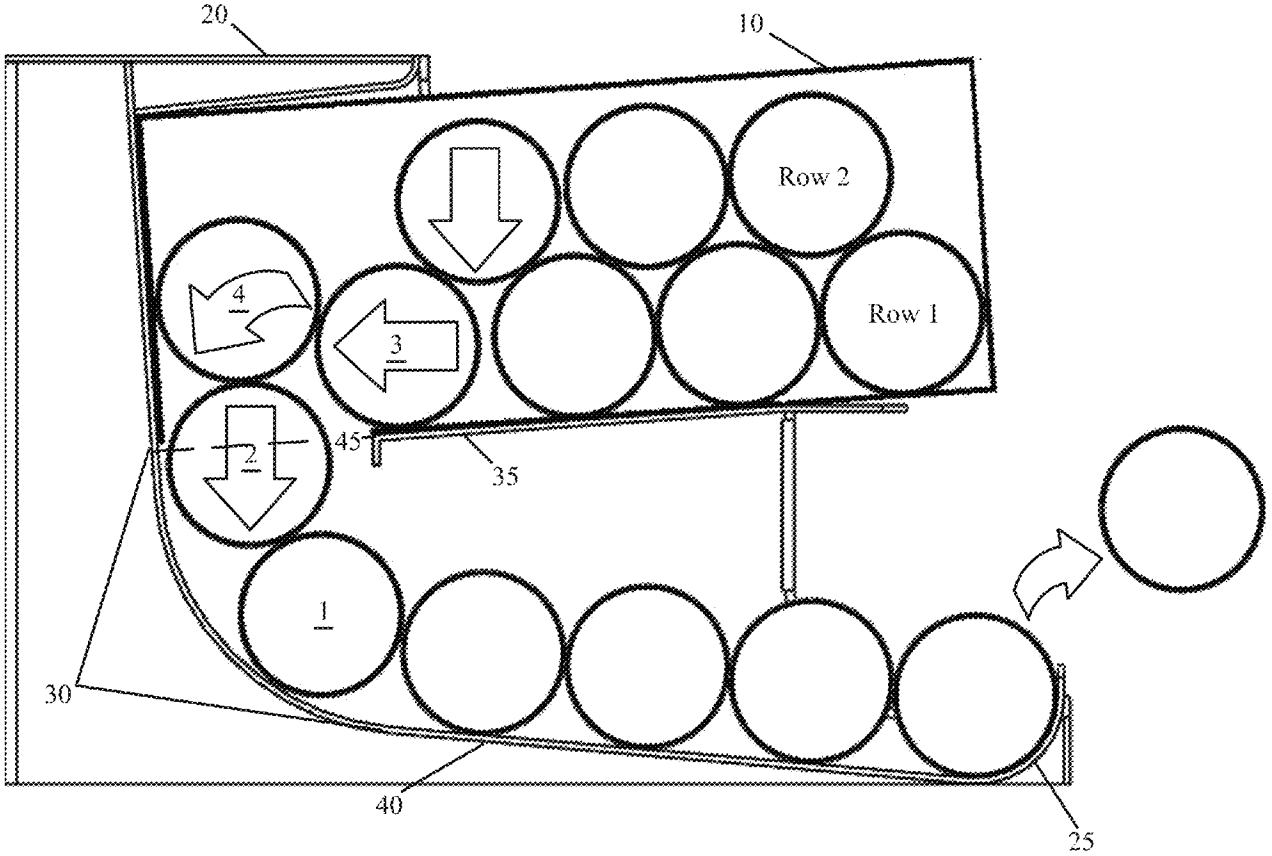
FIG. 15 PRIOR ART
FIG. 15 shows an open side view of a prior art double row product cartridge and partially full dispenser and the motion of cans in the cartridge when a can is removed from the product selection area of the prior art dispenser.
Figure 16:
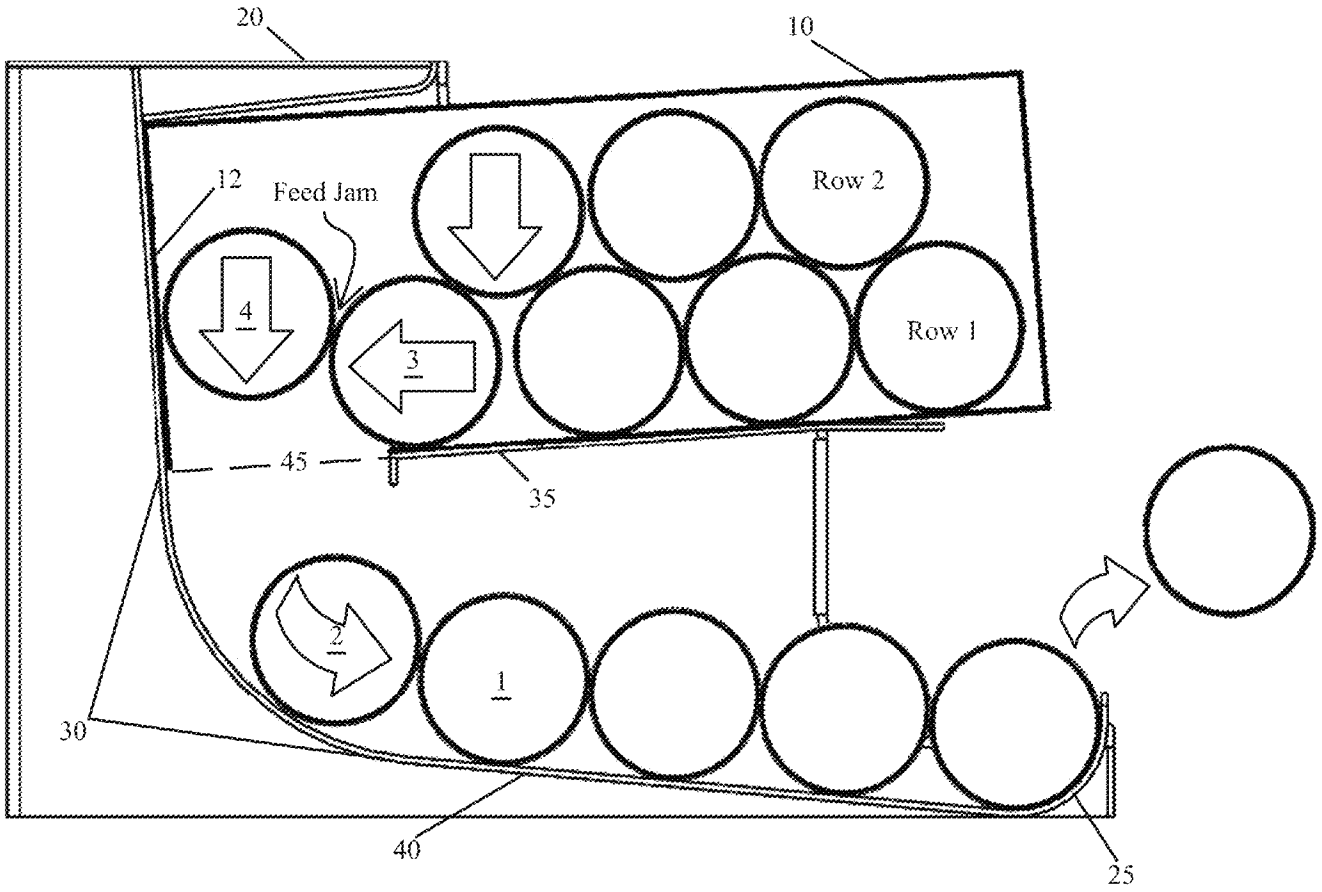
FIG. 16 PRIOR ART
FIG. 16 shows an open side view of a prior art double row product cartridge in which the second can of the second row of product contained in the cartridge has caused a feed jam inside the cartridge.
Figure 17:
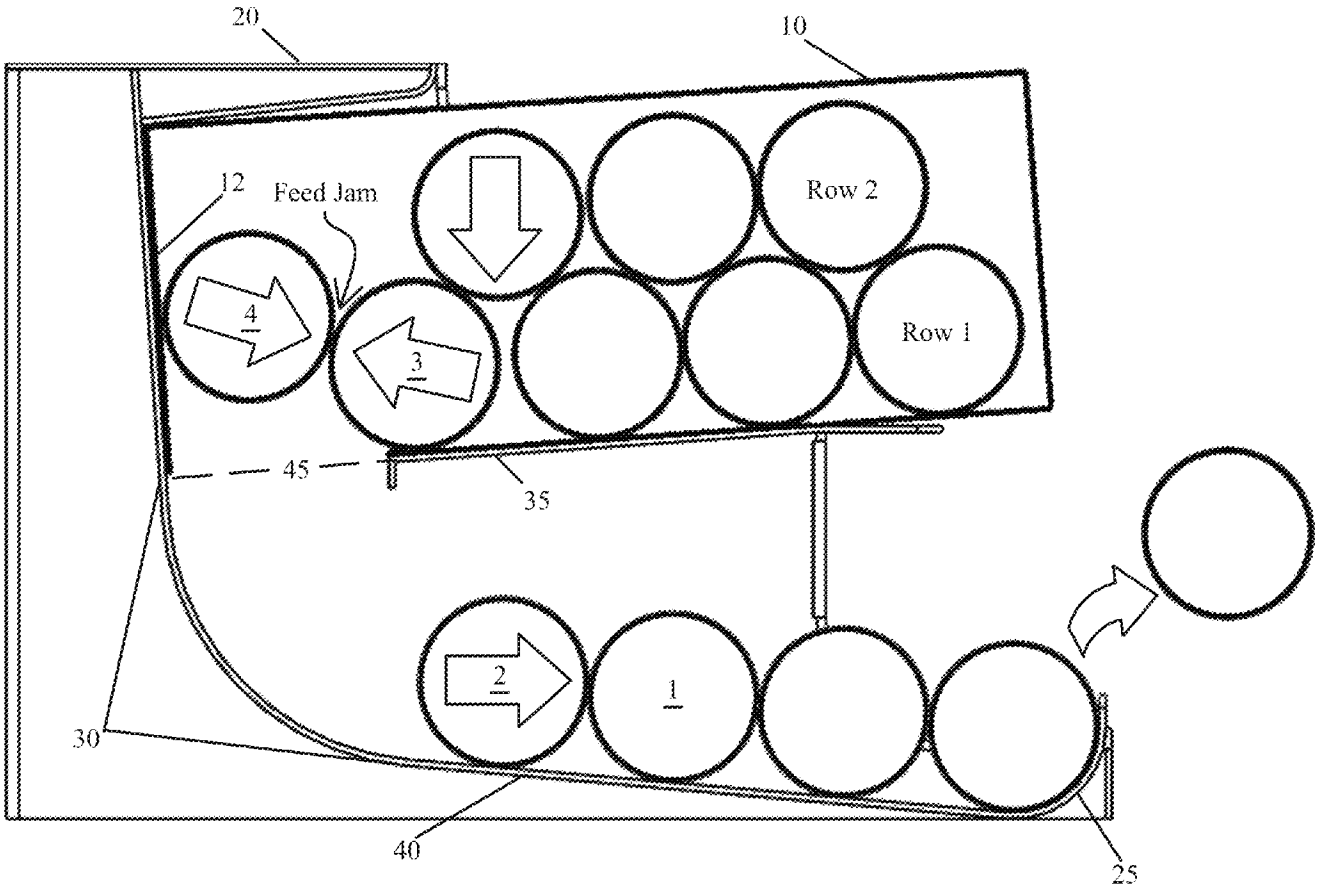
FIG. 17 PRIOR ART
FIG. 17 shows an open side view of a prior art double row product cartridge in which the second can of the second row of product contained in the cartridge causes a feed jam inside the cartridge even as product is dispensed from a product selection area.
Figure 18:
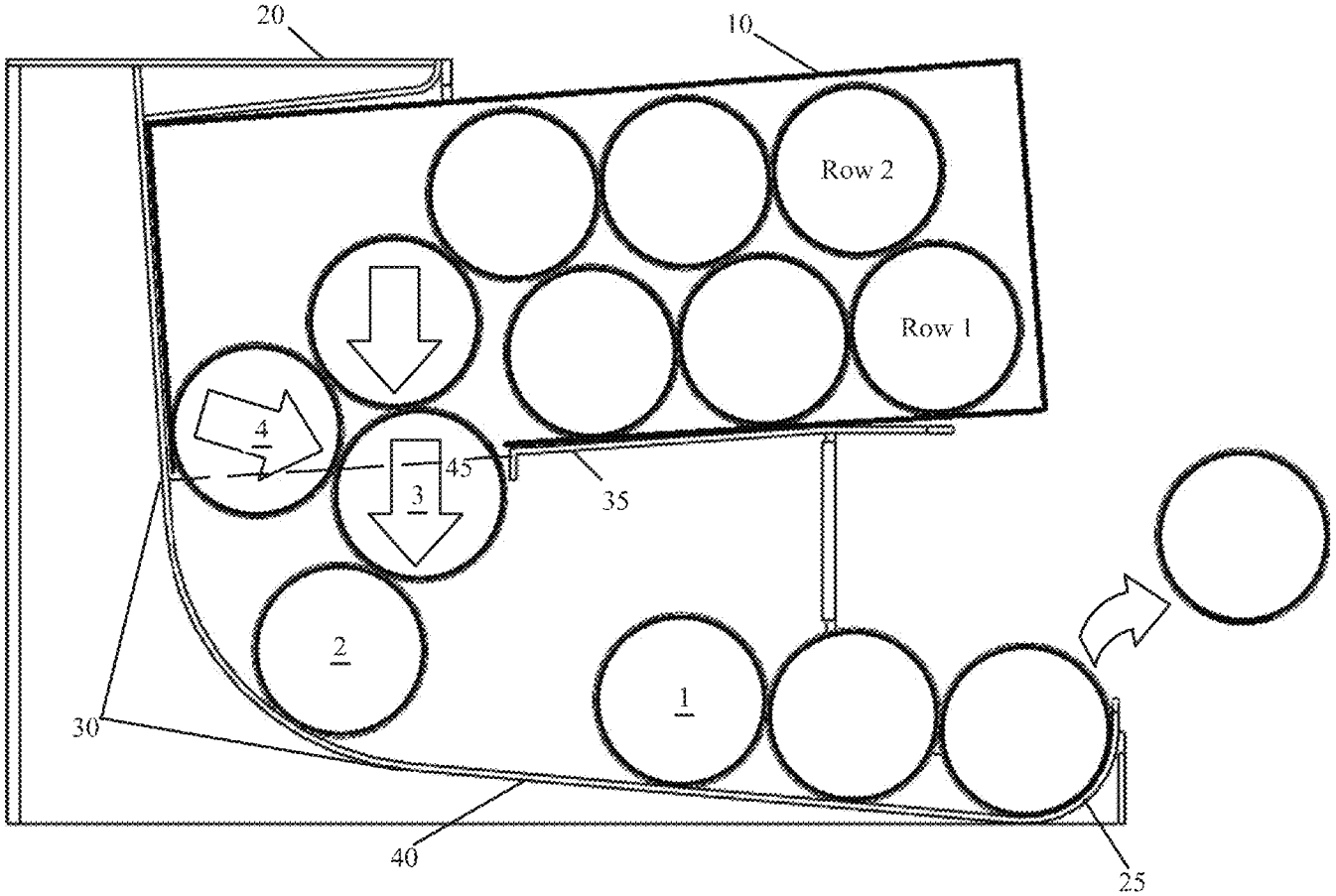
FIG. 18 PRIOR ART
FIG. 18 shows an open side view of a prior art double row product cartridge in which product contained in the cartridge causes a feed jam inside the dispenser when the size of the exit port is increased.
Figure 19:
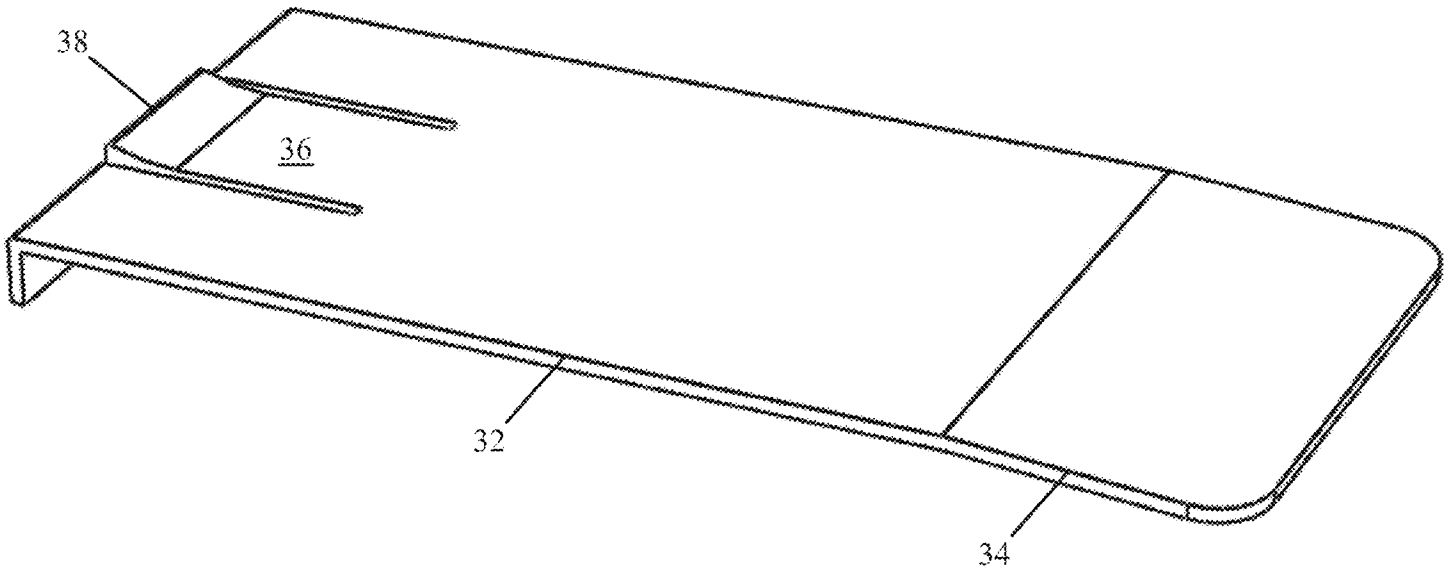
FIG. 19 shows a perspective view of a modified cartridge loading ramp.
Figure 20:
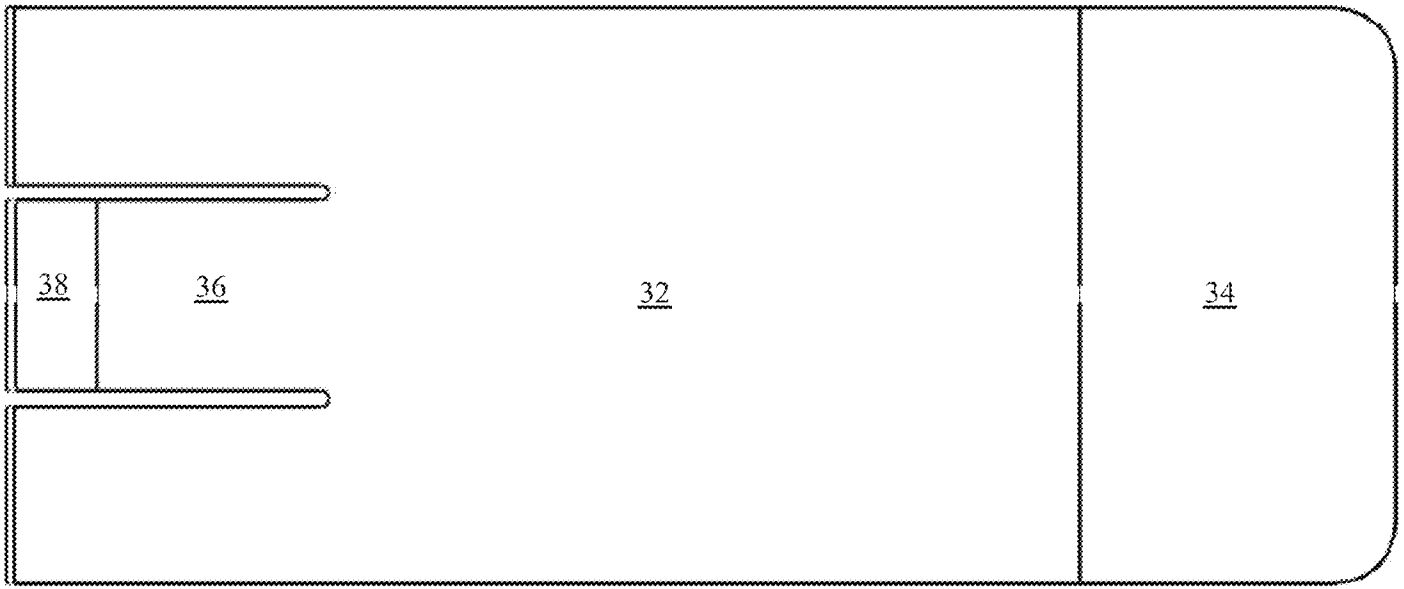
FIG. 20 shows a top view of a modified cartridge loading ramp.

Previous dispenser 20 and packaging design efforts have reasonably assumed that cans would, as shown for example in prior art FIG. 5, exit a cartridge 10 in the numbered order according to their starting location in a cartridge 10; first can 1, then can 2, then can 3, and then can 4. Various past trial and error attempts to solve the product jamming issue were unsuccessful because the cartridges 10 are made from opaque paperboard and it is impossible to see the actions of the cans 1, 2, 3, 4 inside them. Experimenting with a dispenser 20 and cartridge 10 of transparent material, the inventors have found that the cans 1, 2, 3, 4 are actually naturally biased to exit the cartridge 10 in the order; one, two, four, and finally three. As shown sequentially in prior art FIGS. 5-11, can 4 will naturally roll over the top of can 3 before can 3 is able to roll rearward far enough to exit the cartridge. Failure of the prior art to appreciate or recognize the natural tendency of cans 1, 2, 3, 4 to move in this order therefore precluded a systematic and reliable solution to the jams that occur in the prior art; examples of two such jams are shown in FIGS. 16-18.

Figure 21:
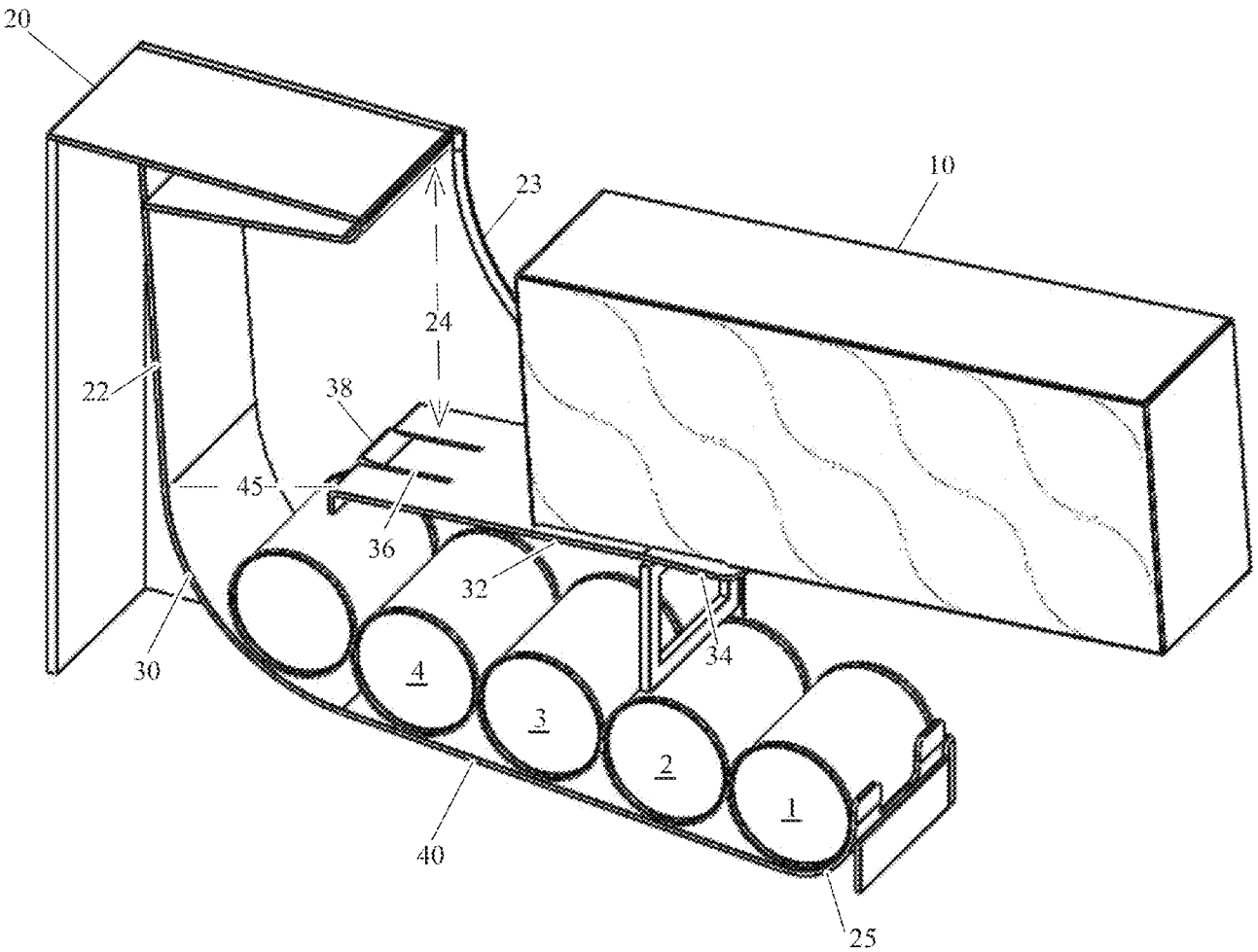
FIG. 21 shows a partial cut away perspective view of a dispenser with modified cartridge loading ramp.
Figure 22:
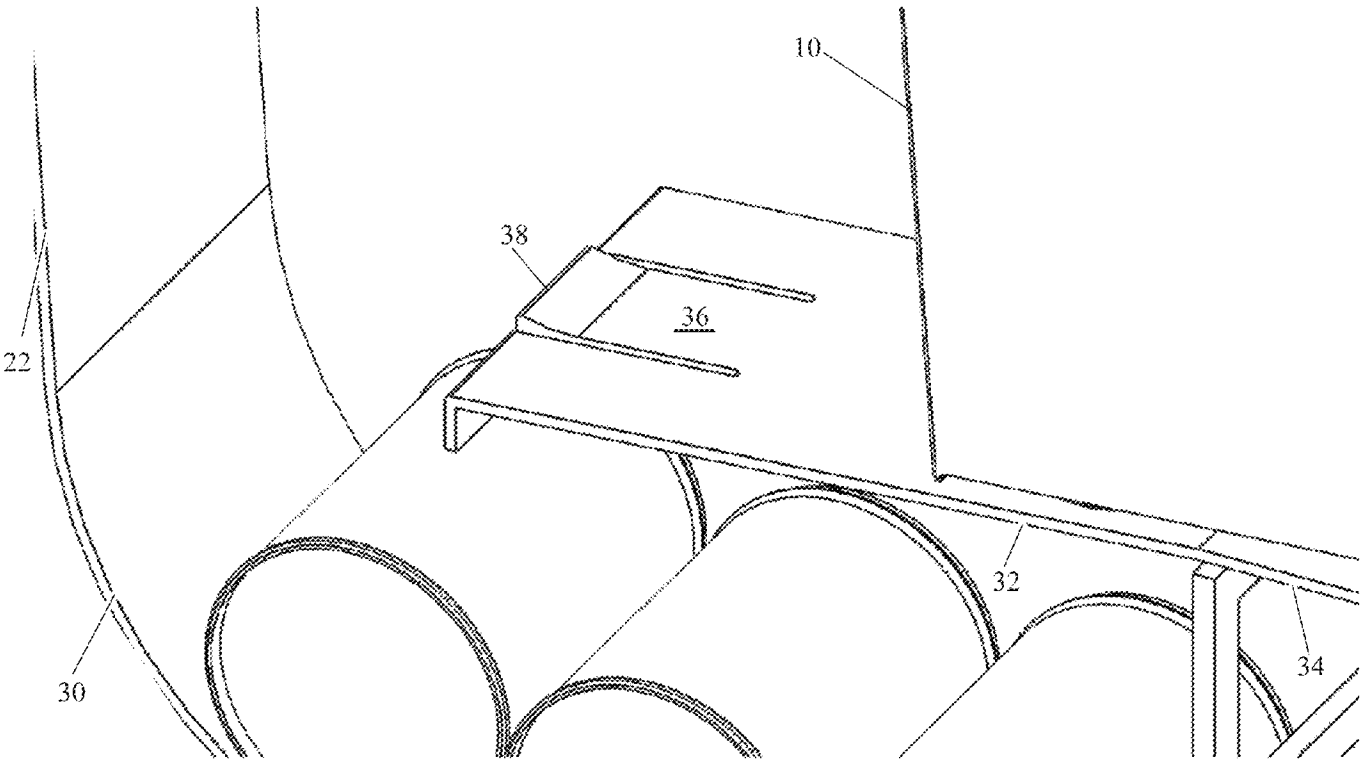
FIG. 22 shows a perspective detail view of a dispenser with a modified cartridge loading ramp.

In one preferred embodiment, shown for example in FIGS. 19-24, a cartridge loading ramp 32 modification prevents product feed jams by temporarily impeding movement of can 3 and others in the lowest product row (lower row 1) using a sprung impedance ridge 38 integrated into the rear edge of the cartridge loading ramp 32. In this embodiment, an upward protrusion, or impedance ridge 38, shown in FIGS. 19-24, is formed along the center of the cartridge loading ramp 32 parallel to, and on the upper surface and rearmost edge of, the cartridge loading ramp 32. The impedance ridge 38 acts together with the resting inertia of the products in the cartridge 10, to impede movement of can 3 sufficiently to allow can 2 and can 4 to exit the cartridge 10 ahead of it, in their naturally biased one, two, four, three order. As shown in FIGS. 21-22, the impedance ridge 38 with a spring tongue 36 is implemented in a dispenser 20 having a cartridge loading ramp 32, a cartridge resting surface 34, a cartridge holding area 24, a back 22, an exit port 45, a down chute 30, a lower feed ramp 40, two sides (only far side 23 is shown in FIG. 21), and a product dispensing area 25.

Figure 23:
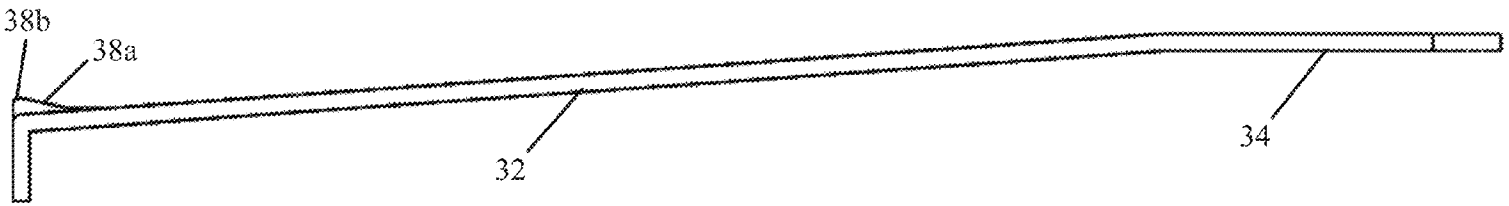
FIG. 23 shows a side view of a modified cartridge loading ramp.
Figure 24:
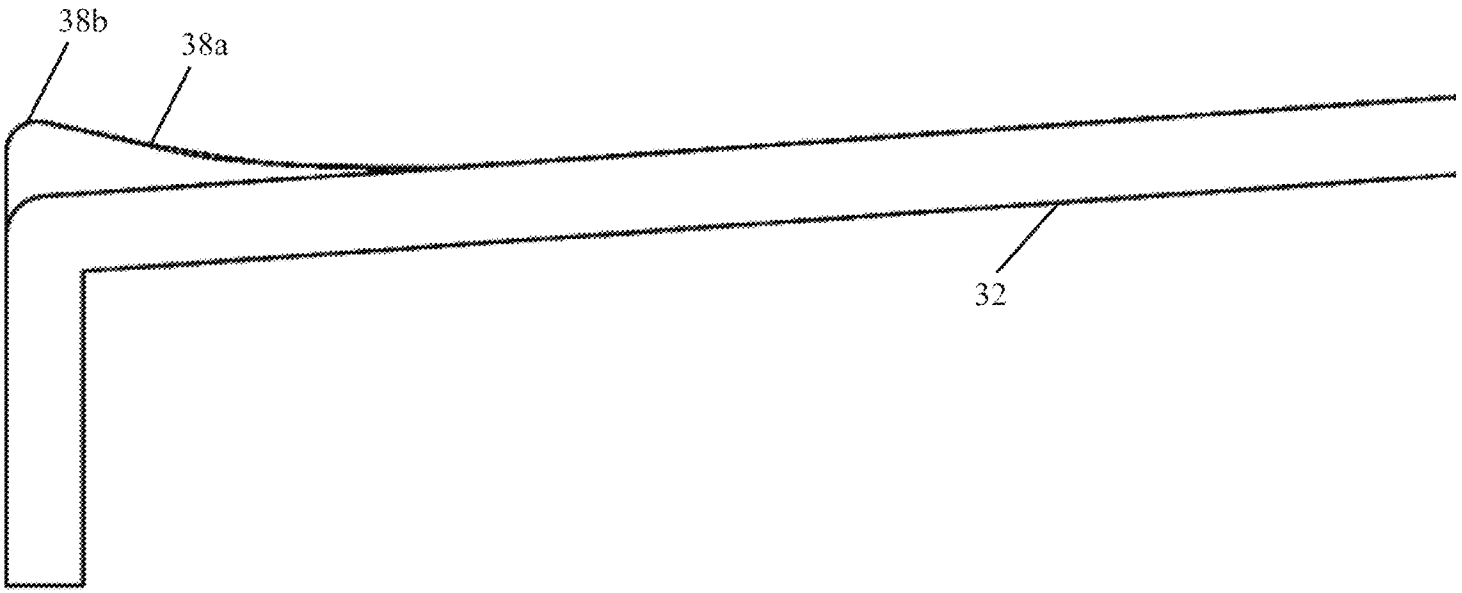
FIG. 24 shows a side view detail of a modified cartridge loading ramp with impedance ridge.
Figure 25:
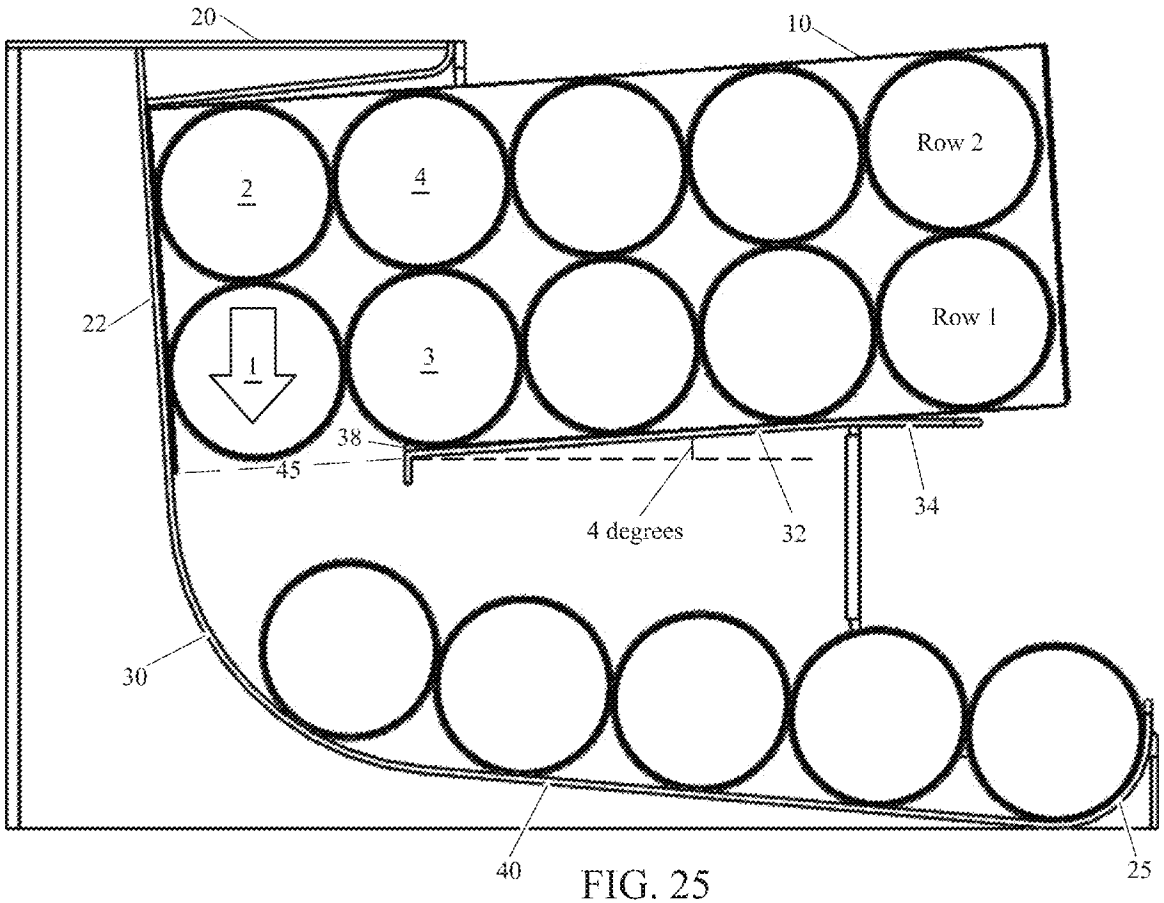
FIG. 25 shows an open side view of a partially full dispenser with a modified cartridge loading ramp with impedance ridge with a full cartridge inserted.
Figure 26:
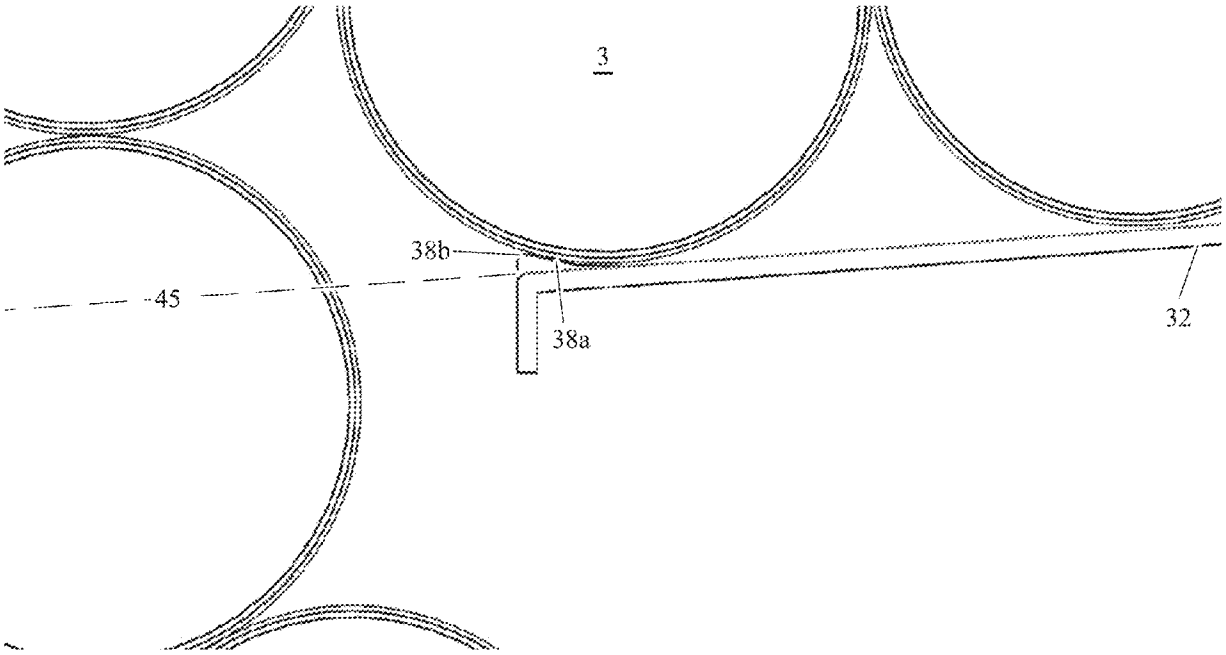
FIG. 26 shows a detail of an impedance ridge interacting with a can in a cartridge.
Figure 27:
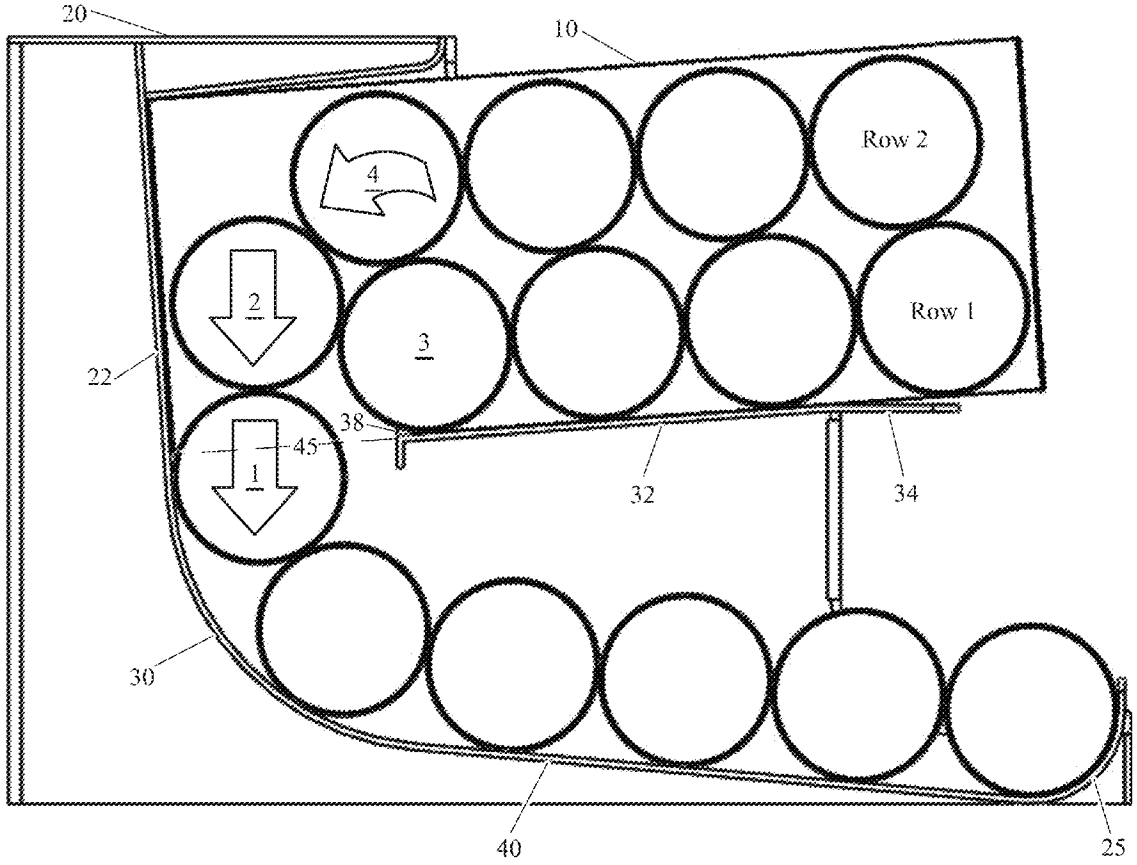
FIG. 27 shows an open side view of a partially full dispenser with a modified cartridge loading ramp with an impedance ridge after a full cartridge has been inserted and cans have moved into the dispenser.
Figure 28:
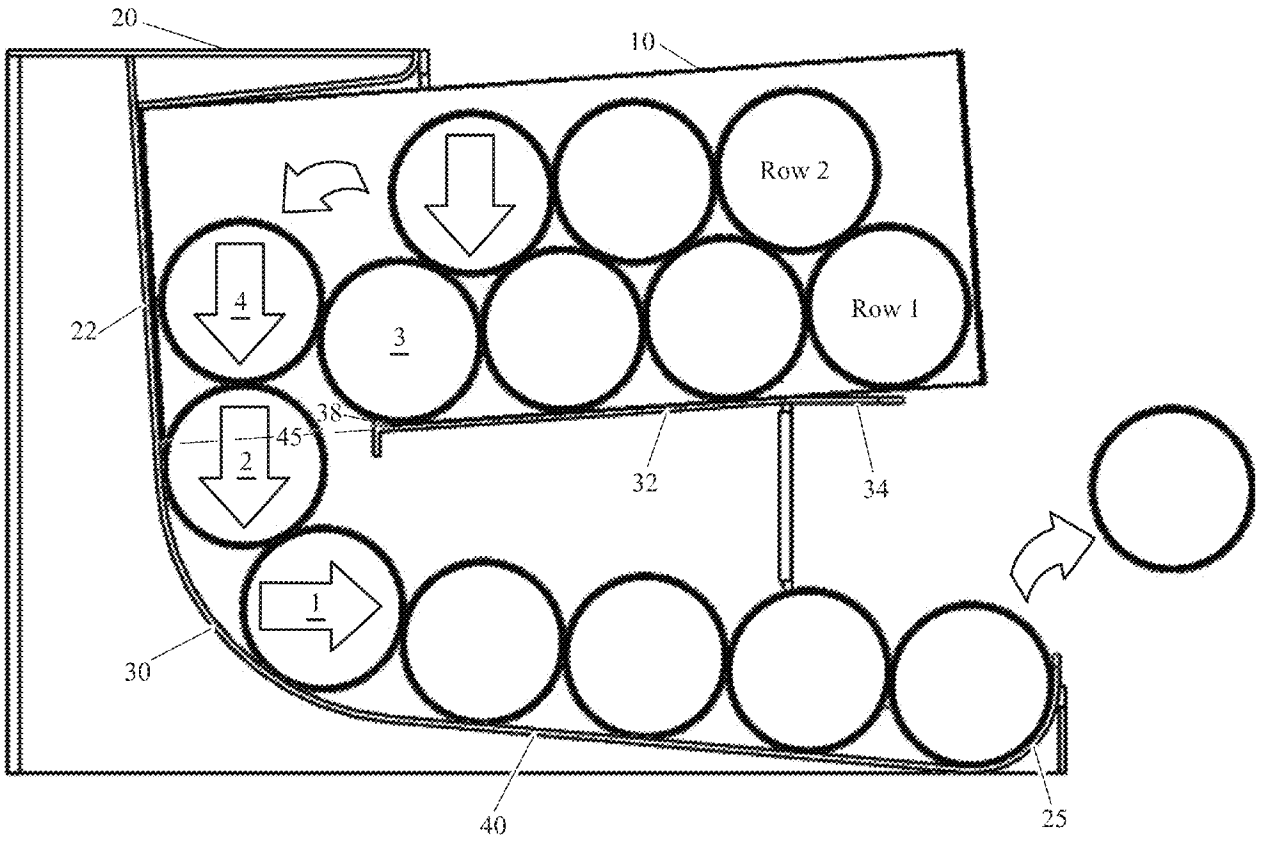
FIG. 28 shows the motion of cans from a cartridge to a dispenser after a can has been removed from the dispenser.
Figure 29:
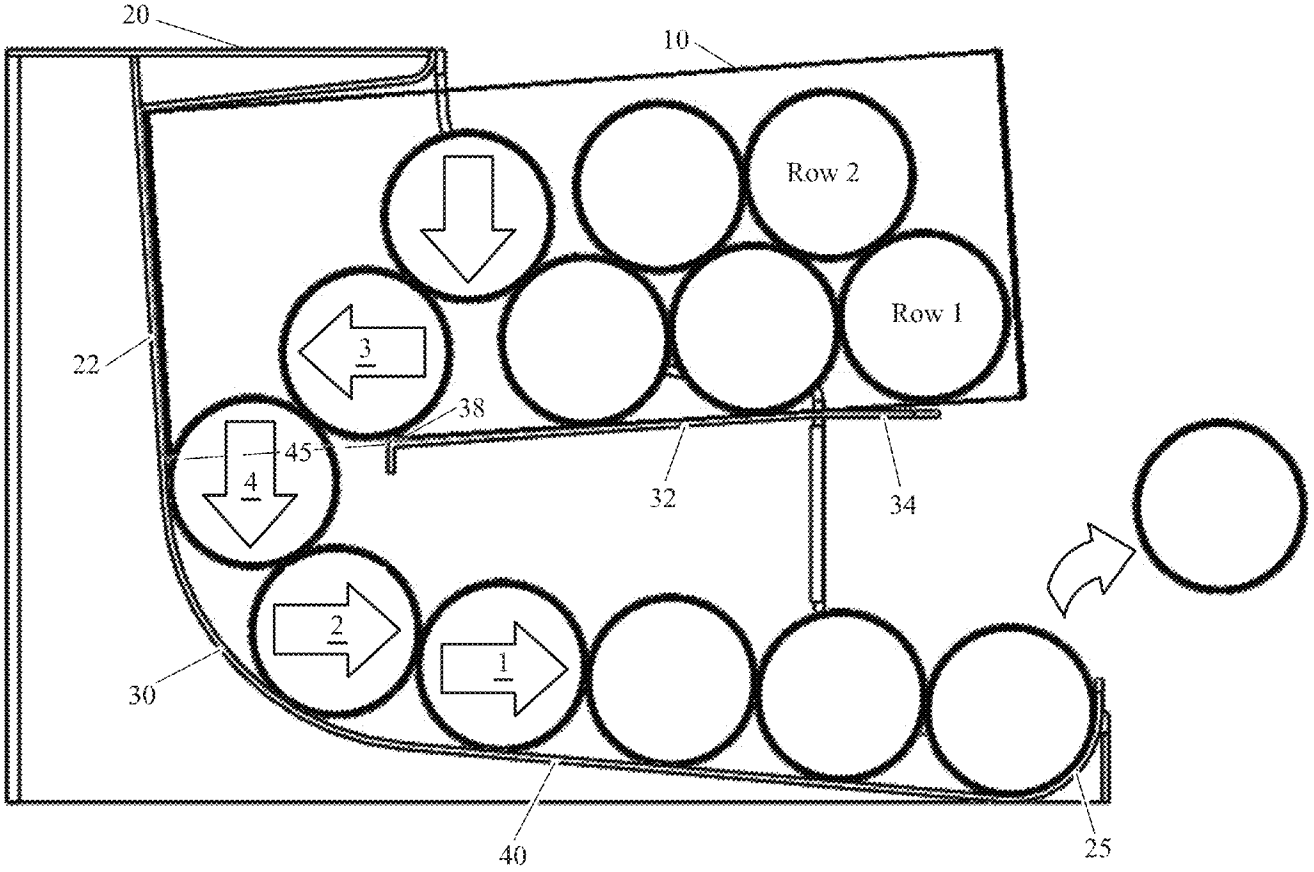
FIG. 29 shows the motion of cans from a cartridge to a dispenser after a can has been removed from the dispenser.
Figure 30:
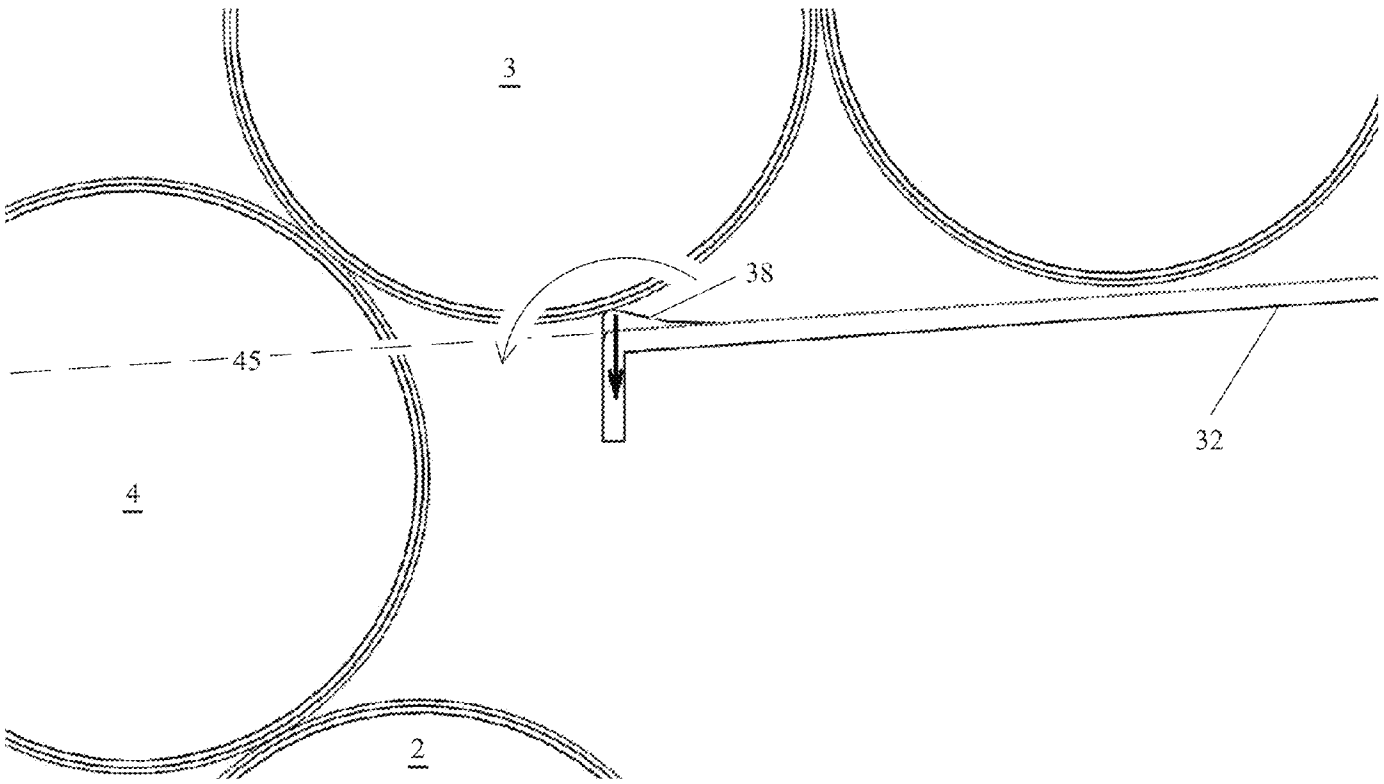
FIG. 30 shows a detail of an impedance ridge interacting with a can in the cartridge.
Figure 31:
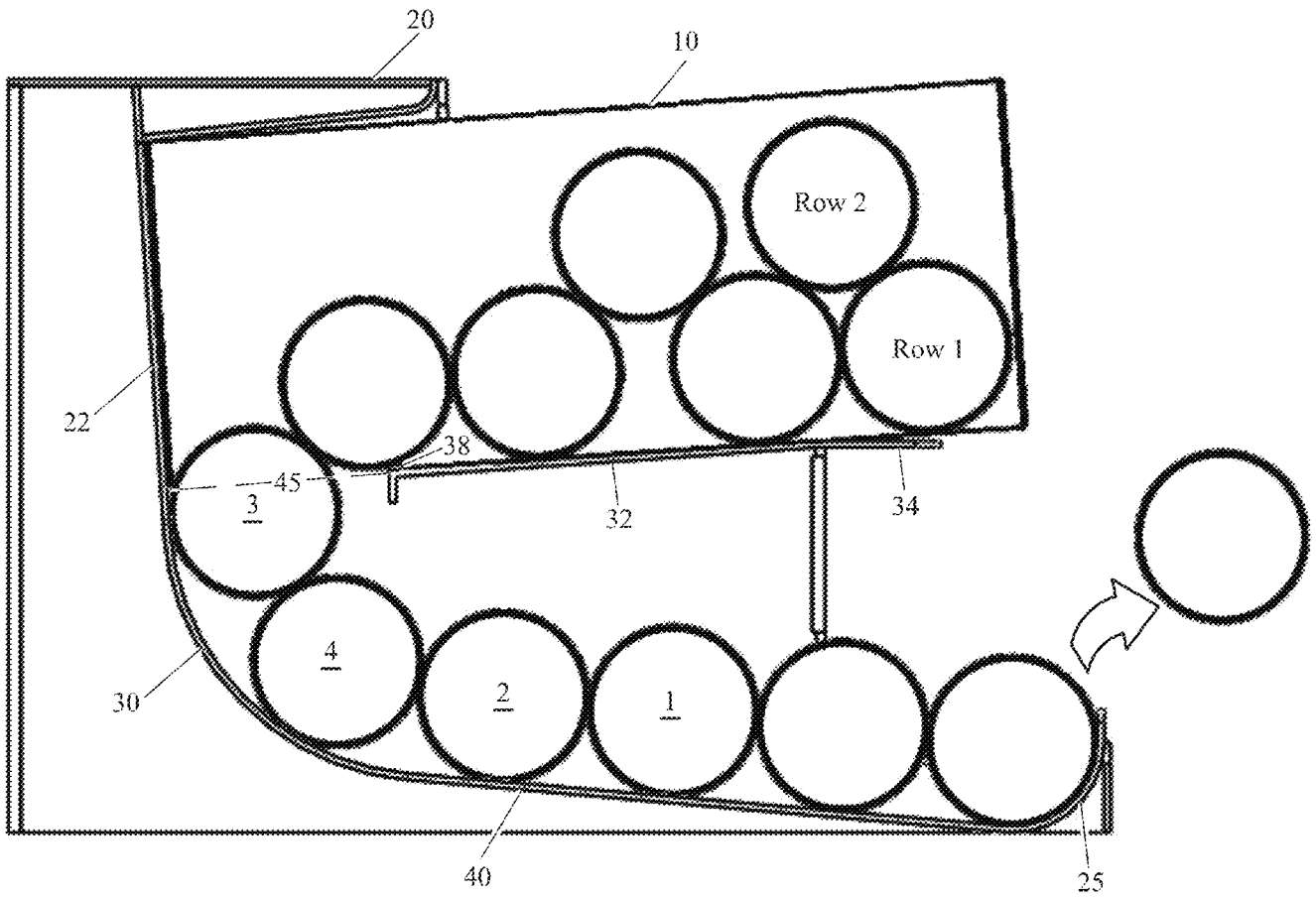
FIG. 31 shows the motion of cans from a cartridge to a dispenser after a can has been removed from the dispenser.

As shown in FIGS. 23-24, the top surface 38*a* of the impedance ridge 38 is a concave curve and has a rounded over end 38*b* at the rear of the cartridge loading ramp 32. As shown in FIGS. 25-26, the concave top surface 38*a* of the impedance ridge 38 is substantially closely concentric and/or co-radial to the outer contacting circumference of can 3 when the full cartridge 10 is installed in the dispenser 20. The impedance ridge 38 thus at first impedes the movement of can 3, and then allows can 3 and those behind it to smoothly roll over the top of the sprung impedance ridge 38 after can 4 exits the cartridge, as shown in FIG. 30. The innermost surface of the ridge may be vertical or nearly so.

The spring tongue 36, as shown in FIGS. 19-22, is created by slotting the cartridge loading ramp 32 for a distance from the back toward the front of the loading ramp 32 at the left and right sides of the impedance ridge 38. Various length slits may be used to achieve different spring constants for use with different size and weight cans contained in a cartridge 10. The impedance ridge 38 and spring tongue 36 may also be formed as a separate component and connected to the cartridge loading ramp 32 by an independent spring element, such as piece of spring steel, a sprung hinge, or other similar element that provides the impedance ridge 38 and spring tongue 36 with the desired level of resistance movement of the cans in the lower row 1 of the cartridge 10.

Figure 32:
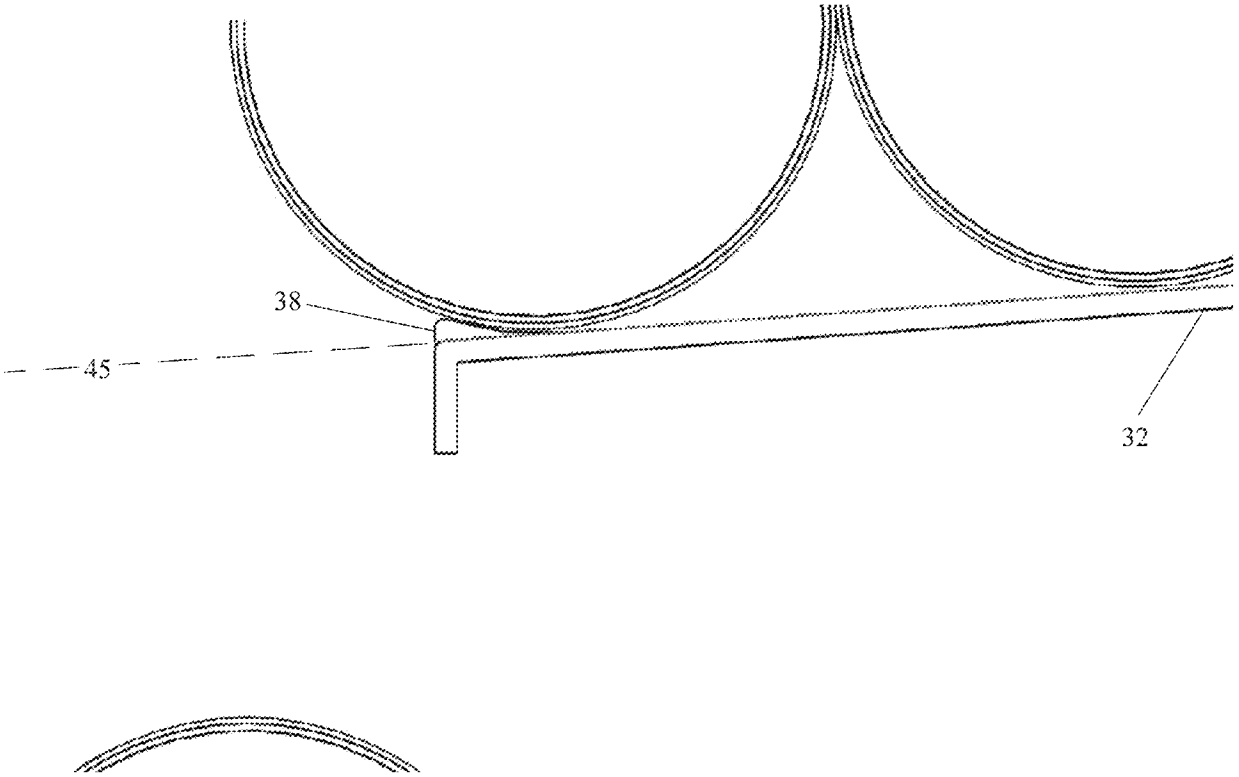
FIG. 32 shows a detail of an impedance ridge interacting with a can in a cartridge.

Referring now to FIGS. 25-31, together with a loading ramp 32 angle (, for example four degrees in FIG. 25), the impedance ridge 38 and spring tongue 36 strength are defined to initially maintain the resting inertia of can 3 and the entire lower row of cans (lower row 1), until cans 1, 2, and 4 exit the cartridge 10. If the impedance ridge 38 is too high or the spring action too strong, one or more cans in the lower row (lower row 1) inside the cartridge 10, may not have sufficient rearward rolling momentum to overrun it, and, as shown in FIG. 32, may stop against the impedance ridge 38 causing a new type of feeding jam. If the impedance ridge 38 is too low or the spring action too weak, can 3 will not be sufficiently impeded to allow the smooth passage of can 4 ahead of it, causing a jam as occurs in prior art FIGS. 16-17 inside the cartridge 10 between cans 4 and 3. Selecting the cartridge loading ramp 32 angle together with the impedance ridge 38 size and shape, and the spring tongue 36 strength, jam free feeding is achieved and, as shown in FIGS. 25-31, cans 1, 2, 3, 4 exit the cartridge in one, two, four, three order. While a cartridge loading ramp 32 angle of four degrees is shown, for example in FIG. 25, this angle may be varied to as much as eight degrees or more, or less than four degrees, depending on the selection of other dispenser parameters and the size and mass of cans in the cartridge 10.

The spring action of the spring tongue 36 may be strengthened or weakened by any normal means known to those skilled in the art, such as, but not limited to, various material selections, varying material thicknesses, or the inclusion of weakening grooves or strengthening ribs.

The spring tongue 36 and impedance ridge 38 are preferably, but not necessarily, used with cartridge 10 designs that eliminate a portion of the cartridge 10 bottom material above the impedance ridge 38. Removing cartridge 10 material in this area places the impedance ridge 38 in direct contact with can 3, rather than pushing a portion of the cartridge 10 upwardly against can 3. Direct contact greatly increases the control and effectiveness of the spring tongue 36 and impedance ridge 38, and delivers consistent performance for a given can 1, 2, 3, 4 size and weight. This feature of the cartridge 10 design also removes the necessity for the cartridge 10 bottom wall to flex up and over the impedance ridge 38, which is less reliable, and instead allows the impedance ridge 38 to directly contact the cans in lower row 1, as shown in FIGS. 26 and 30, thereby providing more predictable motion behaviors and reliable design parameters.

Referring now to FIGS. 33-42, an improved cartridge 90 for use with the spring tongue 36 and impedance ridge 38 also addresses the issue of cans potentially falling out of the cartridge 90 during the loading process. A cartridge 90 construction with specific types of die cut lay-outs, perforations, folds, and assembly methods, as shown in FIGS. 33-42, enables a stocking person to pre-open a priming flap of cartridge 90 and invert it for loading into a dispenser 20, as shown in FIGS. 43-48, without holding a hand over the opening or having any cans unintentionally fall therefrom.

Figure 33:
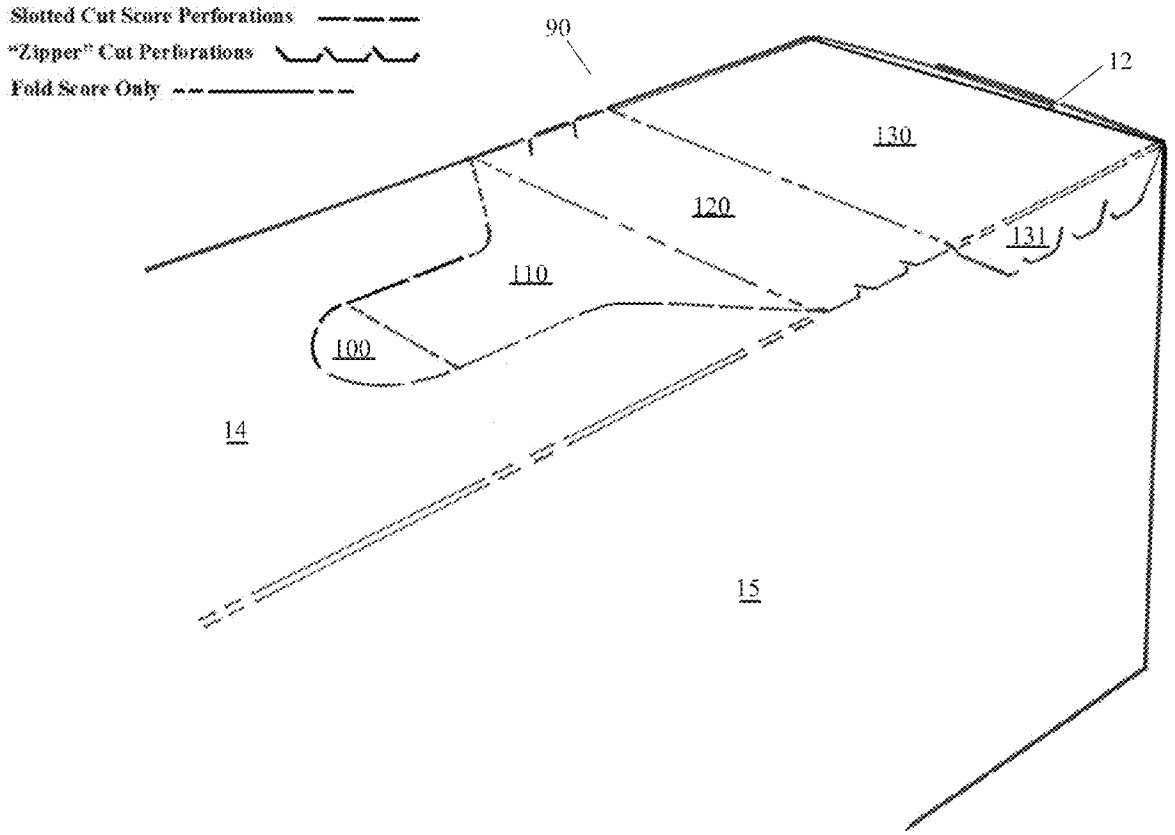
FIG. 33 shows a detail of a cartridge with a priming flap and opening perforations.
Figure 34:
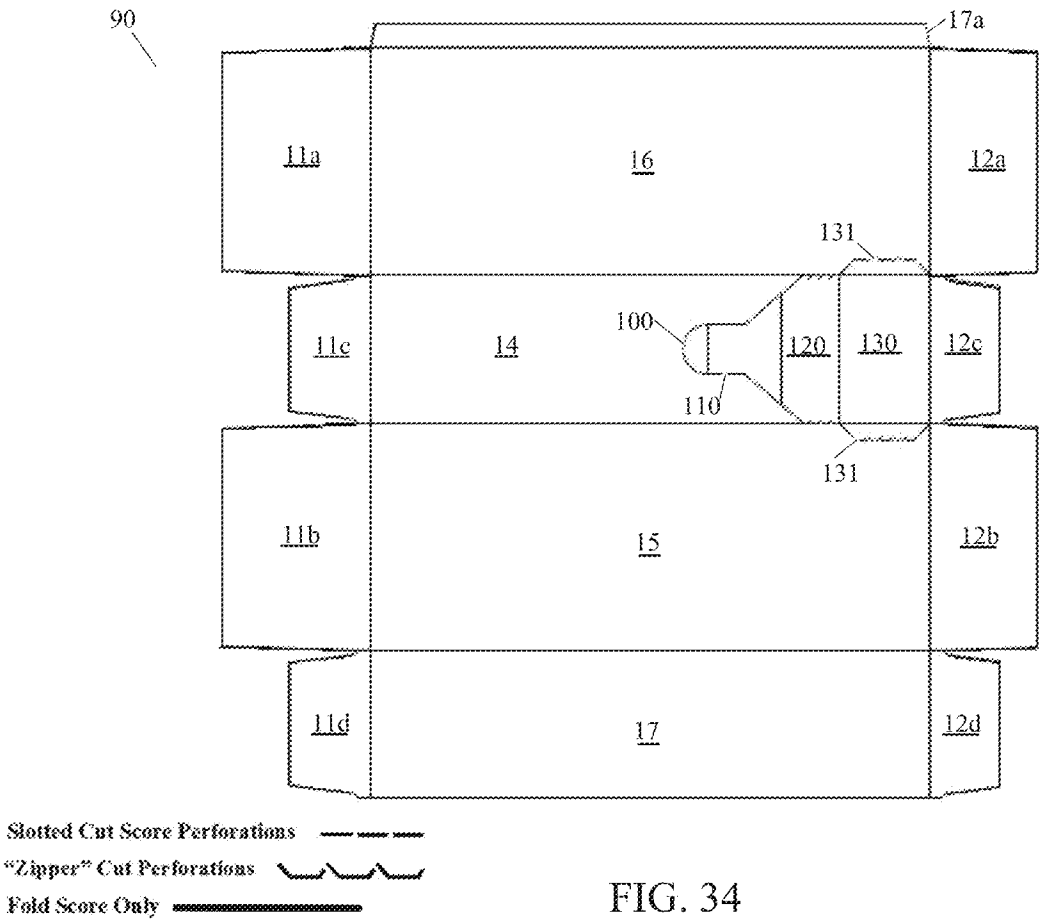
FIG. 34 shows a die lay out blank for a cartridge with a priming flap and opening perforations.
Figure 35:
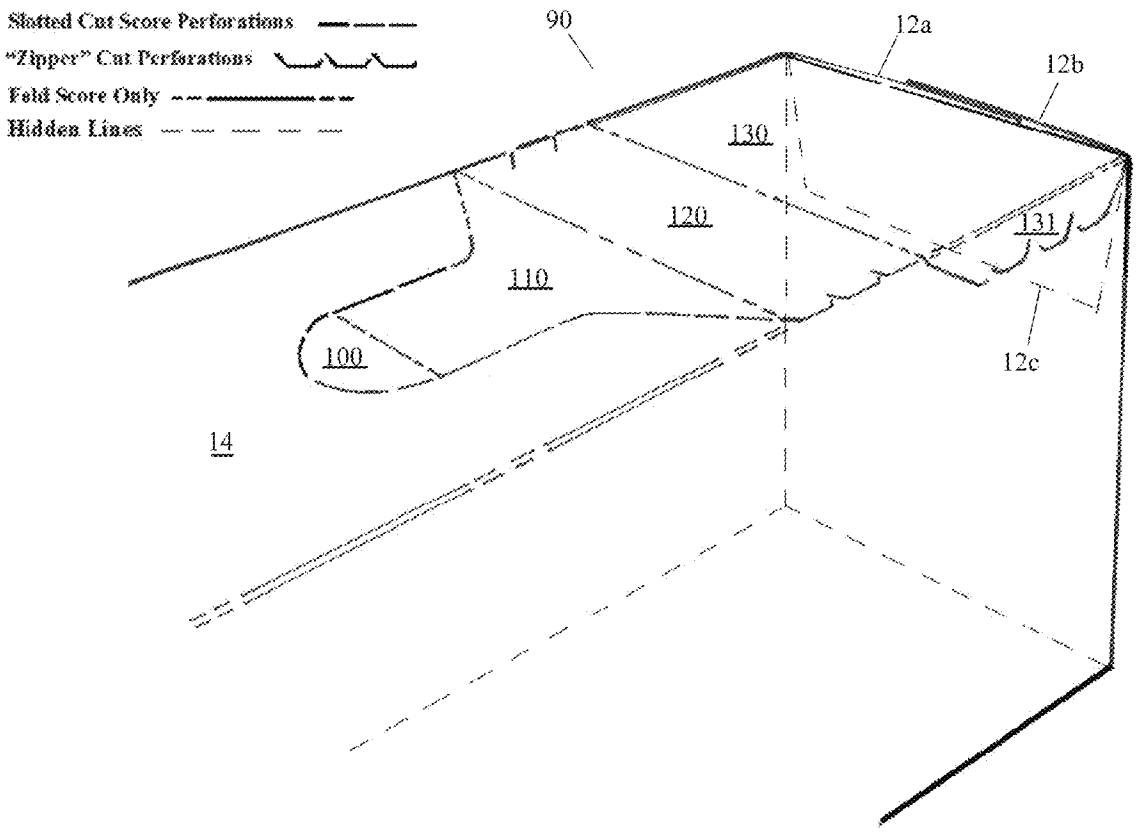
FIG. 35 shows a perspective view with hidden lines of a cartridge with a priming flap and opening perforations.
Figure 36:
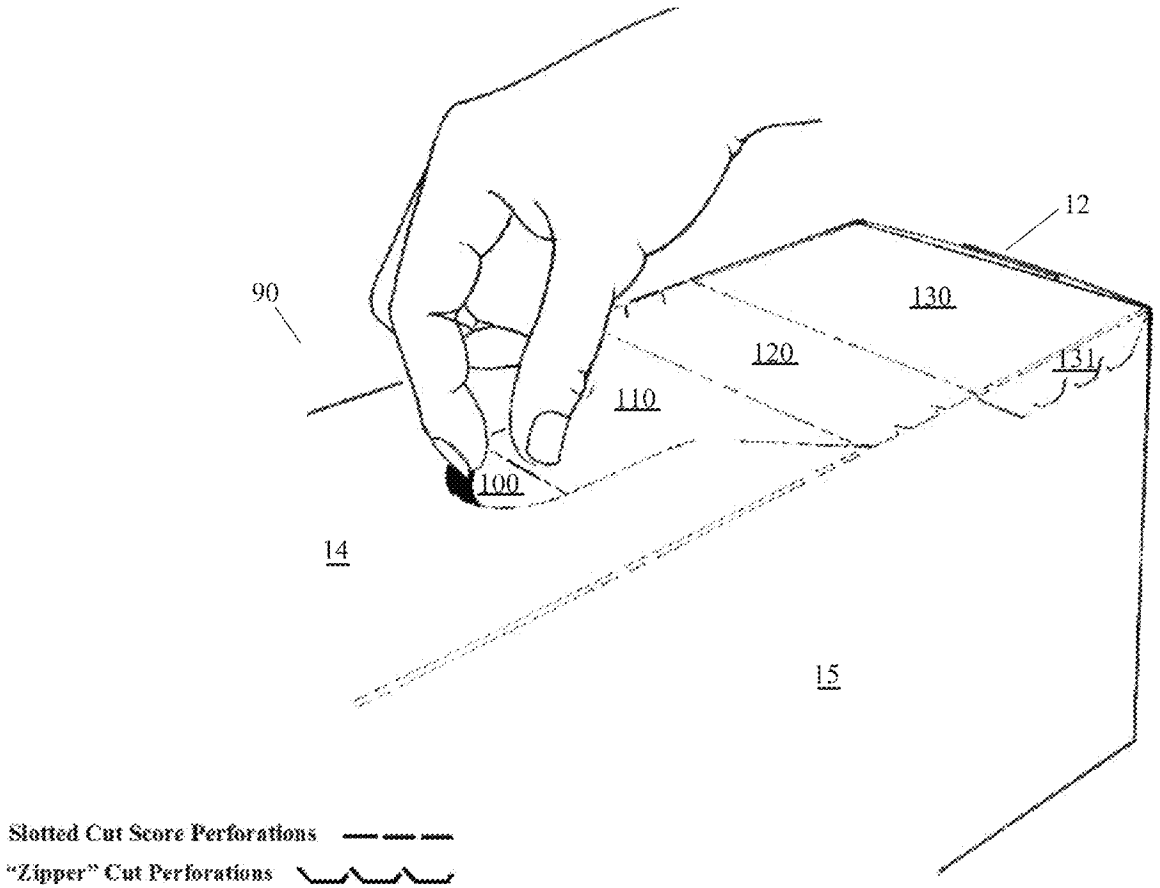
FIG. 36 shows a first step in opening a cartridge with a priming flap.
Figure 37:
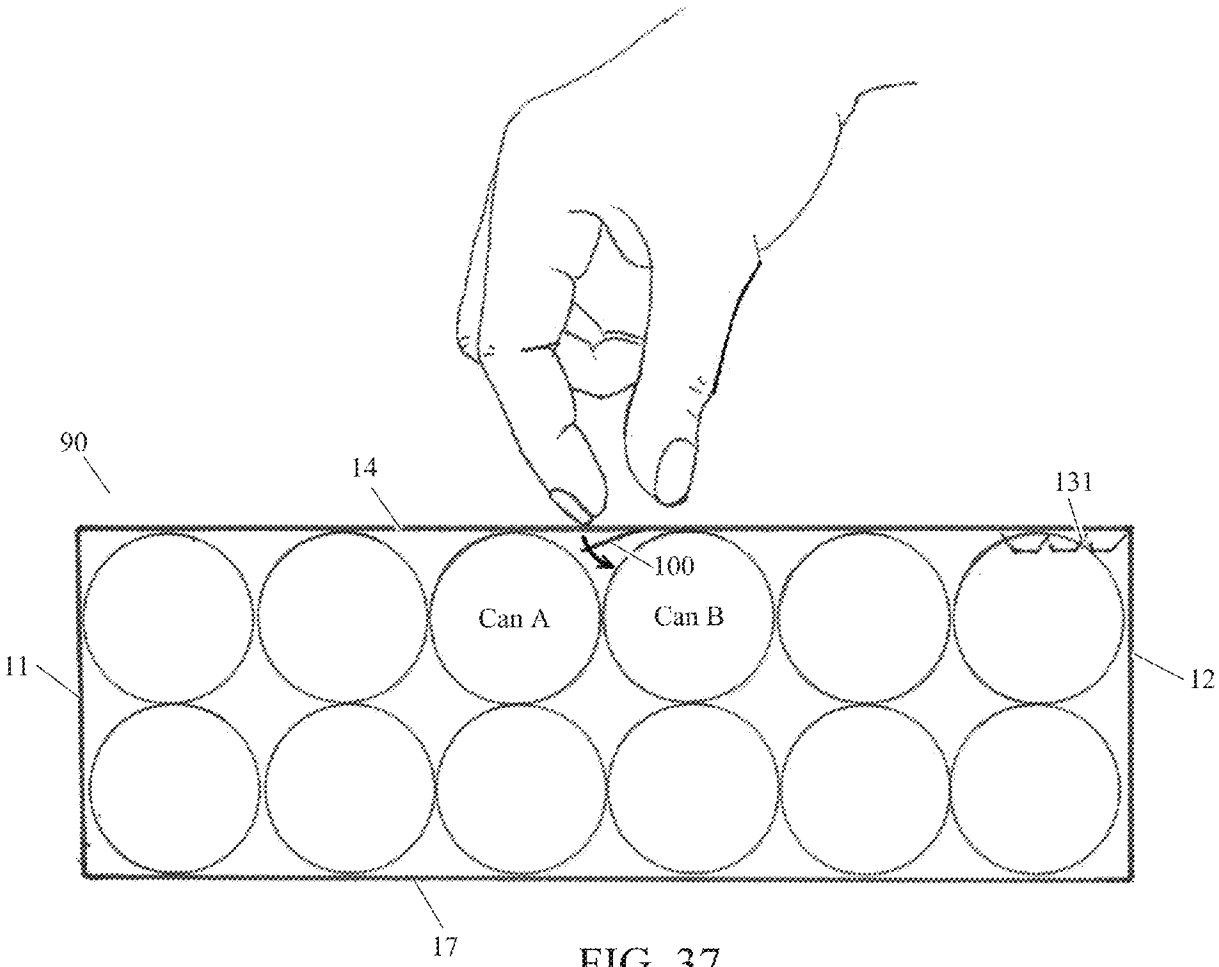
FIG. 37 shows a location of the end of a priming flap relative to cans in the cartridge.
Figure 38:
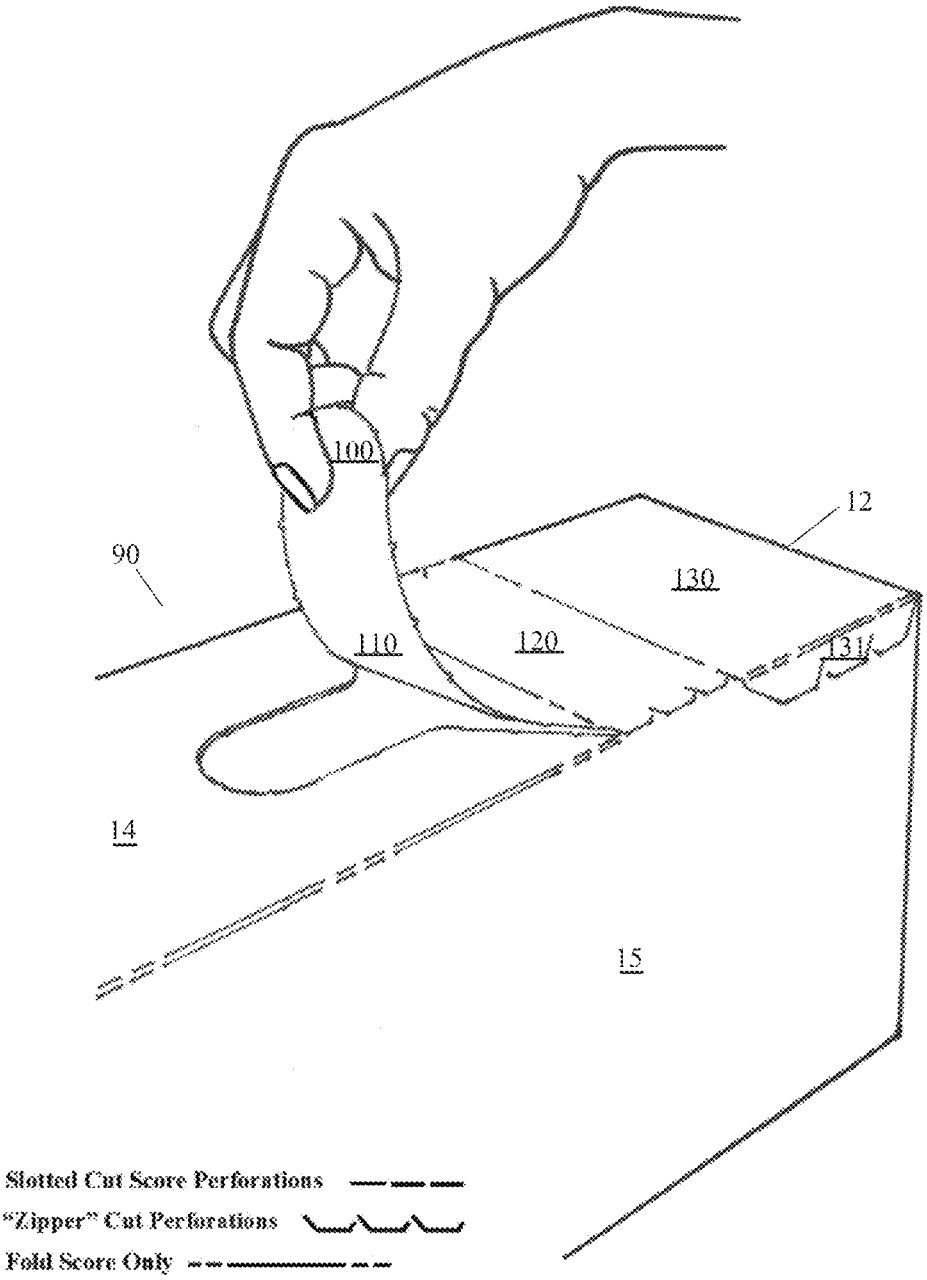
FIG. 38 shows secpmd step of a priming flap strip torn out of a cartridge bottom.
Figure 39:
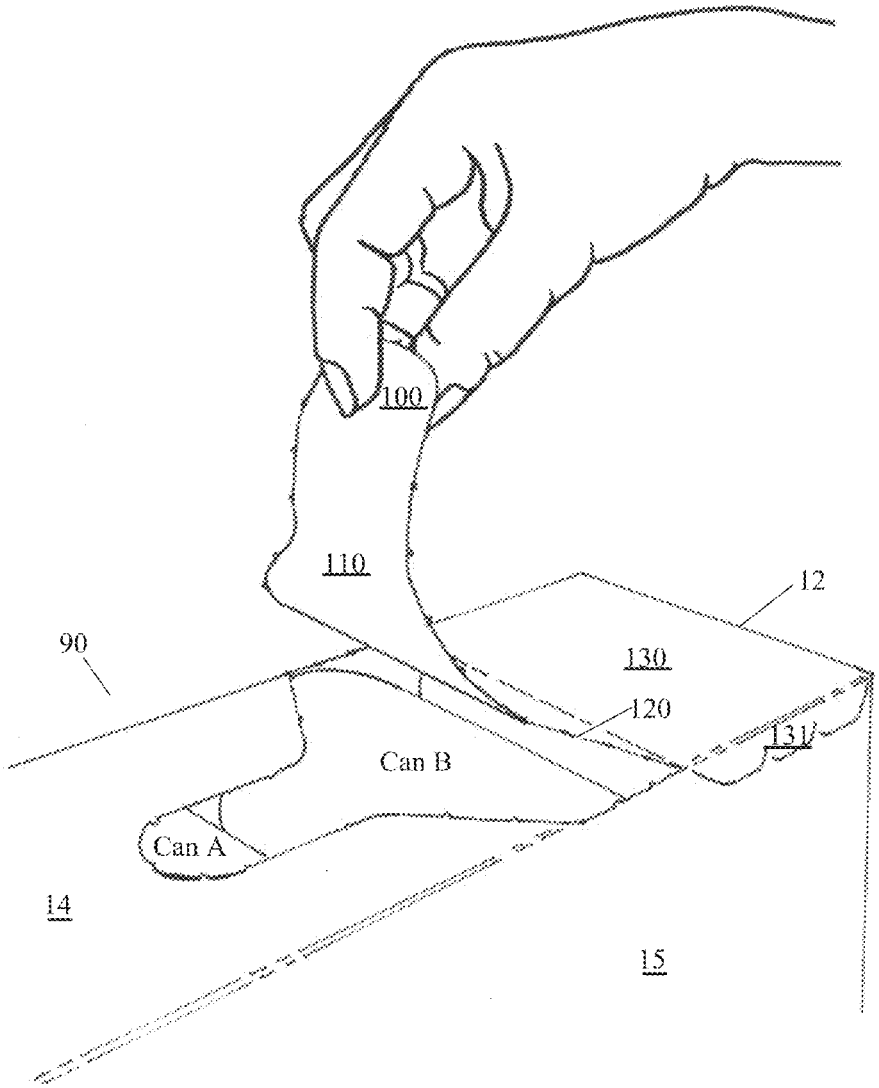
FIG. 39 shows an open side view of a partially opened a priming flap.

One preferred cartridge 90 embodiment, shown in FIGS. 33-42, has a cartridge priming flap 120 that includes a long, longitudinal tear tab 110 forward of the cartridge priming flap 120. The tear tab 110 is also centered about the cartridge 90 longitudinal center line. Referring to FIG. 33, the tear tab 110 may be opened by perforated die-cut lines along its perimeter. At the forward most end of the tear tab 110 is a finger grip perforation 100 of any common design known to the art. This finger grip perforation 100 is preferably located, as shown in FIGS. 36-37, at the space between two cans in the cartridge 90, such that when pushed inwardly, the finger grip perforation 100 has room for relief and may be gripped by a stock person.

Figures 41A, 41B:
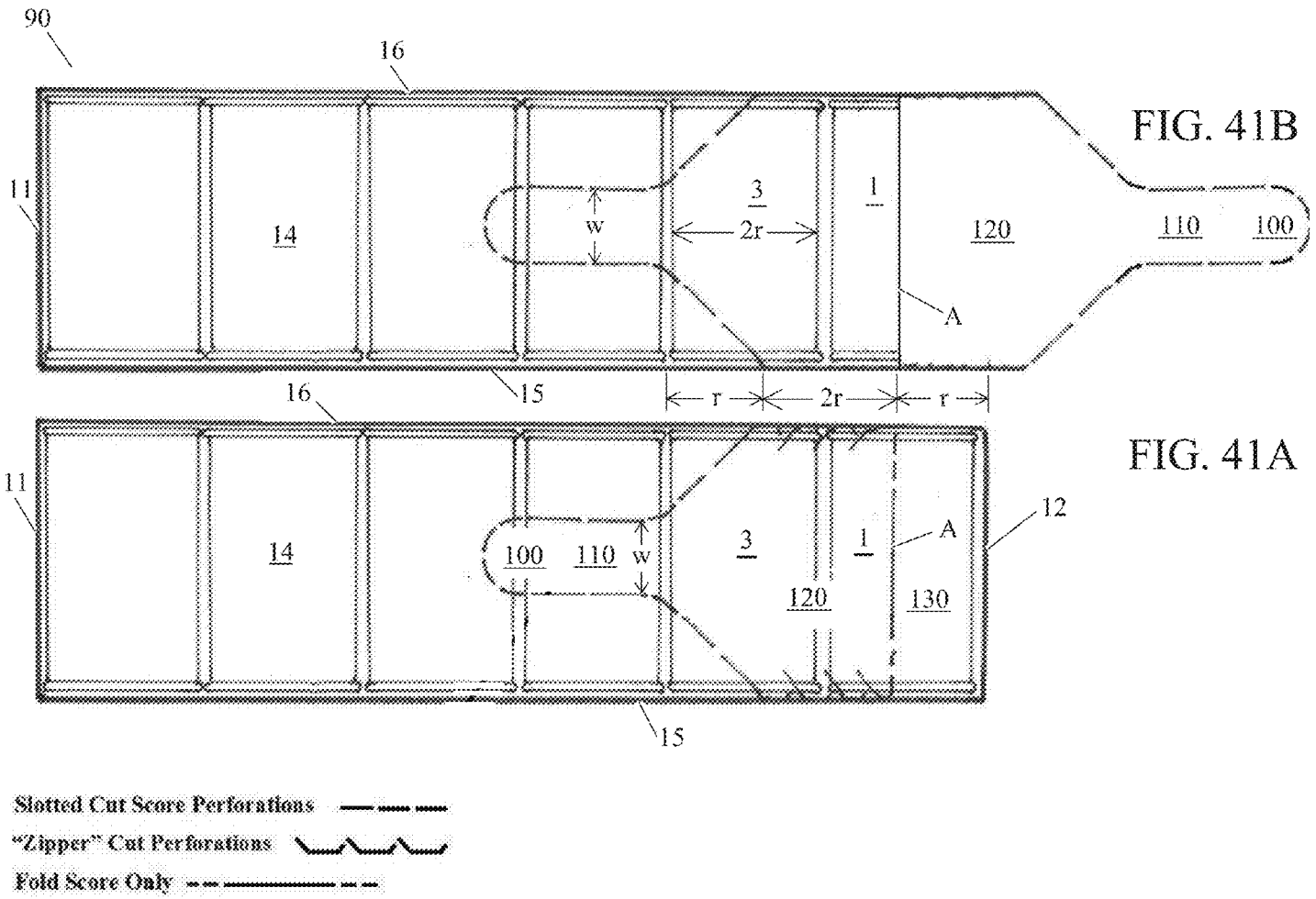
FIG. 41A shows an open side view of a cartridge with a closed priming flap and the relation of the priming flap tear and retaining flap tear and fold lines to can locations in the cartridge.
FIG. 41B shows see-through view not a cartridge with a fully opened and folded back priming flap and the relation of the priming flap and retaining flap tear and fold lines to can locations in the cartridge.

The tear tab 110 transitions, as shown for example in FIGS. 33-36, to the full width of the priming flap 120 by two perforated die-cut lines at generally 45 degrees to the cartridge 90 center line. As shown in FIGS. 41A-41B, these perforations end at the beginning of the priming flap 120 and at the approximate centerline of the can 3 in the cartridge 90. While these transitional die-cut lines are shown at generally 45 degrees to the center line, other geometries are possible and consistent with the current cartridge 90 design, and may be used to provide a smooth tearing transition and ensure that sufficient cartridge 90 material is present after the tear tab 110 and priming flap 120 area has been opened to prevent any cans from exiting the cartridge 90 when inverted.

Figure 40:
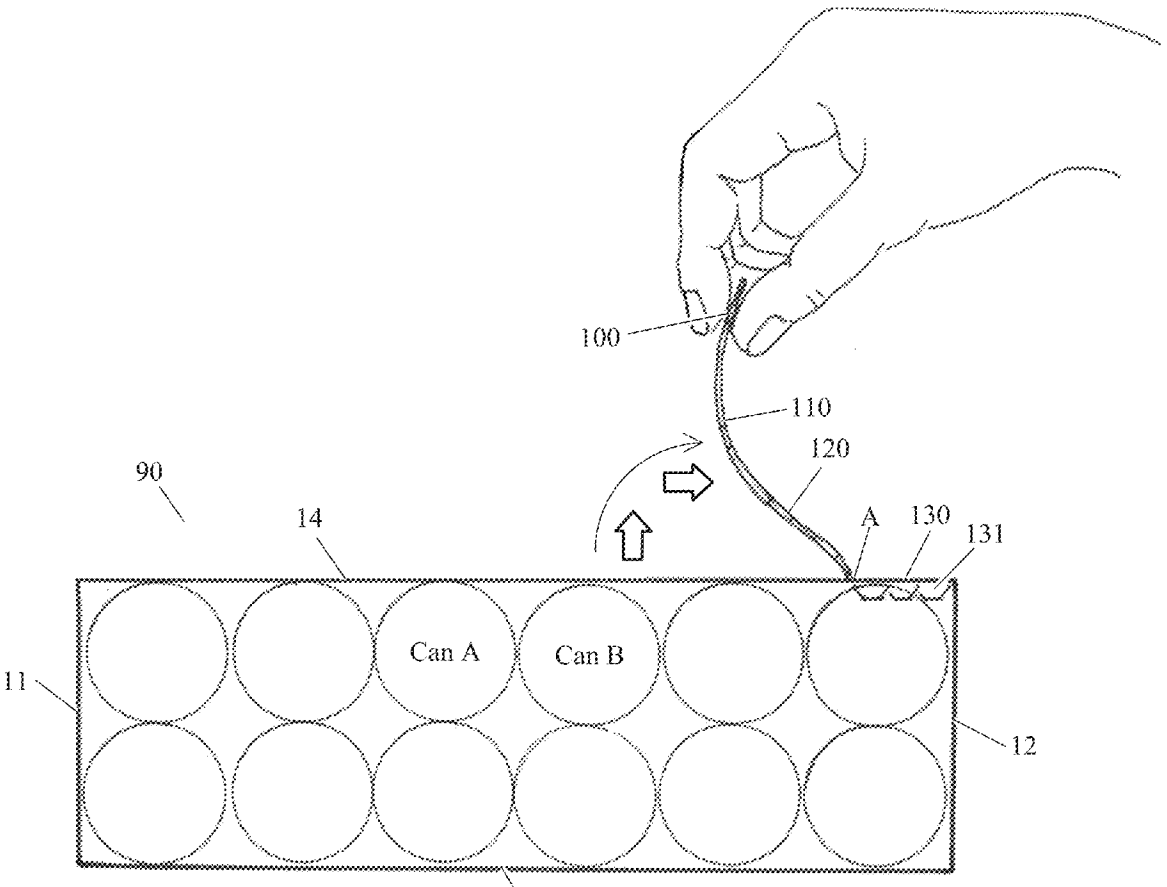
FIG. 40 shows an open side view of a priming flap and the motions involved in opening it.
Figure 42:
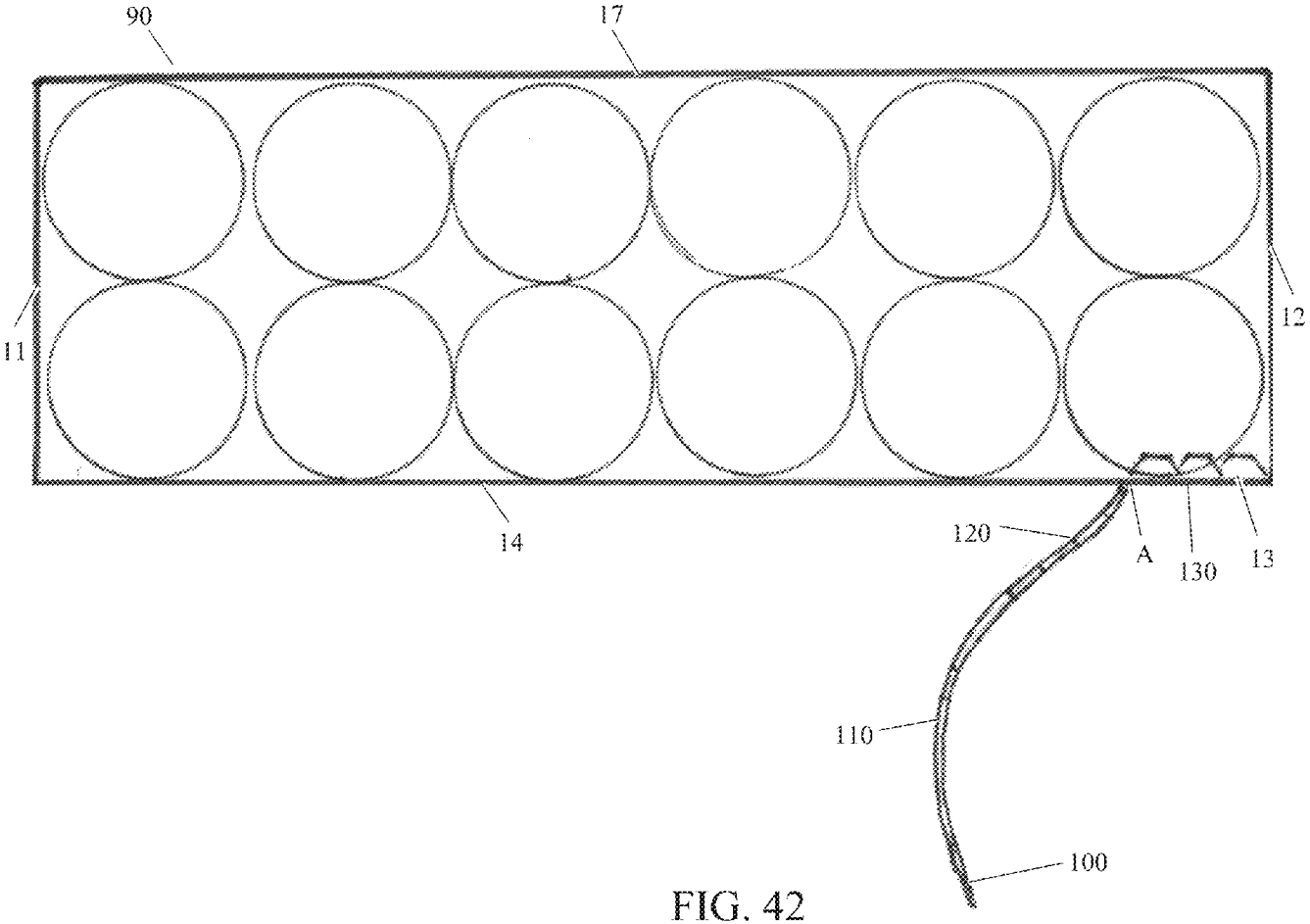
FIG. 42 shows a side view of a complete cartridge with an open a priming flap.

The priming flap 120 and tear tab 110 are torn open, as shown in FIGS. 36-40, by the stocking person during the initial pre-opening process. The priming flap 120 is shown with a die-cut perforation known to the art as a "zipper score". However, other types of perforations may be used provided that they function consistently with the remainder of the opening process. The priming flap 120 opened prior to insertion of the cartridge 90 into the dispenser 20 ends, as shown in FIGS. 40-42, at a fold line, or crease score, "A". Fold line "A" is approximately coincident with the centerline of can 1 in the cartridge 90, as shown in FIGS. 41A and 41B.

While the locations of the priming flap 120 opening and retaining flap 130 shown in FIGS. 41A-41B are the preferred, other configurations are possible, provided the final opening created in the bottom 14 of the cartridge 90 after removal of the priming flap 120 and the retaining flap 130 is large enough to permit a can 1, 2, 3, 4 to freely exit the cartridge 90, and cans 1, 2, 3, 4 are not permitted to exit the cartridge 92, 93, 94, 95 when only the priming flap 120 is separated from the cartridge 90. A general range of retaining flap 130 dimensions include a retaining flap 300 extension from the back 12 of the cartridge 90 forwardly less than twice the radius of a can 1, 2, 3, 4, and one radius of a can 1, 2, 3, 4 or more. A general range of priming flap 120 dimensions include a priming flap 120 extending forwardly of the front edge of the retaining flap 130 a distance twice a can 1, 2, 3, 4 radius or less.

A retaining flap 130, rearward of fold line "A", preferably carries indicia that communicate "DO NOT TEAR", or similar cautions, instructing the stocking person not to remove the retaining flap 130 prior to inserting the cartridge 90 into the dispenser 20. The retaining flap 130 ends in a cartridge assembly flap 12*c*, shown in FIGS. 34-35, inside the assembled cartridge 90. In some embodiments, where the priming and retaining flaps are both completely removed during cartridge insertion, FIG. 48 for example, cartridge assembly flap 12*c* is either simply tucked into the assembled and packed cartridge 90 without the aid of adhesives, or is only lightly adhered, as is commonly known in the art as being spot or tack glued, to facilitate removal with a minimal amount of applied force. The other cartridge 90 assembly flaps 11*a*-11*d*, and 12*a*, 12*b*, and 12*d* are adhered in the normal manner when the cartridge 90 is assembled and filled during production.

The length of cartridge assembly flap 12*c* is preferably less than the radius, "r", of can 1 in the cartridge 90 to prevent it from being pinched between can 1 and the cartridge rear wall 12, as this would hinder removal of the cartridge assembly flap 12*c* after insertion into the dispenser 20.

The cartridge 90 shown in FIGS. 33-43 is not limited to use with a dispenser 20 having a sprung impedance ridge 38. As shown in FIGS. 43-48, the cartridge 90 may also be used with a dispenser 20 that includes a substantially S-shaped down chute 50. The S-shaped down chute 50 is constructed of three arcuate sections 50*a*, 50*b*, and 50*c*. An upper arcuate section 50*a* holds a can moving through the exit port 45 in rolling contact with can 3 in the cartridge 90 and inhibits movement of can 3 toward the exit port 45. A central arcuate section 50*b* continues to hold the can in rolling contact with can 3 as it moves through the exit port 45. And a lower arcuate section 50*c* directs the can to the lower feed ramp 40 and product selection area 25.

Figure 47:
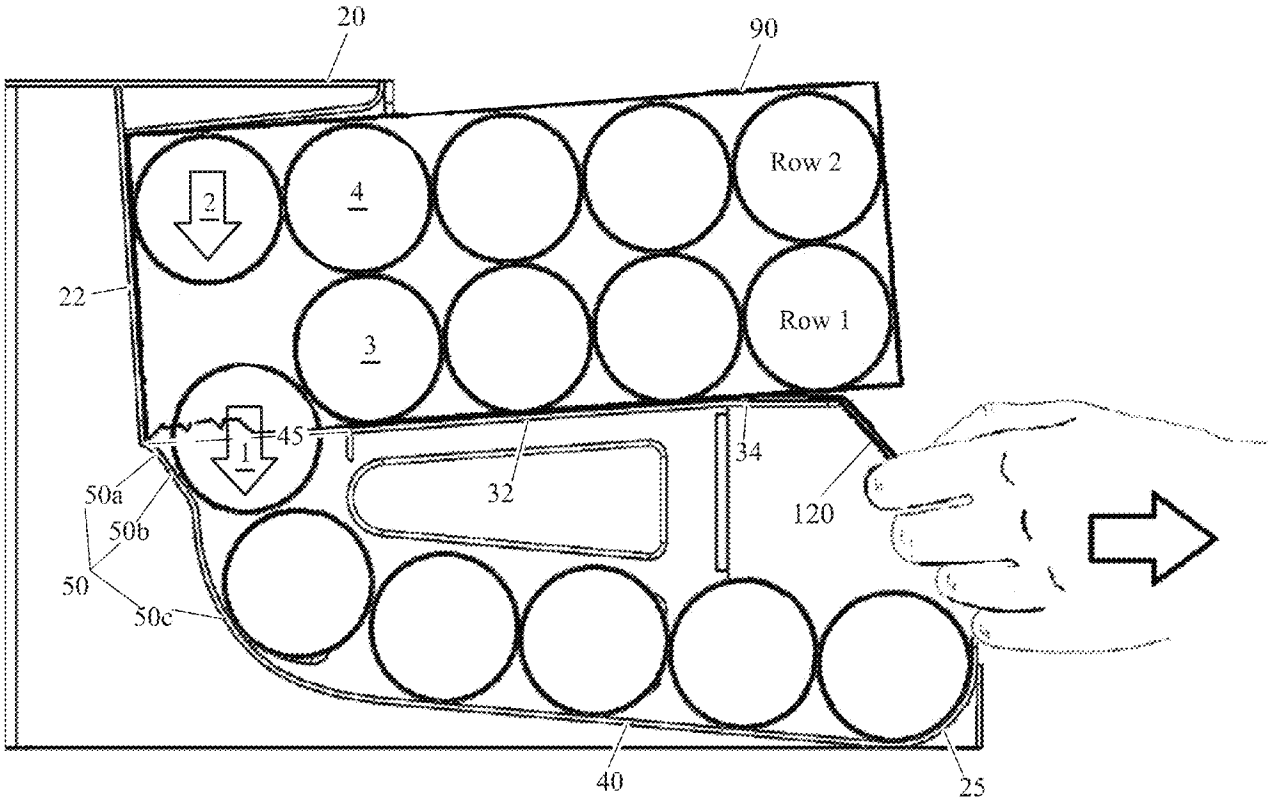
FIG. 47 shows an open side view of a dispenser after a cartridge has been inserted into the dispenser and a priming flap and retaining flap are torn free.
Figure 48:
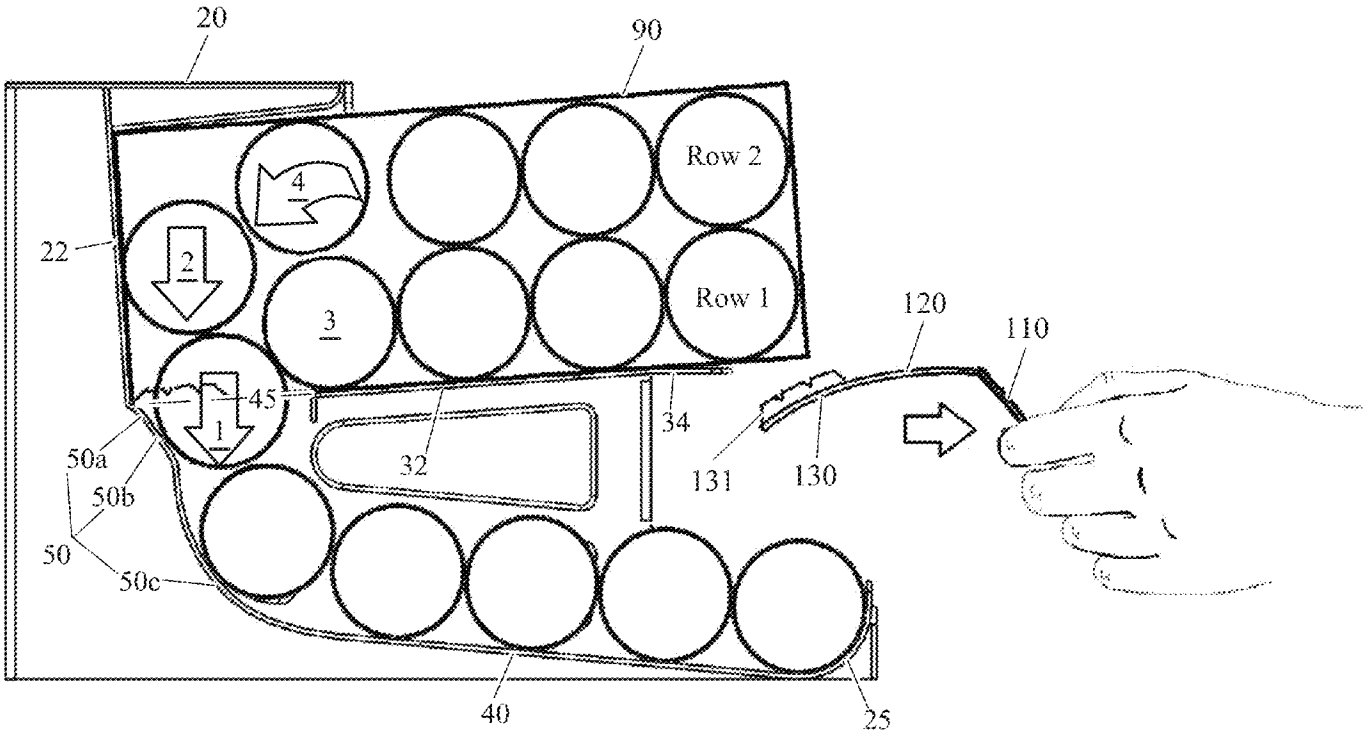
FIG. 48 shows an open side view of a dispenser after a cartridge has been inserted into the dispenser and the priming flap and retaining flap are fully removed.

For example, as shown in FIG. 47, as can 1 moves down into the exit port 45, the upper arcuate section 50*a* holds can 1 in rolling contact with can 3, and movement of can 3 is inhibited so that can 2 may move downward into the space previously occupied by can 1. As can 1 continues to move through the exit port 45, the central arcuate section 50*b* continues to hold can 1 in rolling contact with can 3, and can 2 may move downward as can 1 did previously, with the upper arcuate section 50*a* and central arcuate section 50*b* also holding it in rolling contact with can 3, so that movement of can 3 toward the exit port 45 continues to be inhibited. As shown in FIG. 48, can 4 may then move behind can 2, just as can 2 moved behind can 1. Can 3, and the cans behind it, are then free to move toward the exit port 45 once can 4 has moved to the lower arcuate section 50*c*. In this manner, cans 1, 2, 3, 4 are biased to exit the cartridge 90 in the one, two, four, three order that prevents jamming.

Figure 43:
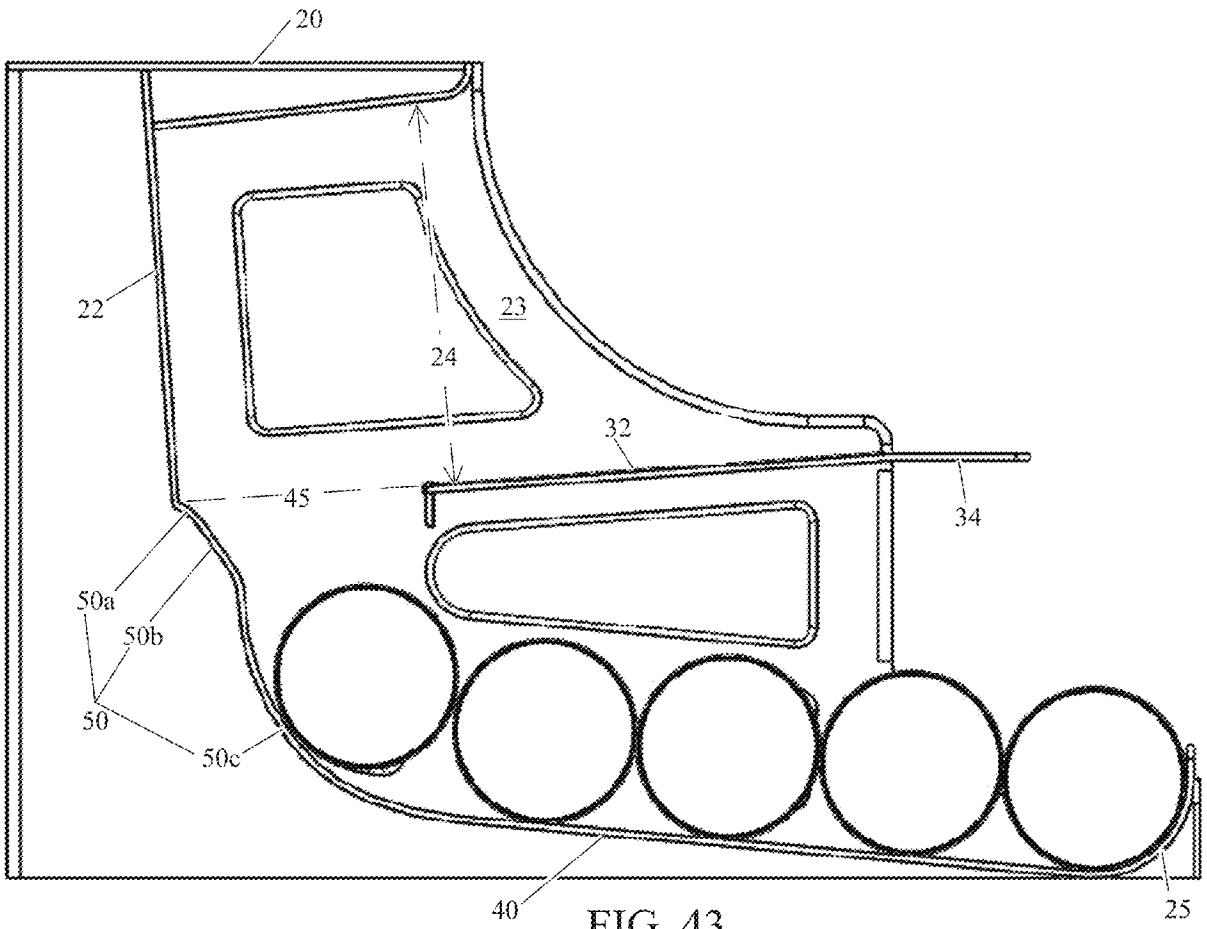
FIG. 43 shows an open side view of a dispenser with cartridge loading ramp and a resting surface.
Figure 44:
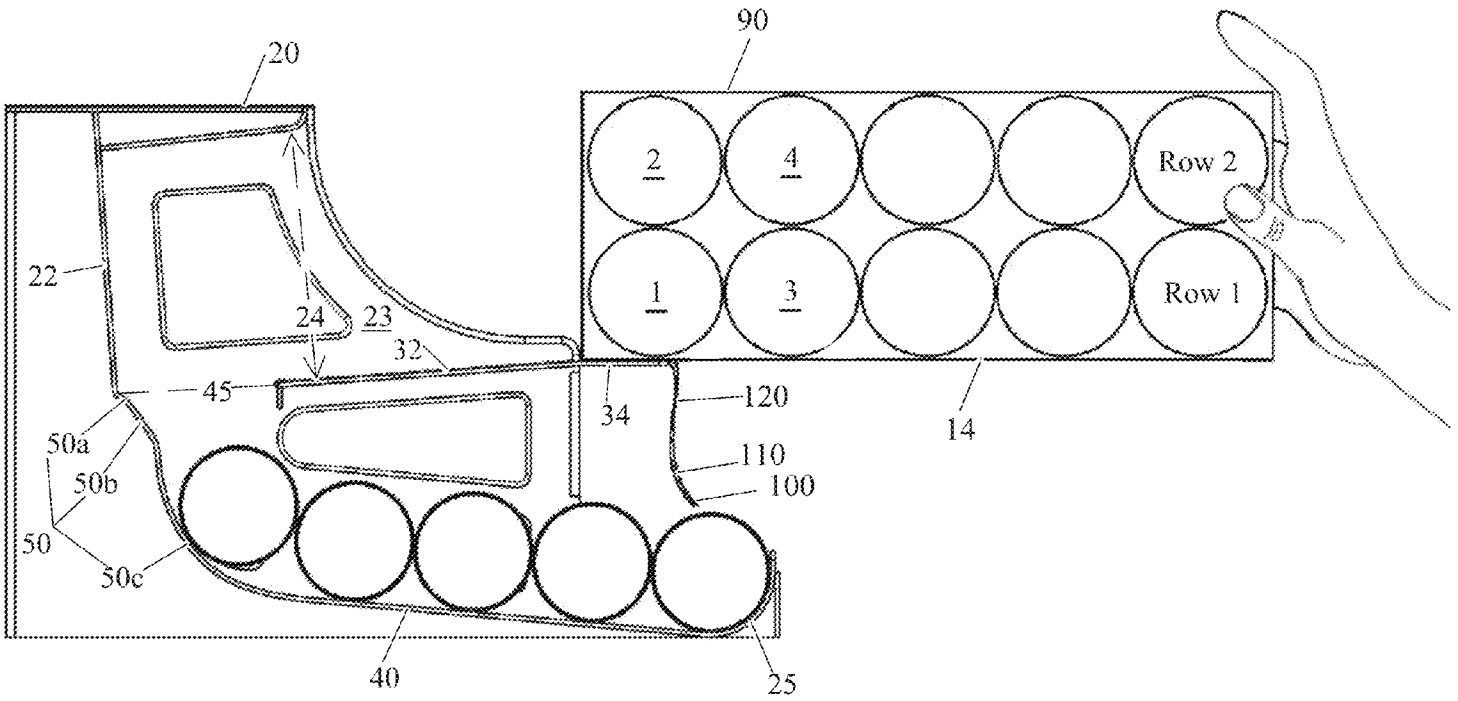
FIG. 44 shows an open side view of a dispenser with cartridge with an open priming flap on a resting surface.
Figure 45:
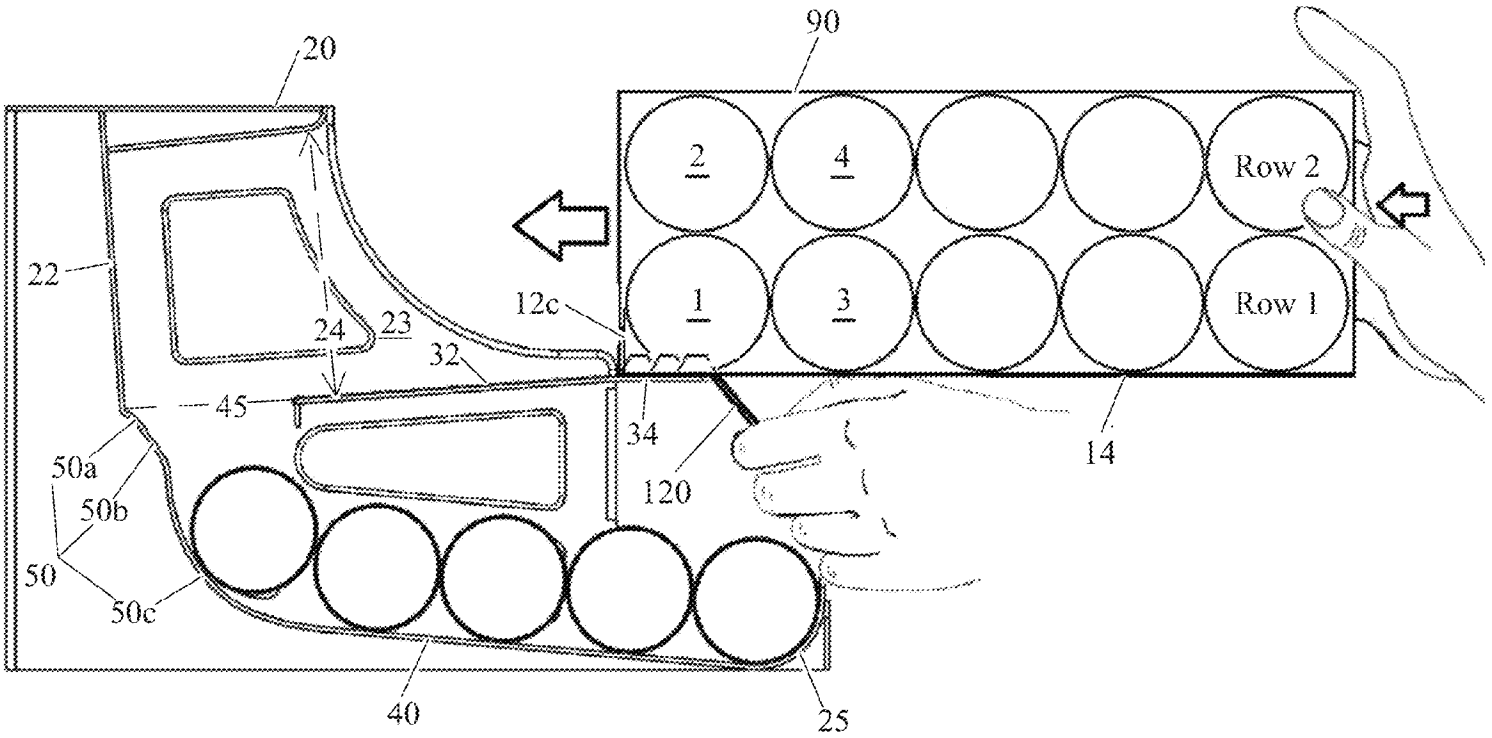
FIG. 45 shows an open side view of a dispenser with cartridge on a resting surface and a stock person holding a pull strip on a priming flap.
Figure 46:
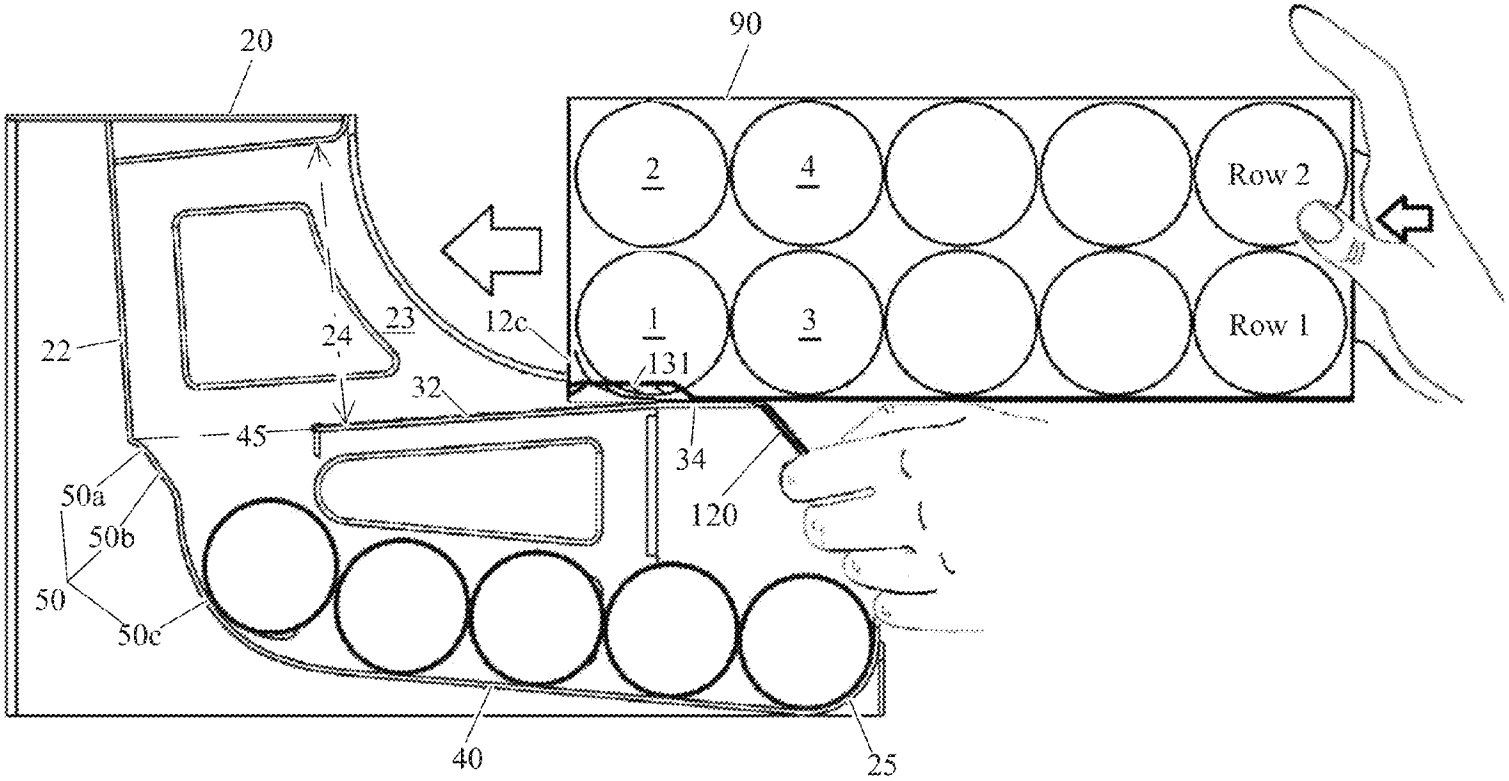
FIG. 46 shows an open side view of a dispenser with a cartridge being inserted into the dispenser.

The method of using this cartridge 90 design with a dispenser 20, illustrated in FIGS. 36-48, includes the steps of:

Step One: punching open the finger grip 100 and grasping the tear tab 110 (see FIGS. 36-37), tearing the tear tab 110 and the priming flap 120 rearward along its perforations and out of the cartridge 90 (see FIG. 38), and stopping the tear at fold line "A" (see FIGS. 39-41B);

Step Two: inverting the cartridge 90 and placing its partially unopened end on the dispenser 20 resting surface 34 (see FIGS. 42-44);

Step Three: gripping the tear tab 110 portion of the priming flap 120 firmly with one hand and holding it against the front edge of the dispenser 20 resting surface 35 (see FIGS. 45-46);

Step Four: pushing the cartridge 90 into the cartridge holding area 24 with the other hand until the cartridge is firmly against the dispenser rear wall 22 (see FIGS. 46-47), thereby shearing the retaining flap 130 zipper cut perforations located on the two retaining flap 130 sidewalls 131 (see FIGS. 34, 35 and 46 for example); and Step Five: disposing of (removing and recycling or discarding) the tear tab 110, priming flap 120, and retaining flap 130 (see FIGS. 47-48).

Figure 49:
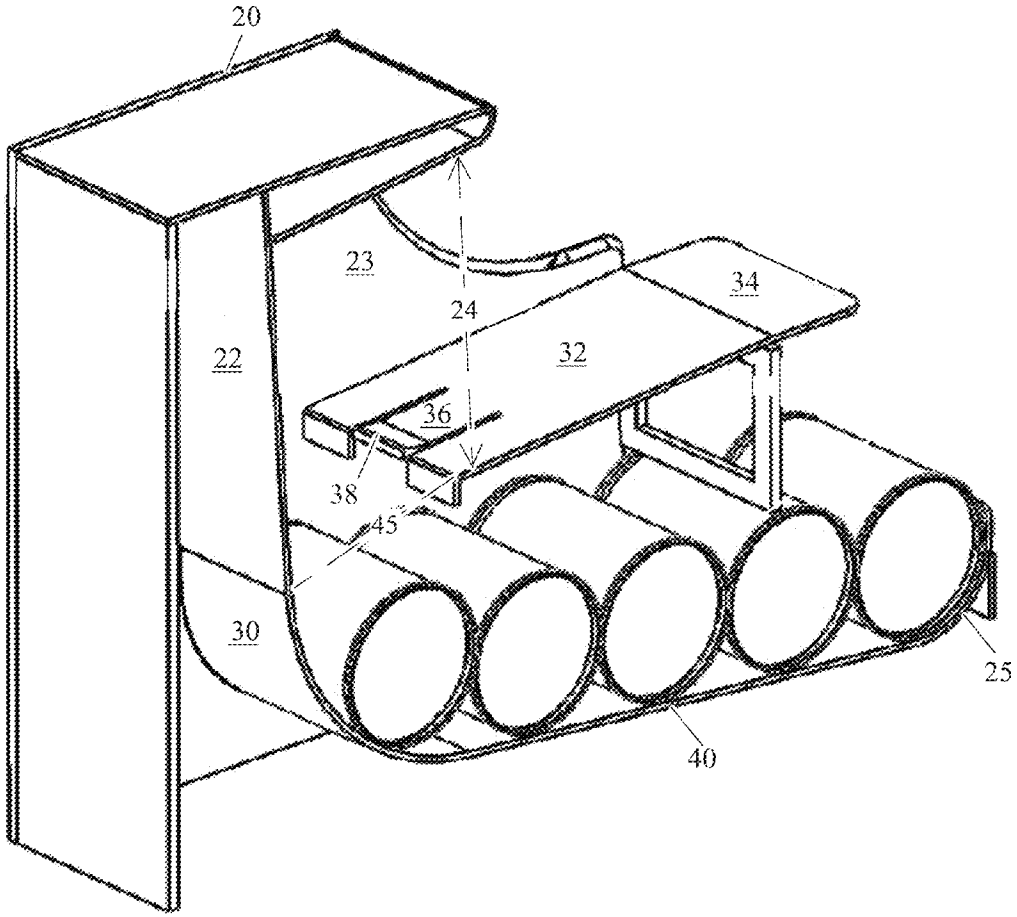
FIG. 49 shows an open sided perspective view of a dispenser with a cartridge loading ramp, an impedance ridge, a spring tongue, and a resting surface.
Figure 50:
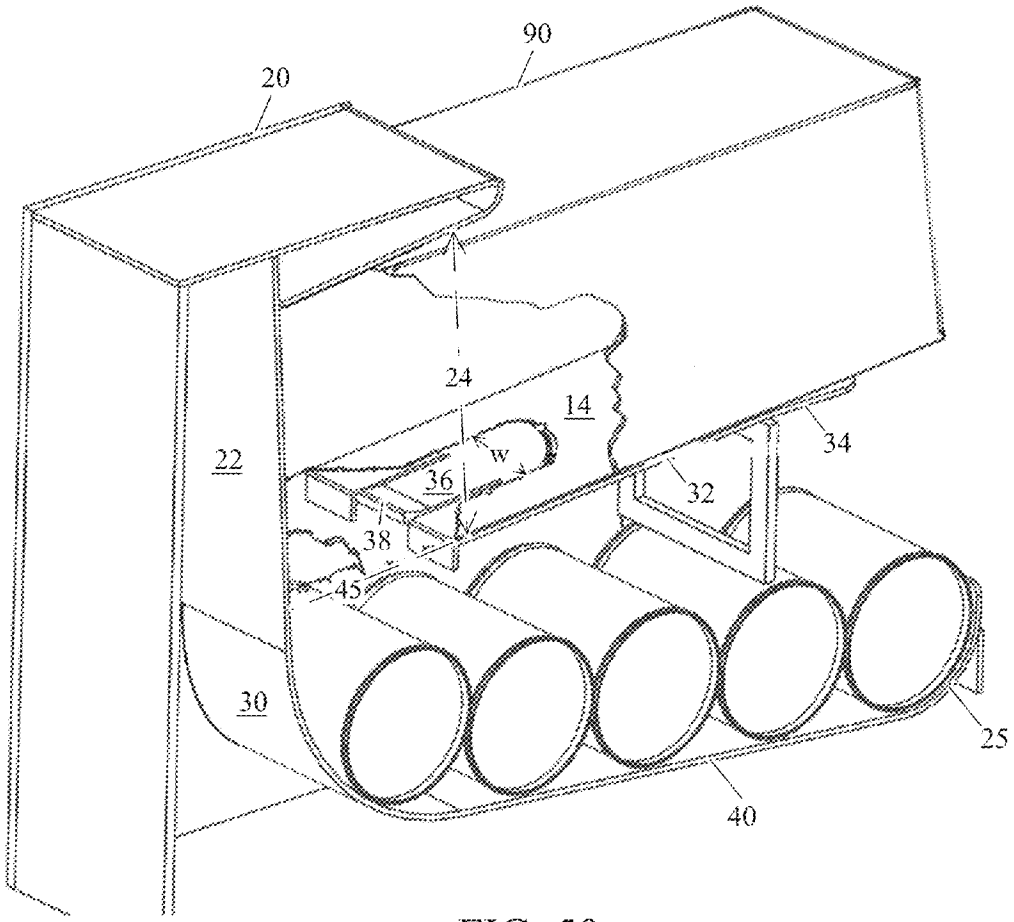
FIG. 50 shows a partial cut away of a dispenser and installed cartridge with a priming flap.

In the event this cartridge 90 is used in conjunction with the dispenser 20 having the impedance ridge 38 (shown in FIG. 49), the tear tab 110 is so laid out, as shown for example in FIG. 50, having a width, "w", to provide clearance for the spring tongue 36 and impedance ridge 38 along the length of the tear tab 110.

Figure 51:
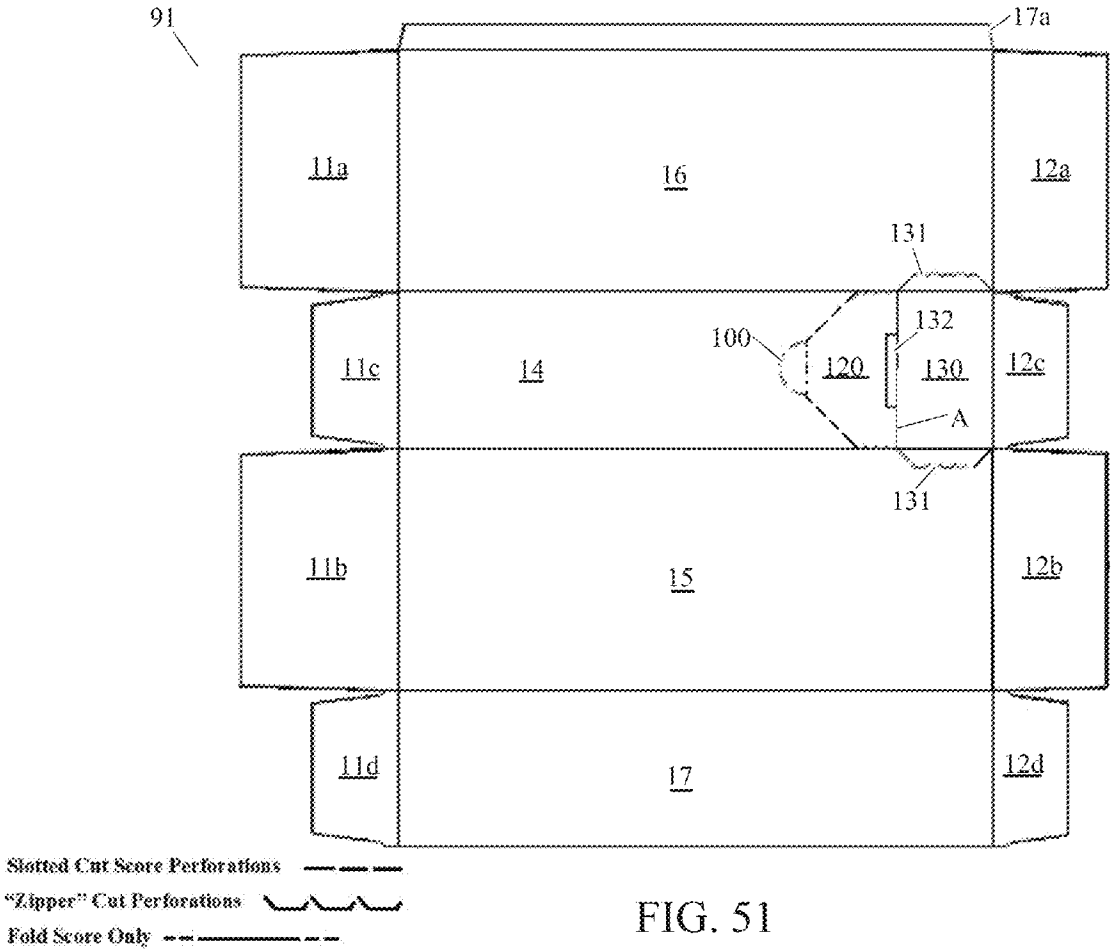
FIG. 51 shows a die cut blank for a cartridge with a priming flap slot an retaining flap.
Figure 52:
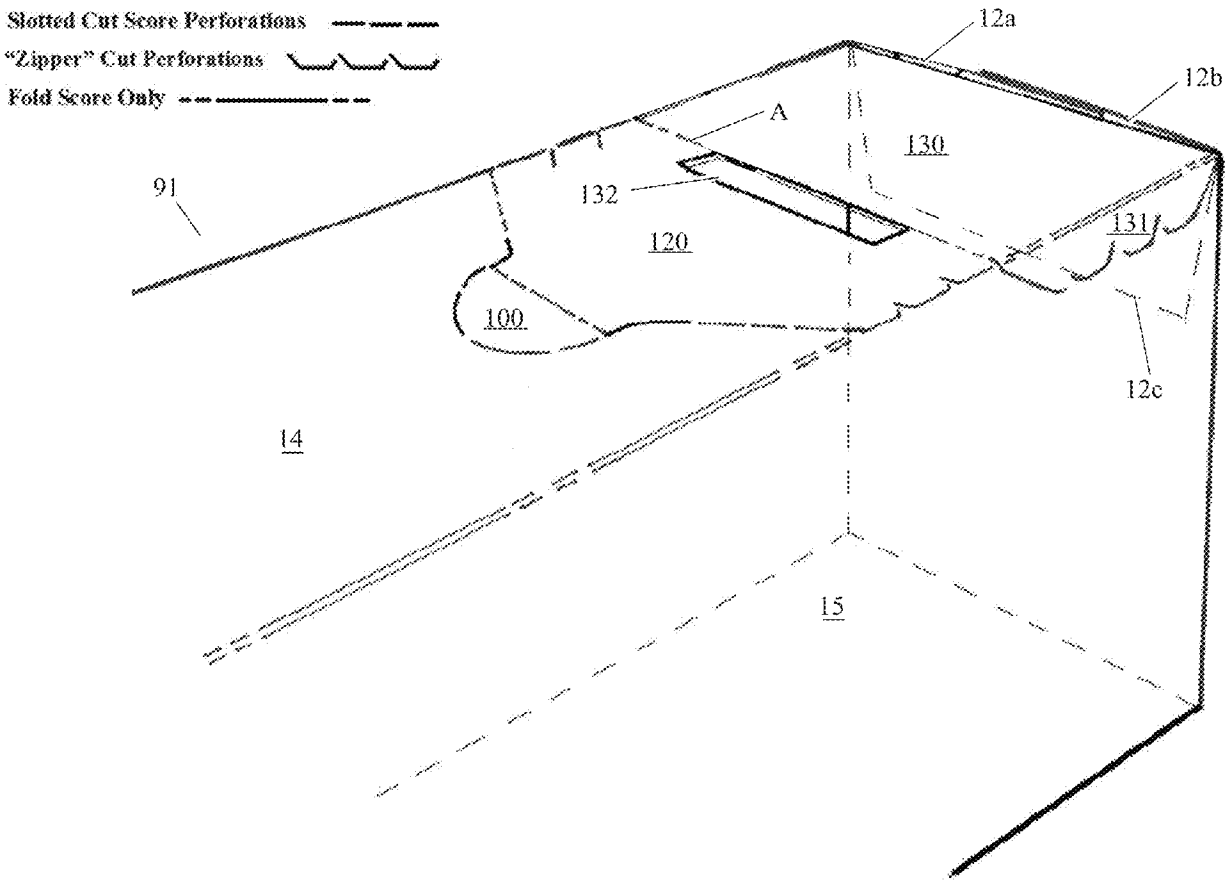
FIG. 52 shows a perspective view of a cartridge with a priming flap and slot.

Referring now to FIGS. 51-52, an alternative cartridge 91 embodiment eliminates the elongated tear tab 110 portion of the priming flap 120, using only a grip perforation 100, priming flap 120, and retaining flap 130, and enables one-handed cartridge 91 insertion into the dispenser 20. The long tear tab 110 of the previous cartridge 90 embodiment acts as a handle and provides sufficient material for one hand to firmly grip the priming flap 120 while inserting the cartridge 90 into the dispenser 20. However, by adding a slot 132 in the priming flap 130 parallel to and coincident with fold line "A", it is possible to eliminate the elongated tear tab 110. In one preferred embodiment, the priming flap slot 132 is approximately one-third the width of the cartridge 91 in length. However, other priming flap slot 132 dimensions are possible provided they are consistent with the opening methodology described herein.

Figure 53:
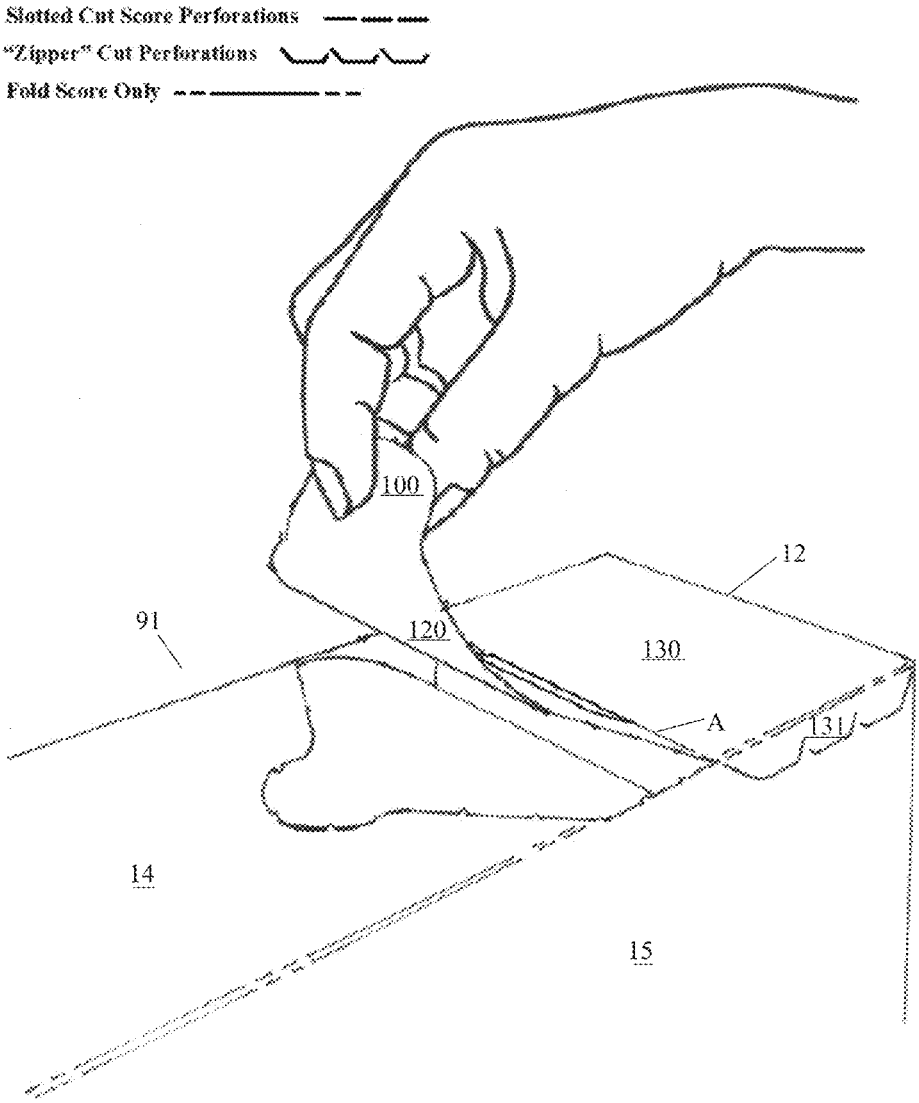
FIG. 53 shows a perspective view of an opening step for cartridge with a priming flap and slot.
Figure 54:
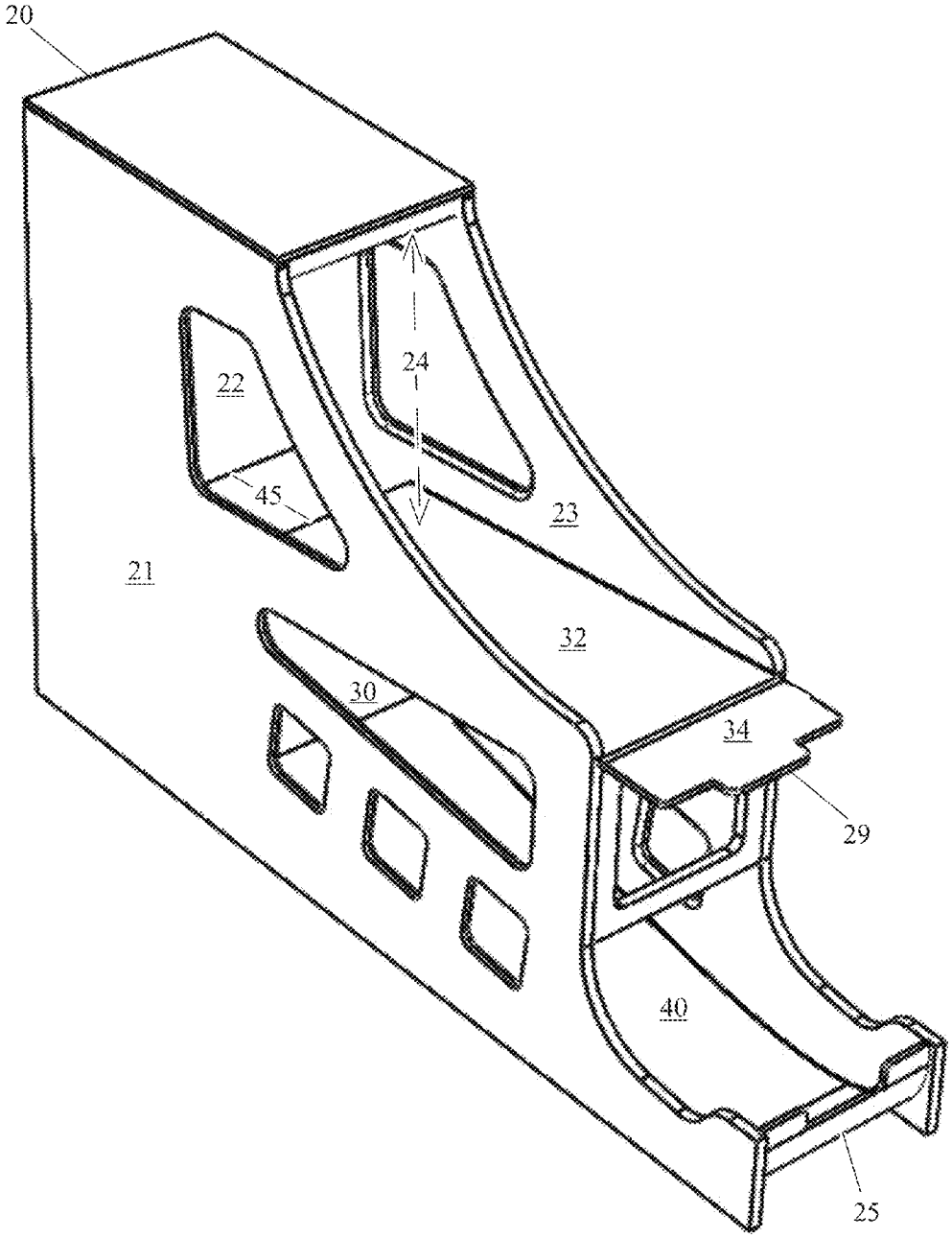
FIG. 54 shows a perspective view of a dispenser with a tab used with a cartridge having a priming flap slot.
Figure 55:
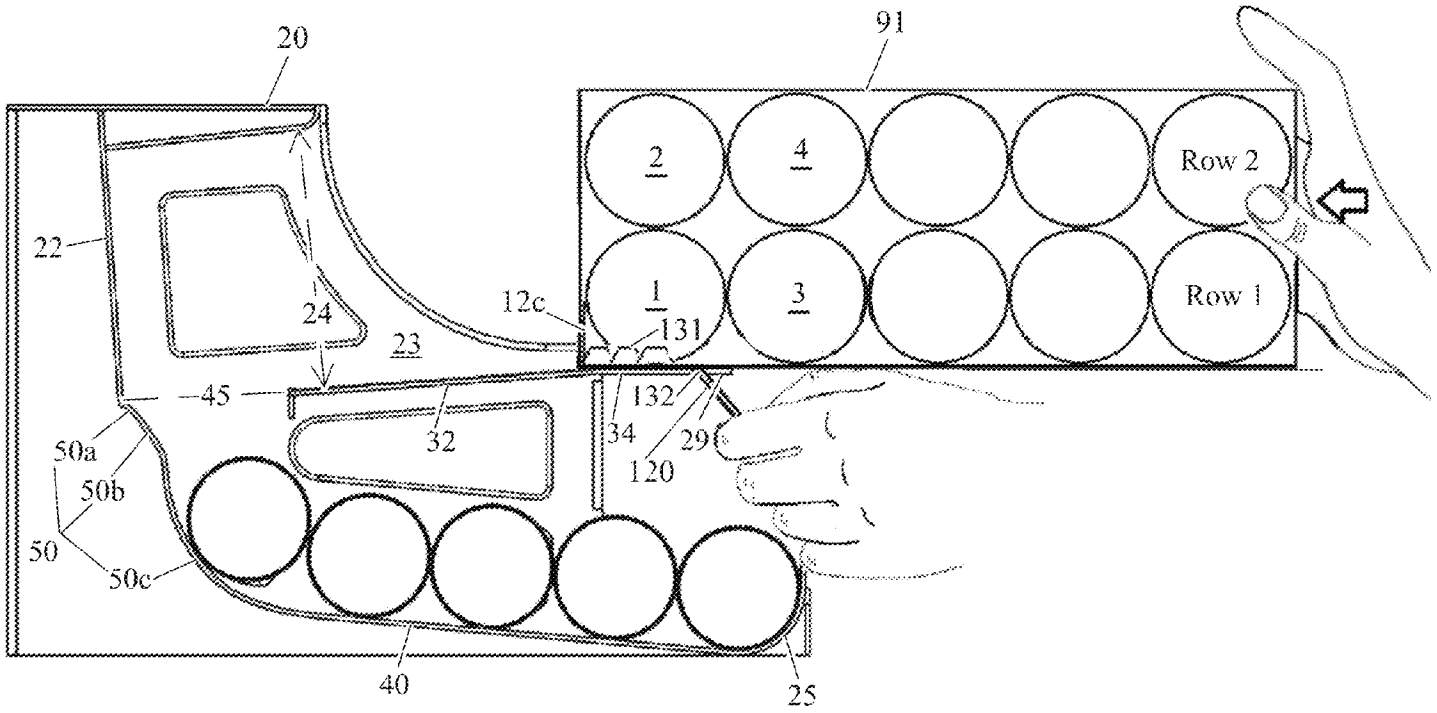
FIG. 55 shows a priming flap slot being engaged into a dispenser tab when inserting a cartridge in a dispenser.
Figure 56:
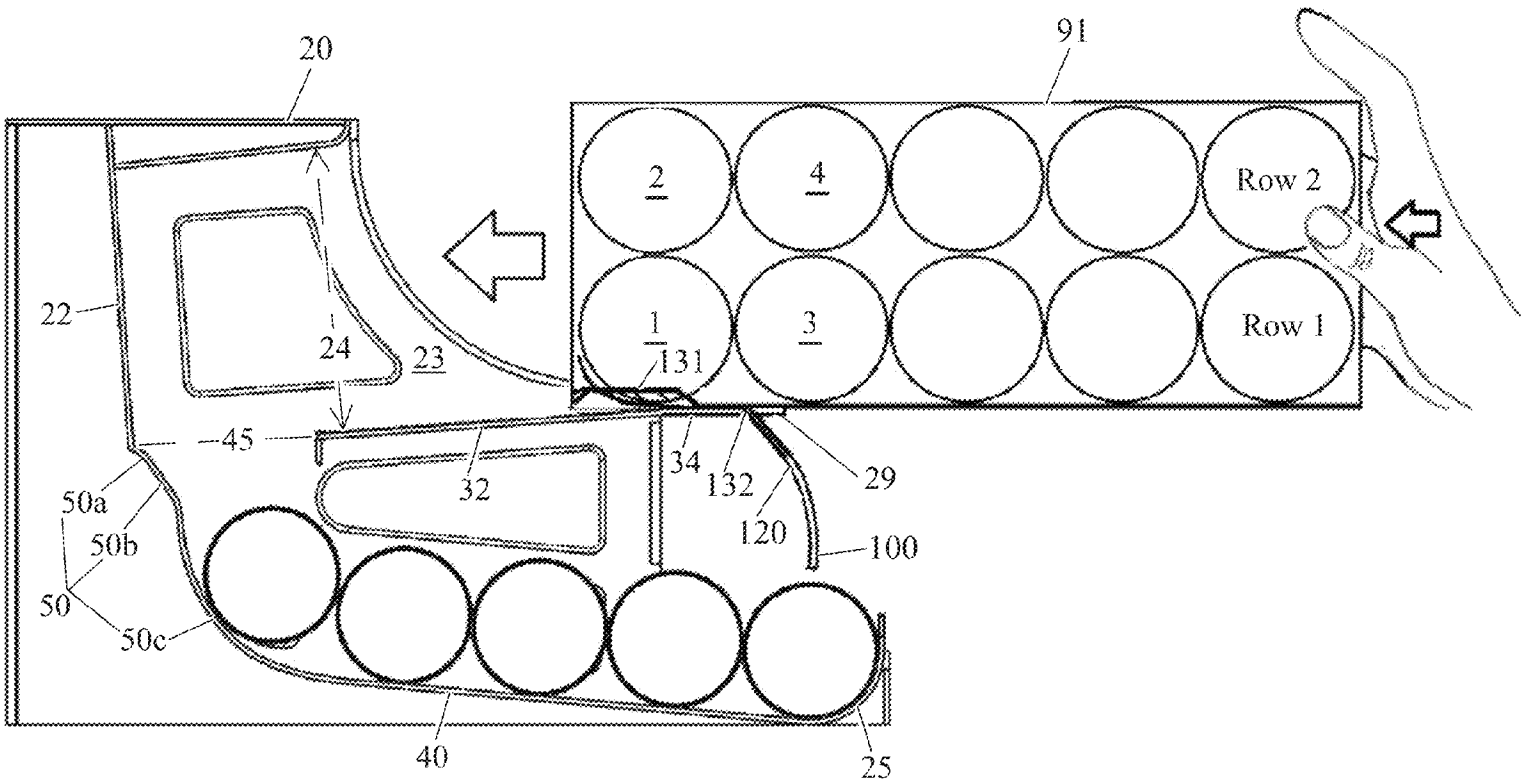
FIG. 56 shows a cartridge being pushed into a dispenser after a priming flap slot has been engaged in the dispenser tab.
Figure 57:
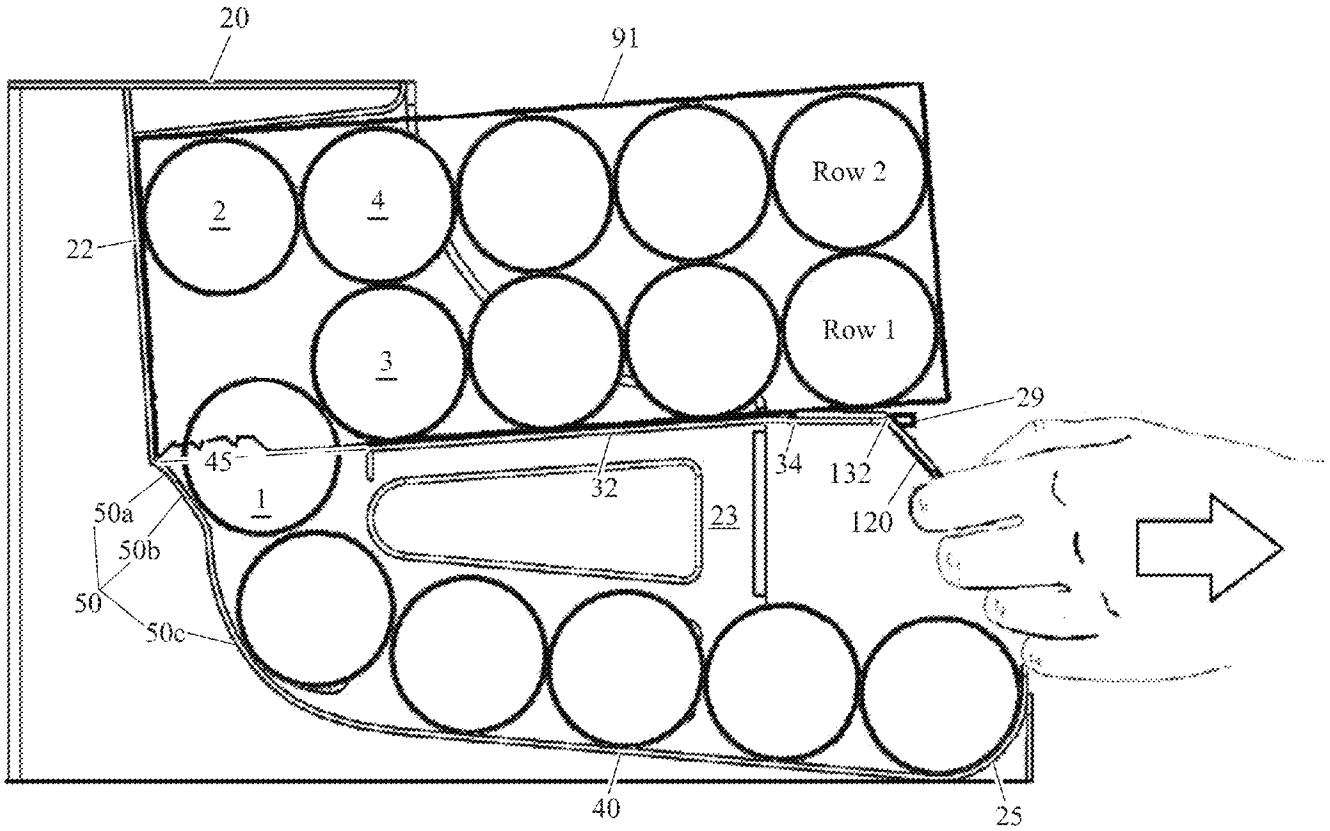
FIG. 57 shows a cartridge after being pushed into a dispenser thereby removing the priming flap and retaining flap from the cartridge.
Figure 58:
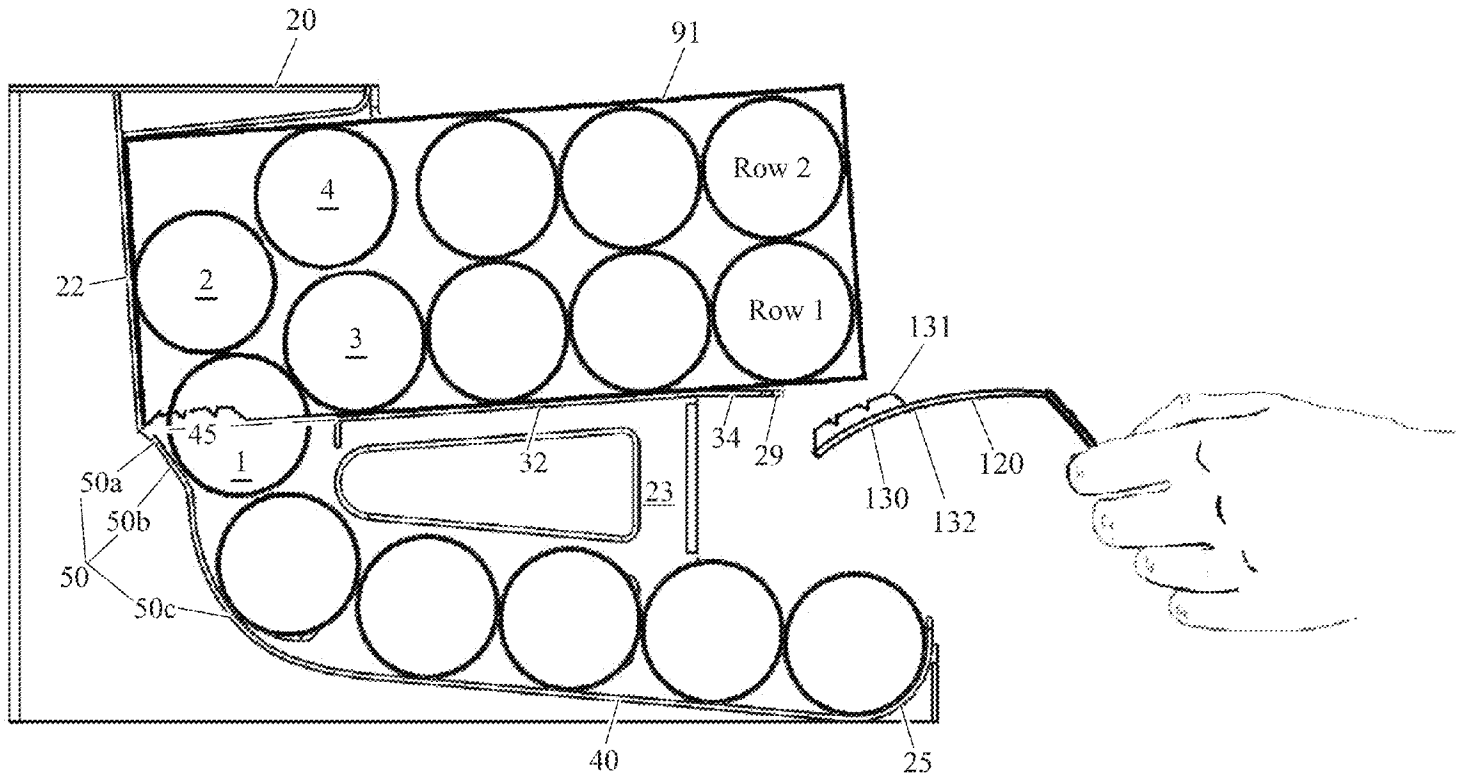
FIG. 58 shows a cartridge after being pushed into a dispenser and complete removal of the opening flap and retaining flap.

The dispenser 20 is also fitted with an resting surface tab 29, as shown for example in FIG. 54, long enough that it may be inserted into the priming flap slot 132, and wide enough to securely engage priming flap slot 132, and hold the priming flap 132 against the front edge of the resting surface 34. This resting surface tab 29 may be an integral part of the dispenser 20 resting surface 34 construction, or may be retrofitted as a component that is attached to the front end of the resting surface 34 using screws, adhesives, or other suitable forms of attachment. The resting surface tab 29 is the only structural modification to the dispenser 20 associated with this cartridge 91 embodiment compared to the previously described cartridge 90 embodiment. The method of using this cartridge 91 is illustrated in FIG. 53 and FIGS. 55-57, and includes the steps of:

Step One: punching open the finger grip 100 and grasping the priming flap 120 (see FIG. 53), tearing the priming flap 120 rearward along its perforations (see FIG. 53) and stopping the tear at fold line "A" (see FIG. 53);

Step Two: inverting the cartridge 91 and placing its partially unopened end on the resting surface 34 (see FIG. 55);

Step Three: engaging the priming flap 120 slot 132 over the resting surface tab 29 on the front end of the dispenser's resting surface 34 (see FIGS. 55-56);

Step Four: pushing the cartridge 91 into the cartridge holding area 24 with one hand, while the priming flap slot 132 engaged by the resting surface tab 29 holds the priming flap 120 in place at the front end of the resting surface 34, until the dispenser 20 contacts the dispenser's internal back wall 22 (see FIG. 57), thereby shearing the retaining flap 130 from the cartridge 91 at the sidewall perforations 131 (see FIGS. 56-57); and Step Five: disposing of (removing and recycling or discarding) the cartridge priming flap 120 and retaining flap 130, now fully separated from the cartridge 91 (see FIG. 58).

Figure 59:
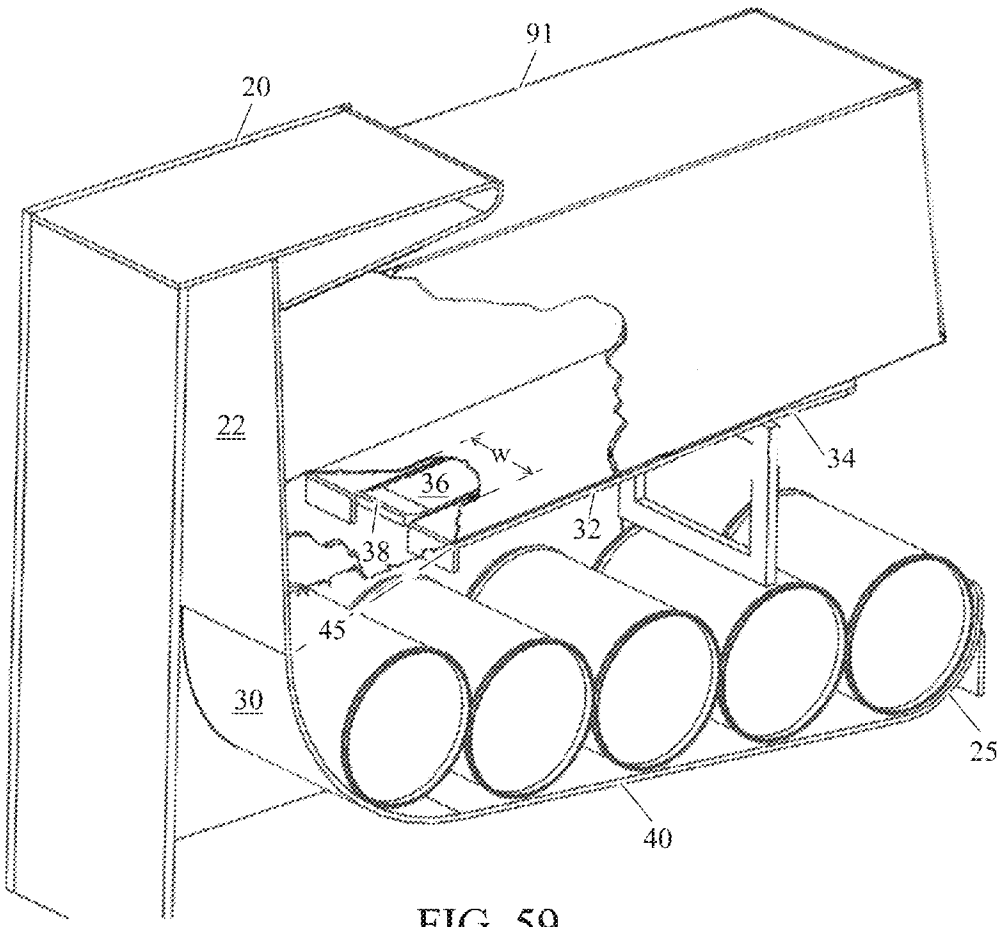
FIG. 59 shows a partial cut away of a dispenser and an installed cartridge.

Referring to FIG. 59, the cartridge 91 can be used with a dispenser 20 having an impedance ridge 38 and spring tongue 36, as well as an exit port 45, down chute 30, lower feed ramp 40, and product selection area 25. In this figure the dimensions of the cartridge 91 finger grip 100 and priming flap 120 are selected so that cartridge 91 material is removed from the area corresponding to the impedance ridge 38 and spring tongue 36 when the cartridge 91 is fully inserted in the dispenser. As previously described herein with regard to FIG. 50, removing material with a width "w" above the impedance ridge 38 and spring tongue 36 allows the impedance ridge to directly contact cans in the cartridge 91 for most reliable operation in impeding or allowing the movement of those cans when desired.

Alternatively, the cartridge 91 may be used in a dispenser 20 having a substantially S-shaped down chute 50 rather than a sprung impedance ridge to prevent jamming. In this alternate embodiment, the cartridge 91 feeds in the identical manner described herein with regard to the combination of cartridge 90 with a dispenser 20 having a substantially S-shaped down chute 50, and shown in FIGS. 47-48.

Another combination of cartridge and dispenser embodiments, shown in FIGS. 60-97, provides a cartridge with specific types of die cut perimeters, perforation slots, folds, and assembly methods, and a modified dispenser to enable quick, safe, easy opening of cartridges during the insertion of the cartridge into the dispenser. The dispenser 20 shown in these figures includes two sides 21, 23, a top 26, a resting surface 34, a cartridge loading ramp 32, a cartridge holding area 24, an exit port 45, a lower feed ramp 40, and a product selection area 25. FIGS. 60-61, FIGS. 63-73, and FIGS. 80-82 show a dispenser 20 with a conventional arcuate down chute 30, while FIGS. 74-78, FIG. 89, and FIGS. 96-97 show a dispenser 20 with an S-shaped down chute 50, as previously described herein.

Figure 60:
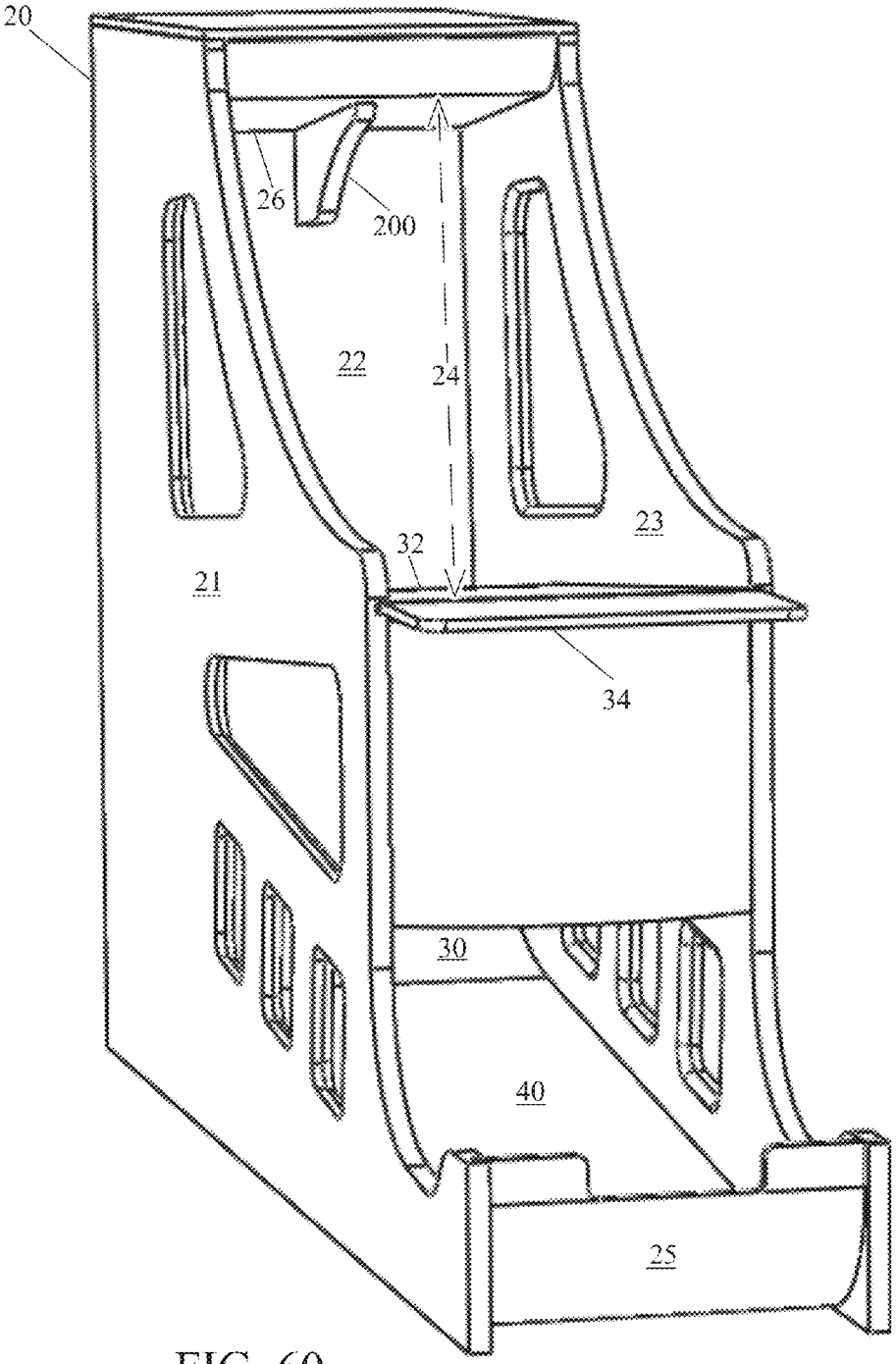
FIG. 60 shows a perspective detail of a modified dispenser with cartridge opening wedge.
Figure 61:
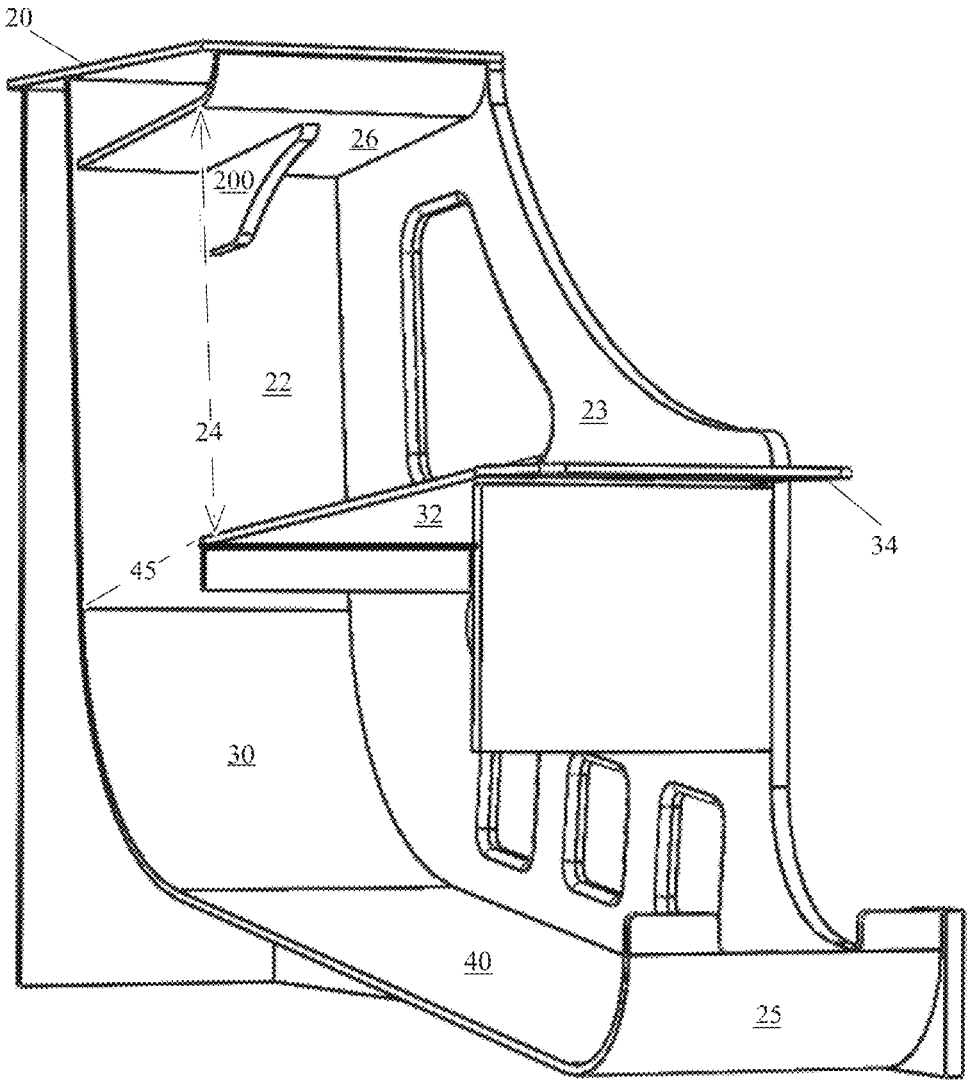
FIG. 61 shows a partial cut away perspective of a dispenser having a cartridge opening wedge.
Figure 63:
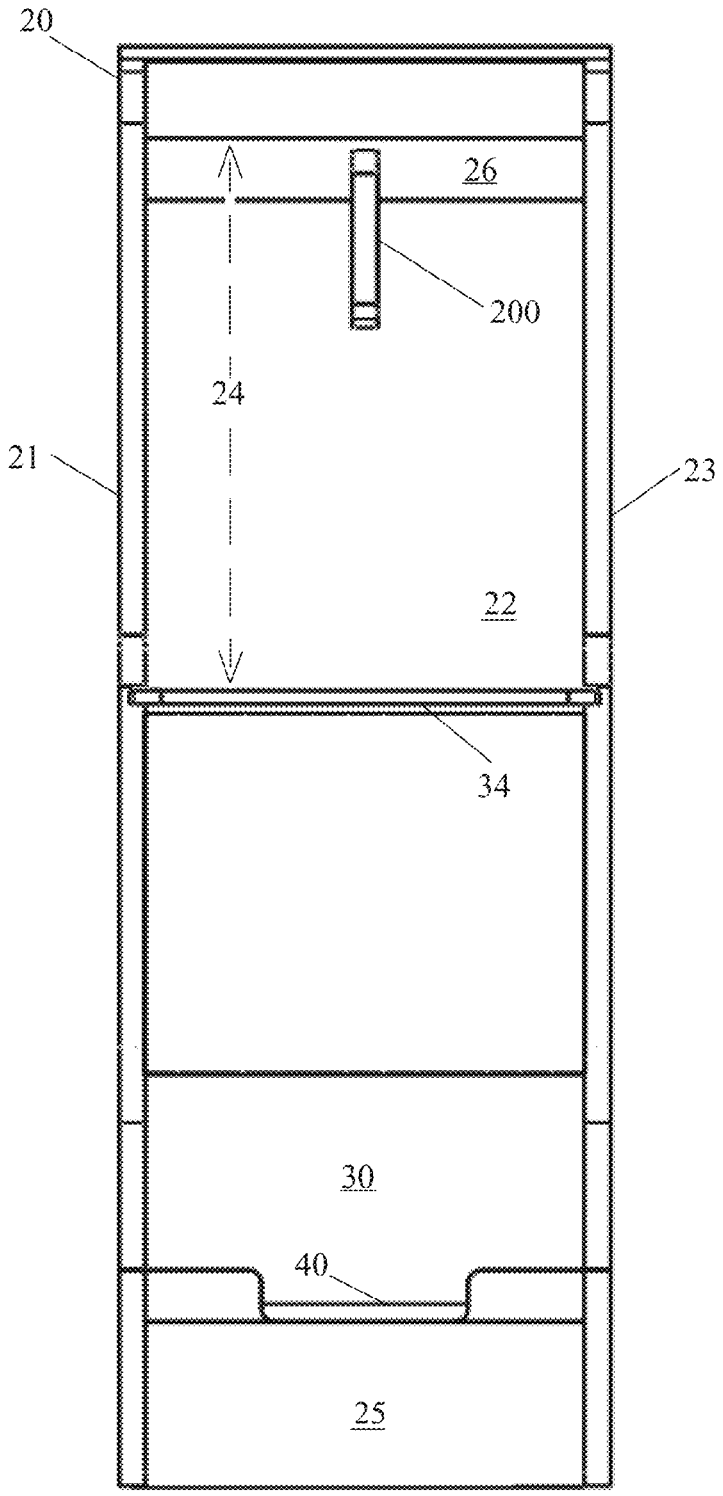
FIG. 63 shows a front view of a dispenser having a cartridge opening wedge.

The dispenser 20 of FIGS. 60-61 and FIG. 63 also includes a generally wedge-shaped rib 200 centrally located at the top 26 and rear 22 of the cartridge holding area 24, and is hereafter referred to as a "wedge" 200. The wedge 200 may be an integral part of the dispenser 20, or may be retrofitted to an existing dispenser 20 with screws, adhesives, or other similar robust attachment means. Although only one wedge 200 is shown, a plurality of wedges 200 spaced across the dispenser top 26 and rear 22 may be alternatively used accordingly to, for example, distribute force to multiple cans in a cartridge 92, 94 (see FIGS. 83 and 90) through a plurality of wedges 200 rather than a single wedge 200.

Figure 62:
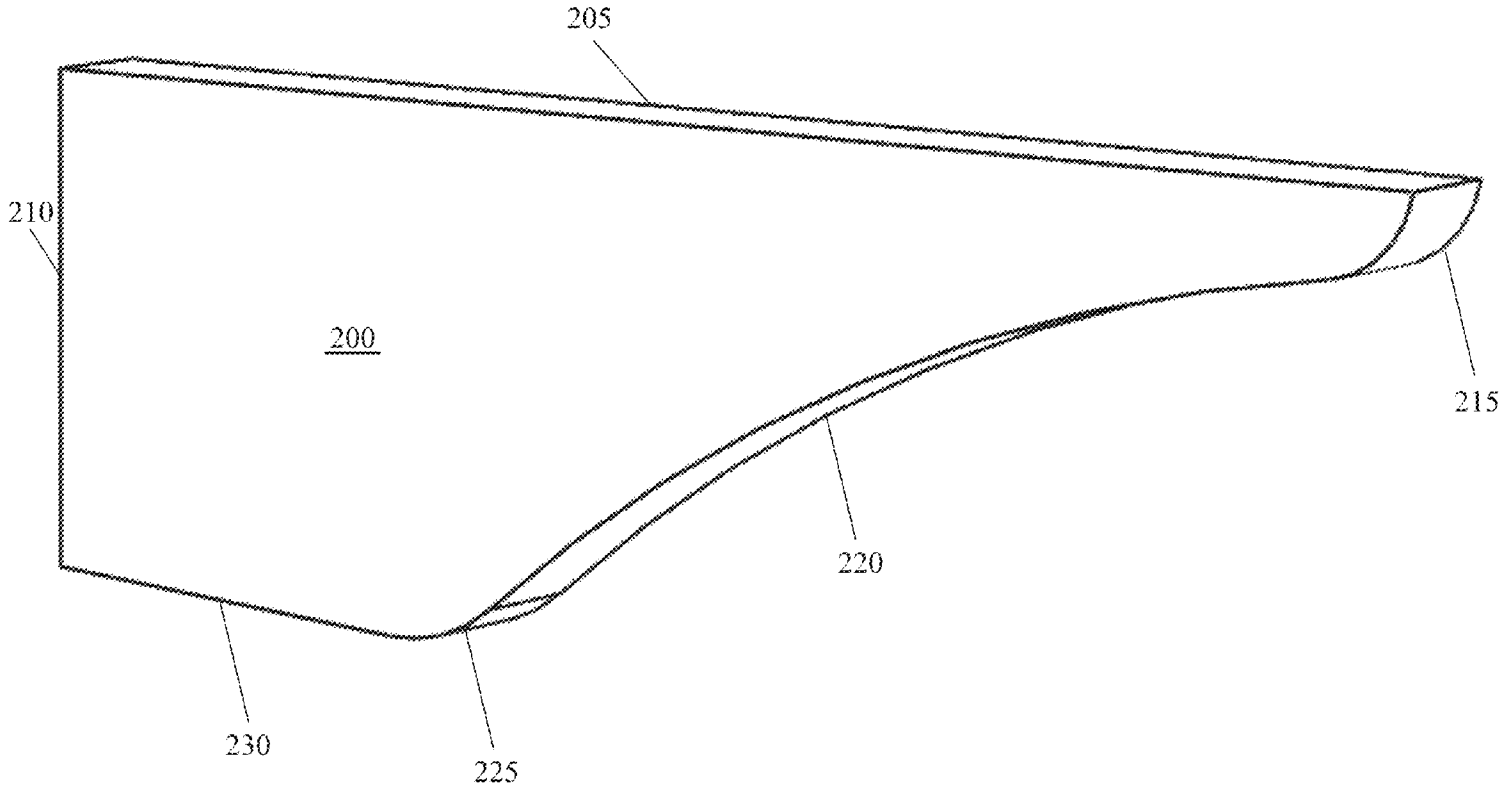
FIG. 62 shows a detail of a cartridge opening wedge.

In one preferred embodiment, shown in FIG. 62, the wedge 200 is generally trapezoidal, having a base 205, a side 210 perpendicular to the base 205, a top 230 parallel to the base 205 for a portion of the base 205 length, and a second side that connects the shorter top 230 and longer base 205. This second side is generally formed by three arcuate sections 215, 220, 225. A front-most arcuate section 215 forms a small convex, arcuate surface which begins approximately perpendicular to the base 205, and ends approximately tangent to a central arcuate section 220.

Figure 64:
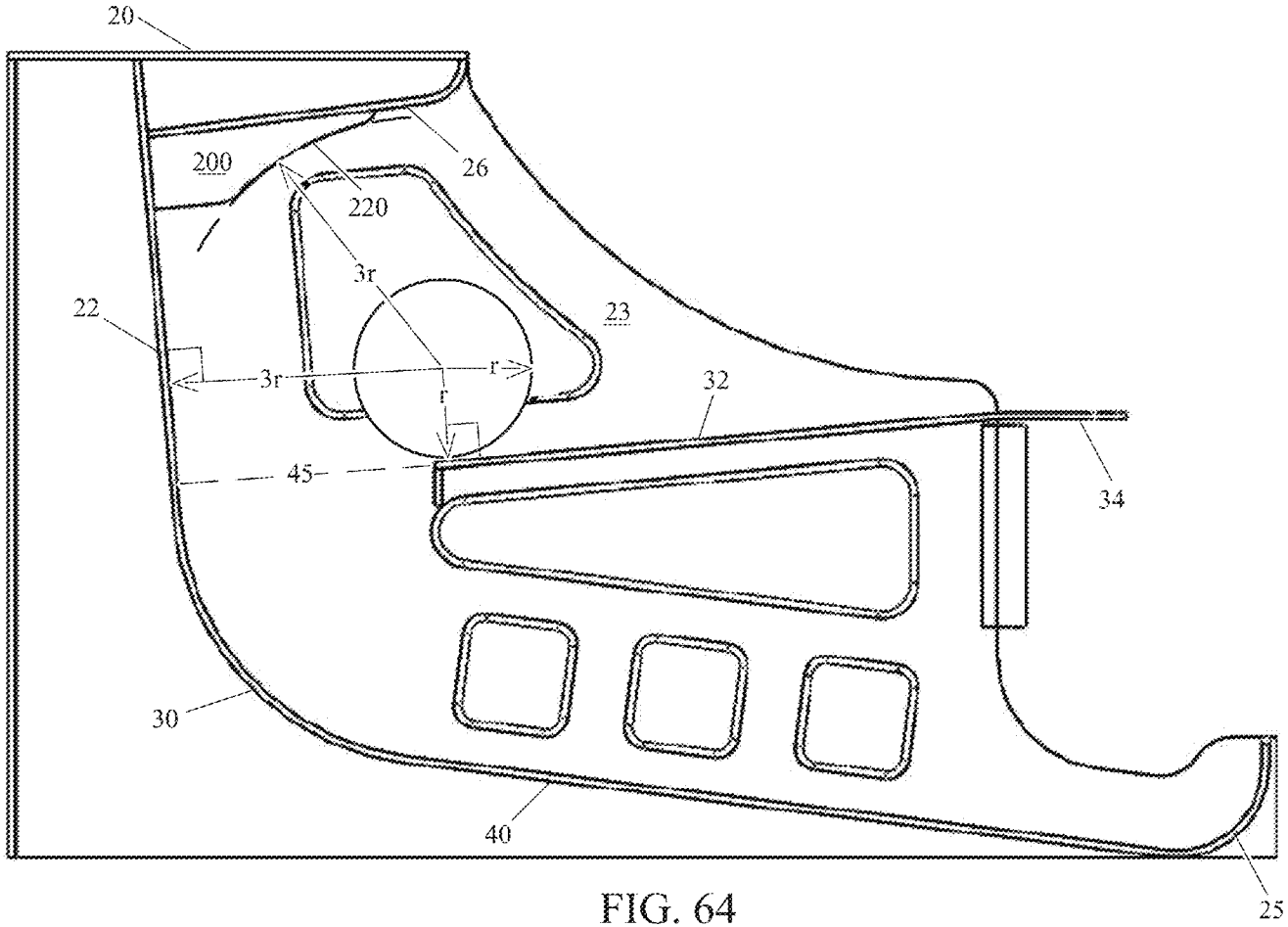
FIG. 64 shows a radius of curvature of a cartridge opening wedge.

The central arcuate section 220 is a generally concave arcuate surface which, as shown in FIG. 64, is roughly concentric to the outermost circumference of can 3 when a cartridge is completely inserted into the dispenser 20. In some preferred embodiments, the radius of curvature of the central arcuate section 220 is approximately 3 times the radius, "r", of can 3. In some preferred embodiments the origin of the central arcuate section 220 radius of curvature is located at a distance approximately "r" perpendicularly above the cartridge loading ramp 32, and a distance approximately "3r" perpendicularly forward of the dispenser back 22. Deviations from these dimensions are considered within the scope of this description, provided the function of the wedge 200 when interacting with the cartridge 92, 94 is maintained.

A third arcuate section 225 connects the central arcuate section 220 with the wedge 200 top 230 and forms a smooth transition between the two that will not dent or puncture cans as they move along the wedge 200.

Figure 65:
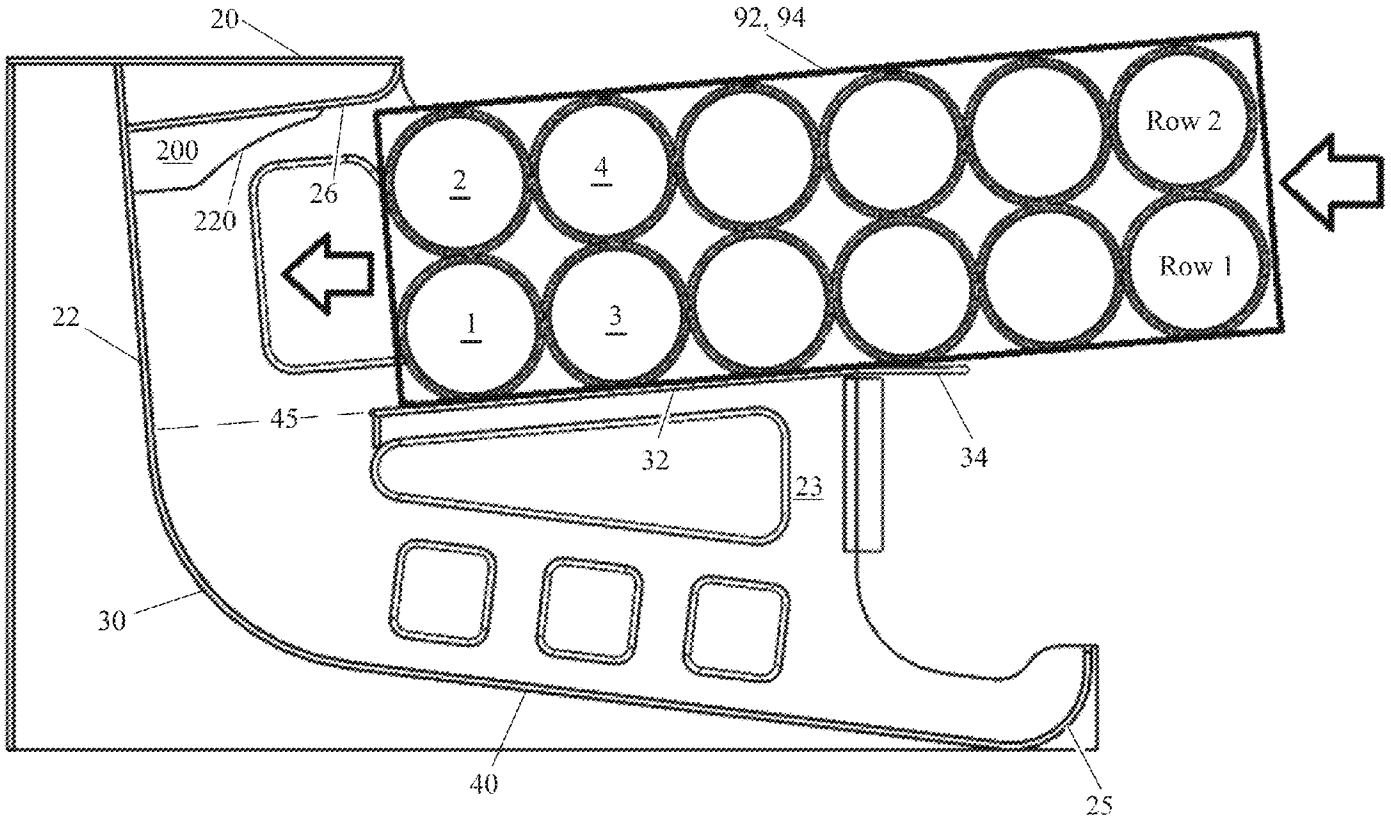
FIG. 65 shows an open side view of a cartridge having a perforated slot and bridge being inserted into a dispenser with a cartridge opening wedge.
Figure 66:
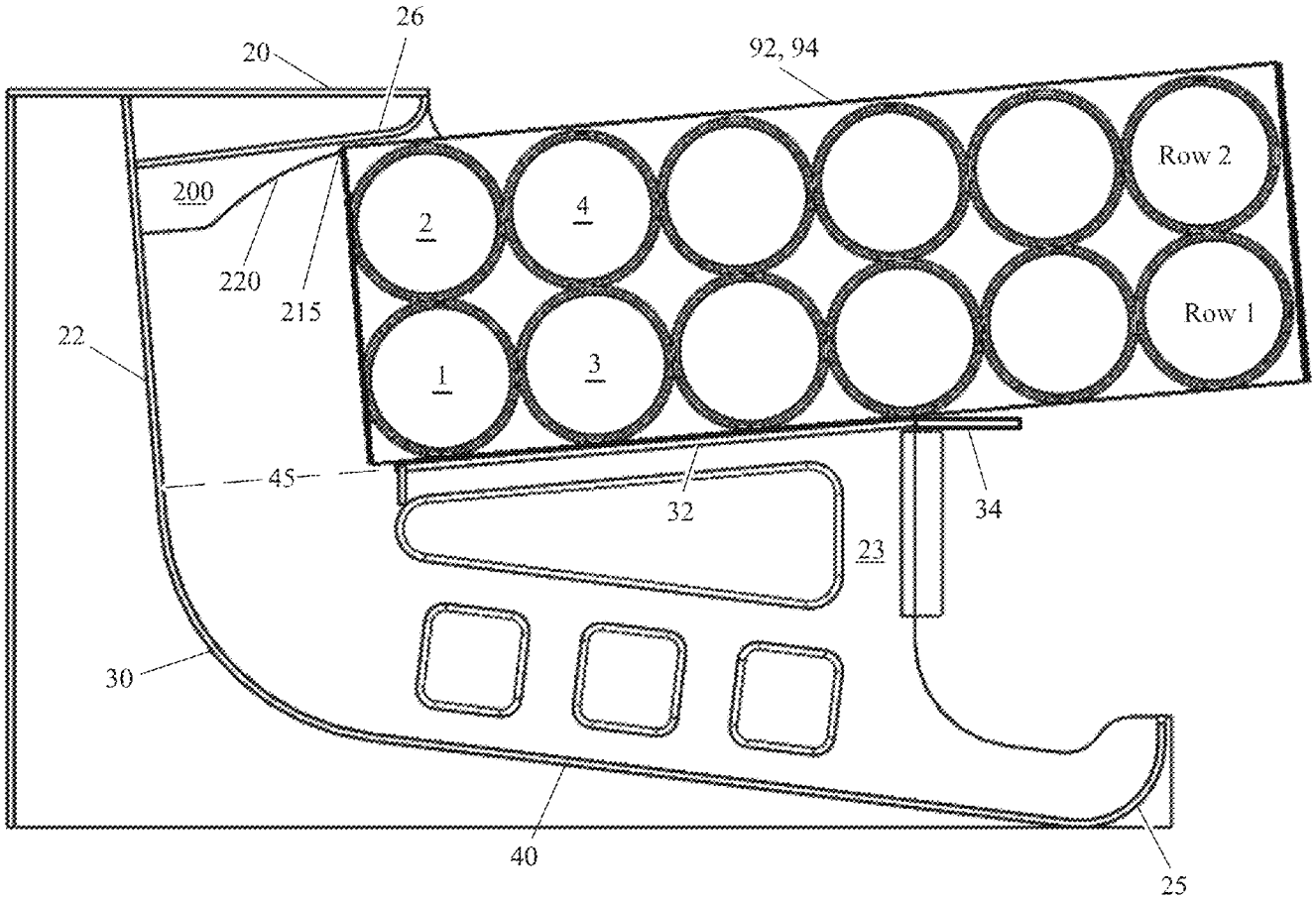
FIG. 66 shows an open side view of a cartridge having a perforated slot and bridge being inserted into a dispenser with a cartridge opening wedge and the opening wedge and bridge contacting the a first edge of the cartridge.
Figure 67:
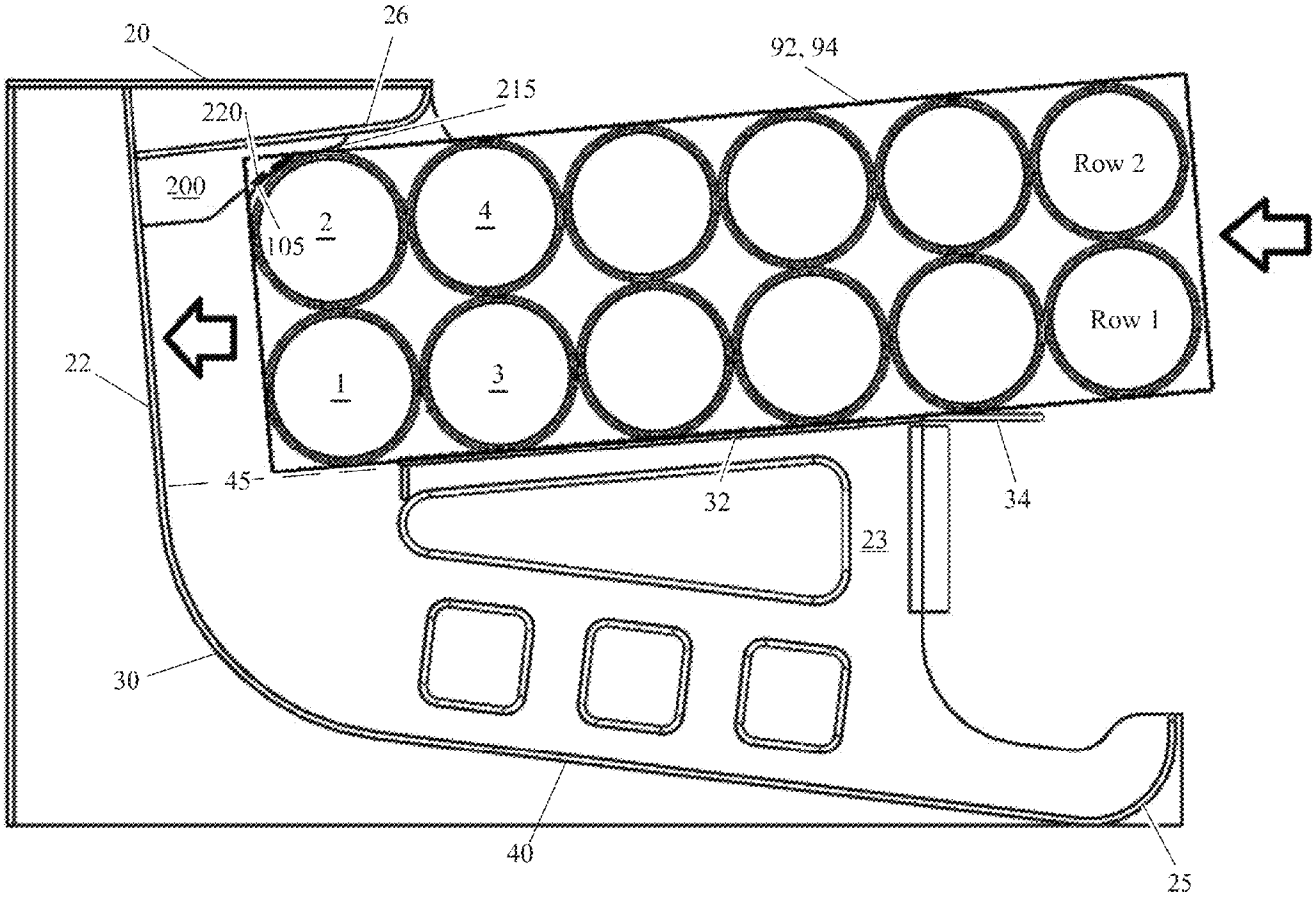
FIG. 67 shows an open side view of a cartridge having a perforated slot and bridge being inserted into a dispenser with a cartridge opening wedge with the opening wedge and bridge contacting first can in an upper row of the cartridge and starting to push cans downward as insertion continues.
Figure 68:
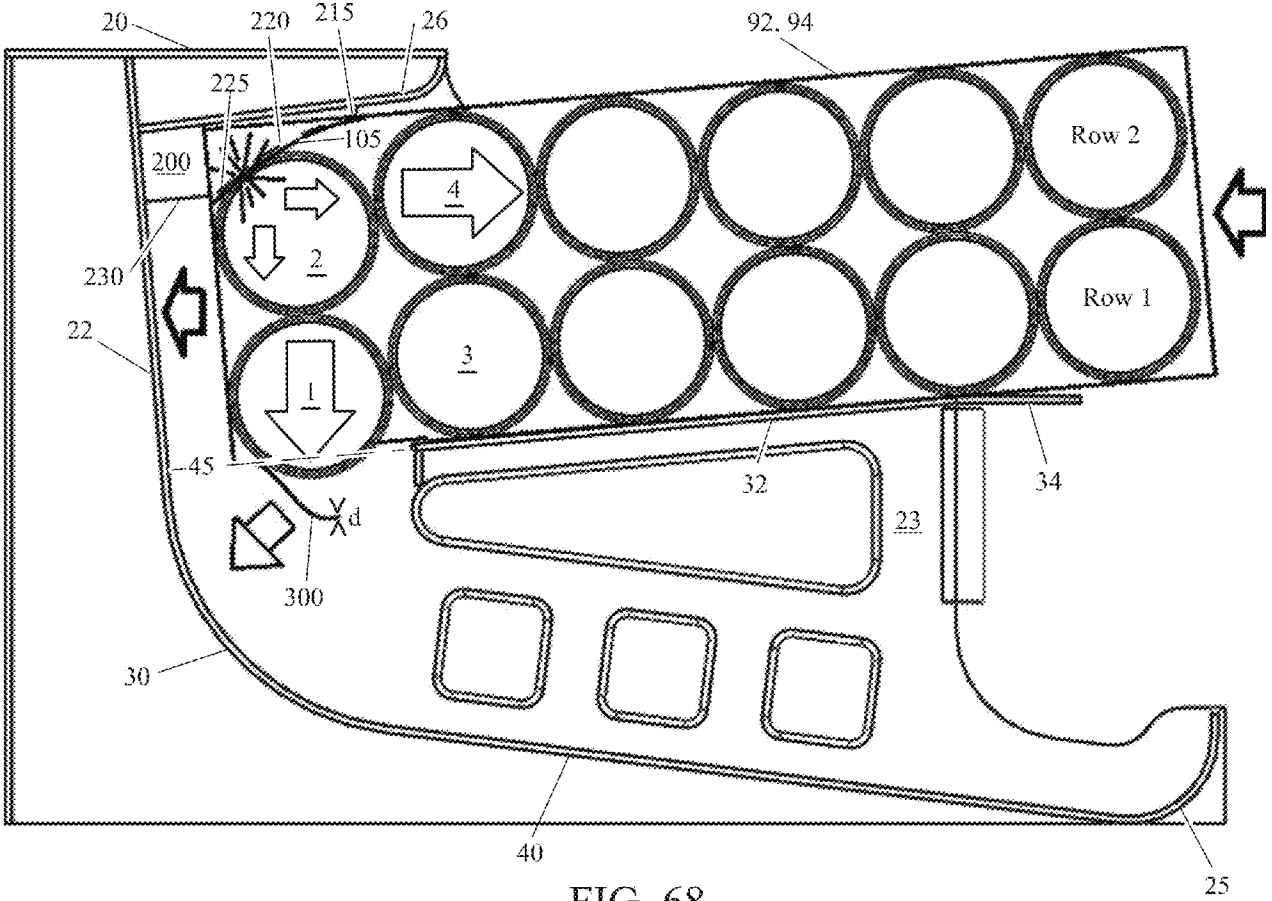
FIG. 68 shows first can in an upper row of the cartridge and starting to push cans downward as insertion continues a cartridge having a perforated slot and bridge being inserted into a dispenser with a cartridge opening wedge and the opening wedge and bridge forcing cans in the cartridge to open the cartridge retaining flap.
Figure 69:
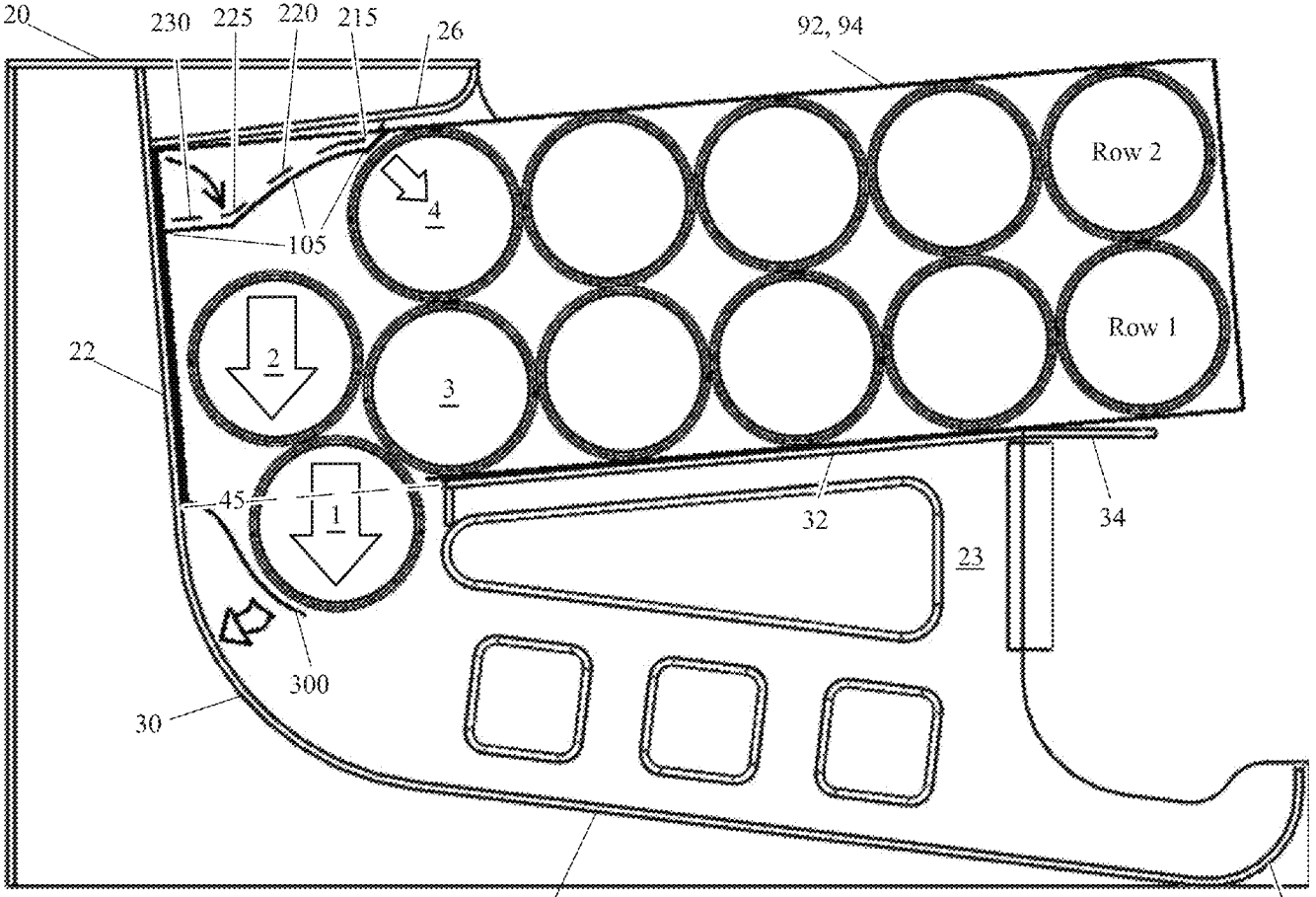
FIG. 69 shows an open side view of a cartridge having a perforated slot and bridge after being inserted into a dispenser with a cartridge opening wedge, the cartridge retaining flap continuing to be forced open, and cans beginning to feed into the dispenser.

As shown in FIGS. 65-67, the wedge 200 front-most arcuate section 215 preferably extends downward toward the exit port 45 so that it contacts the upper rear edge of the cartridge 92, 94 as the cartridge 92, 94 is pushed into the dispenser 20. When the cartridge 92, 94 is inserted into the dispenser 20 sufficiently far to reach the wedge 200, as shown in FIG. 66, the front-most arcuate section 215 contacts the upper rear edge of the cartridge 92, 94 and pushes a die cut bridge 105 (including 105*a*, 105*b*, 105*c*, 105*d*), also shown in FIG. 83 and FIG. 90, inward and downward into the cartridge 92, 94. As shown in FIGS. 67-69, as the cartridge 92, 94 moves further into the dispenser 20, the die cut bridge 105 (including 105*a*, 105*b*, 105*c*, 105*d*) begins sliding along, and conforming to, the shape of the central arcuate section 220 of the wedge 200. As the cartridge 92, 94 is pushed further into the dispenser 20, as shown in FIG. 68, the wedge 200 translates the lateral rearward motion of the cartridge 92, 94 into a downward motion and force upon the cans 1, 2 contained in lower row 1 and upper row 2 of the cartridge 92, 94. The wedge 200 action in forcing cans in a cartridge downward works with single row cartridge embodiments, as well as cartridge embodiments that contain two or more rows or rolling products.

The overall front to rear length of the wedge 200 should be sufficient to contact, and apply downward pressure on, the cartridge 92, 94 (see FIG. 66) and against can 2 (see FIGS. 67-68), so that can 2 and can 1 force open a retaining flap 300 below can 1 (see FIGS. 68-70) as cans 2 and 1 are pushed down by the wedge 200. The wedge 200 is preferably short enough (see FIG. 69) that the front-most arcuate section 215 does not forcibly contact can 4 when the cartridge 92, 94 is completely inserted in the dispenser 20, as it would dent can 4 during forcible cartridge 92, 94 insertion and possibly render can 4 unsalable. Similarly, if the wedge 200 front-most arcuate section 215 extends too far downward into the dispenser 20, can 4 may also be dented.

If the wedge 200 is too short, or does not extend downwardly into the dispenser 20 far enough, the wedging action as the cartridge 92, 94 is inserted into the dispenser 20 can fail. If the wedge 200 does not extend far enough downwardly into the dispenser 20, the wedge 200 may not create sufficient downward force on can 2 and can 1 to force the perforated retaining flap 300 (see FIGS. 68-70) completely open. If the wedge 200 is too short, it will not extend far enough forward toward can 4 when the cartridge 92, 94 is fully inserted in the dispenser to cause the deflected die cut bridge 105 (including 105*a*, 105*b*, 105*c*, 105*d*) to impede movement of can 4, as shown in FIGS. 68-72, so that can 3 exits the cartridge 92, 94 before can 4.

The wedge 200 is preferably sufficiently wide to perform two functions. It should be thick enough to be both structurally stable and durable, as many cartridge 92, 94 insertions will occur during the dispenser 20 useful life cycle. It is also preferably sufficiently thick to distribute forces acting upon can 2 over a large enough surface area to prevent can 2 from being dented during forceful insertion of the cartridge 92, 94 into the dispenser 20. If the wedge 200 is too narrow, can 2 will regularly be dented during insertion, possibly rendering that can 2 unsalable. However, the wedge 200 is preferably narrow enough so that the matching die cut slot 105 (including 105*a*, 105*b*, 105*c*, 105*d*, see FIG. 83) in the cartridge 92, 94 will not be so wide as to render the cartridge 92, 94 structurally unsound during shipment.

Figure 70:
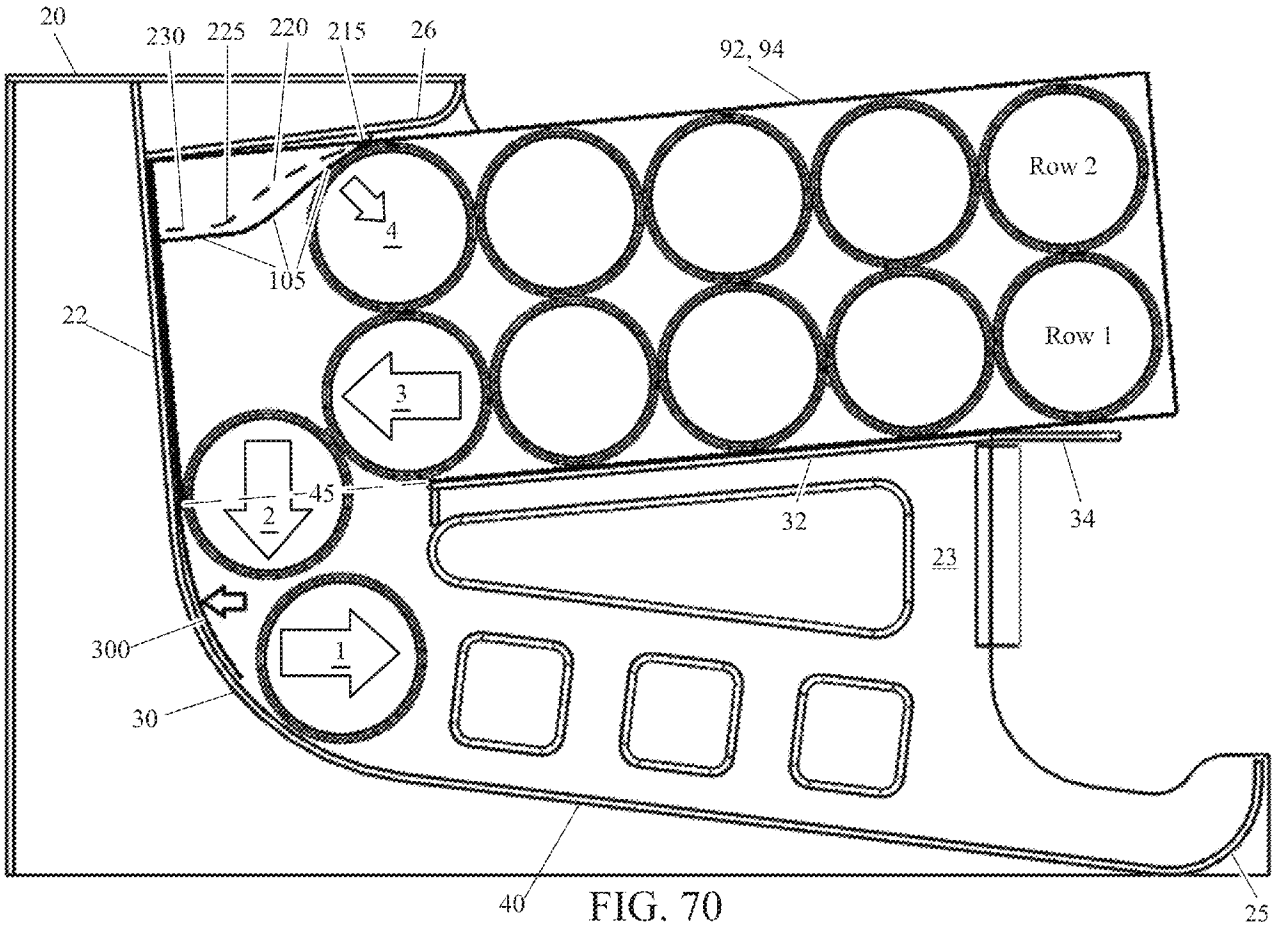
FIG. 70 shows an open side view of a cartridge having a perforated slot and bridge after being inserted into a dispenser with a cartridge opening wedge and the wedge and bridge impeding motion of cans in an upper row in the cartridge.
Figure 71:
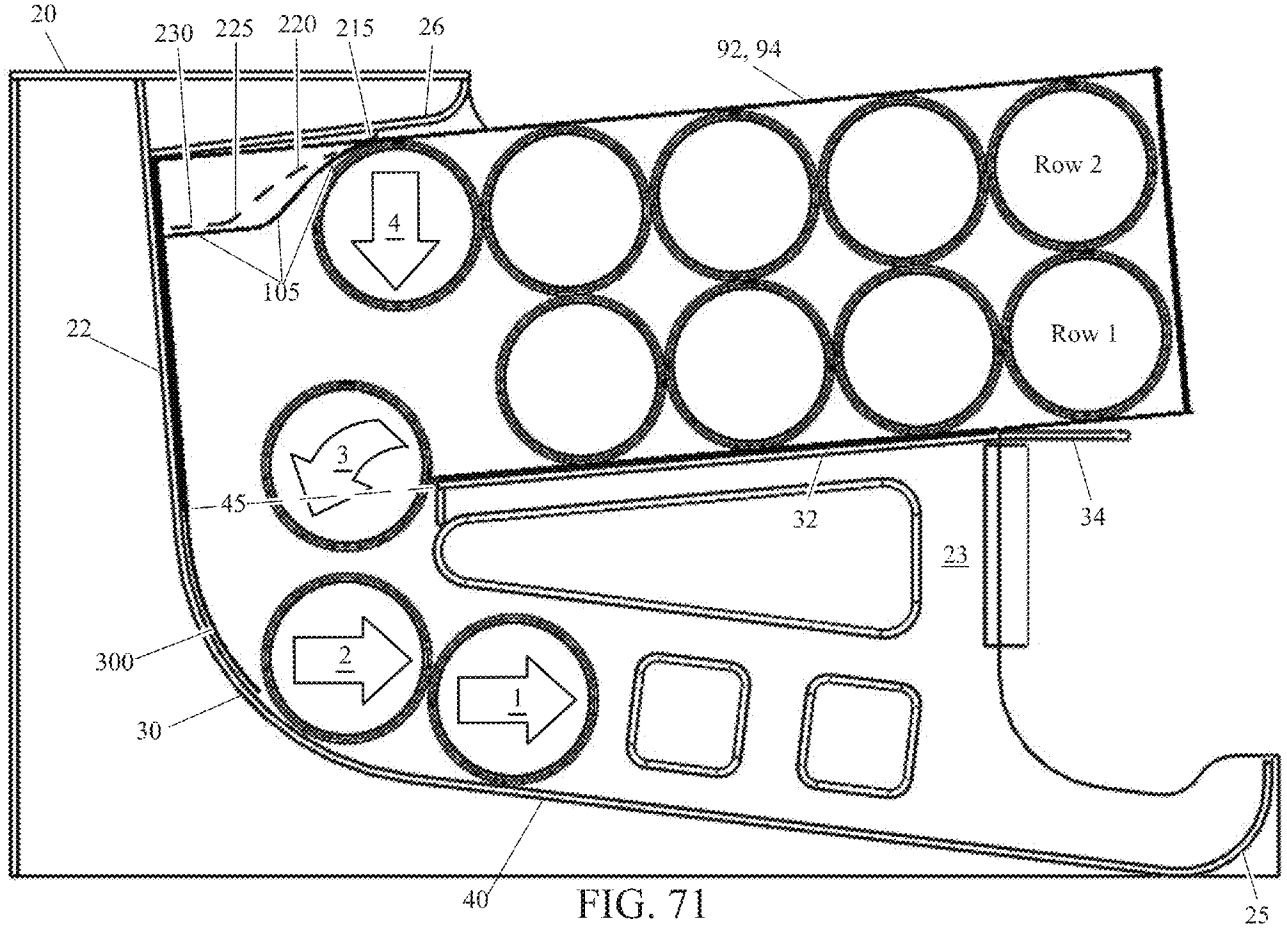
FIG. 71 shows an open side view of a cartridge having a perforated slot and bridge after being inserted into a dispenser with a cartridge opening wedge and cans in a lower row of the cartridge exiting the cartridge.
Figure 72:
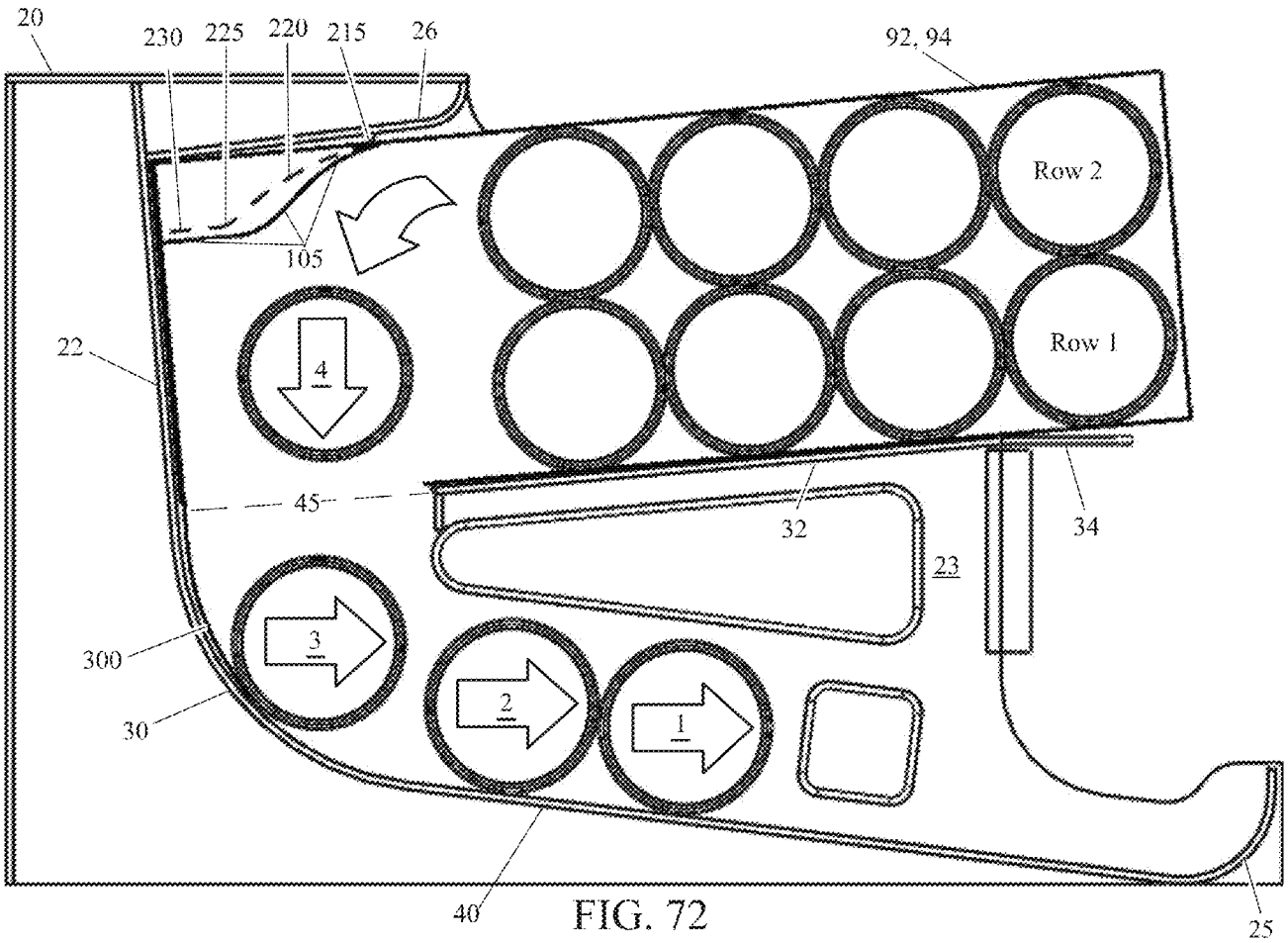
FIG. 72 shows an open side view of a cartridge having a perforated slot and bridge after being inserted into a dispenser with a cartridge opening wedge and the first three cans in the cartridge have exited the cartridge, and can 4 is now free to exit.
Figure 73:
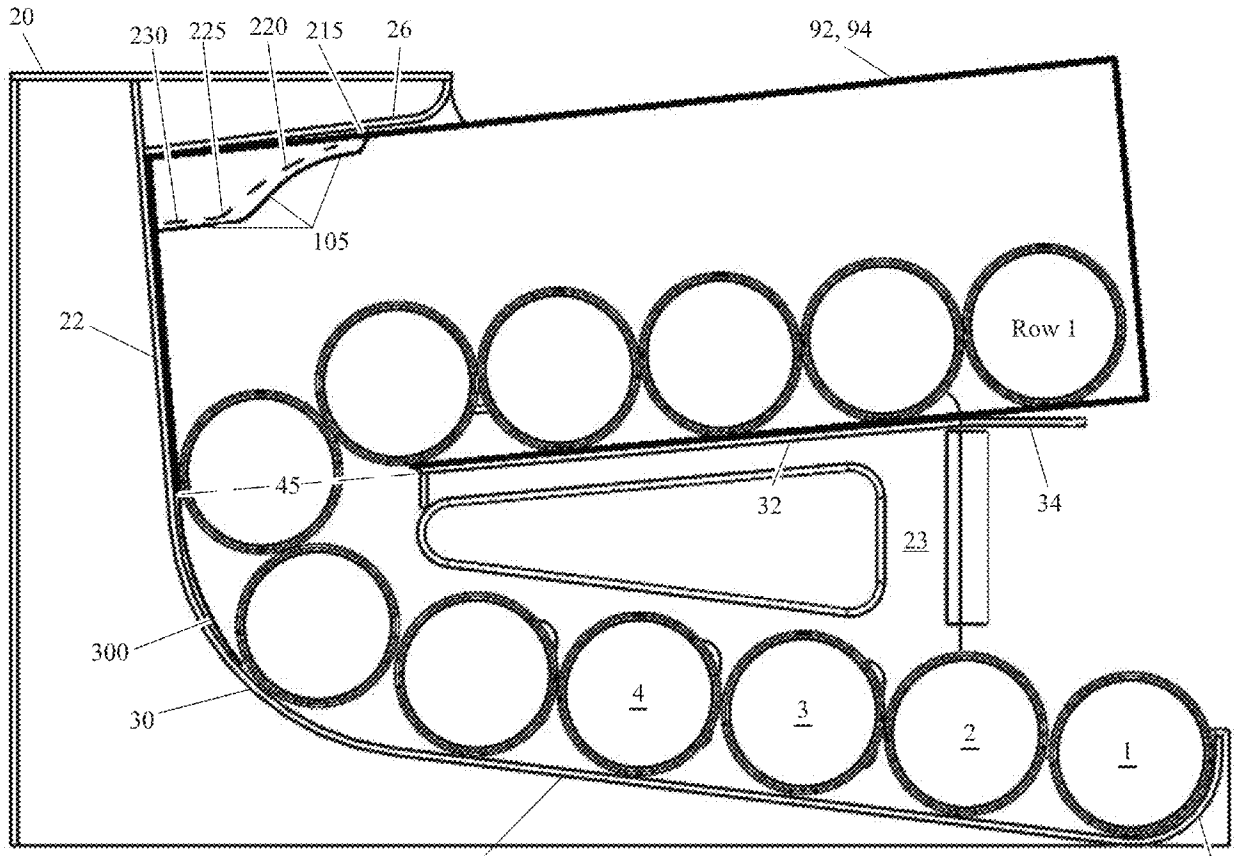
FIG. 73 shows an open side view of a cartridge having a perforated slot and bridge after being inserted into a dispenser with a cartridge opening wedge and the dispenser has been filled.
Figure 74:
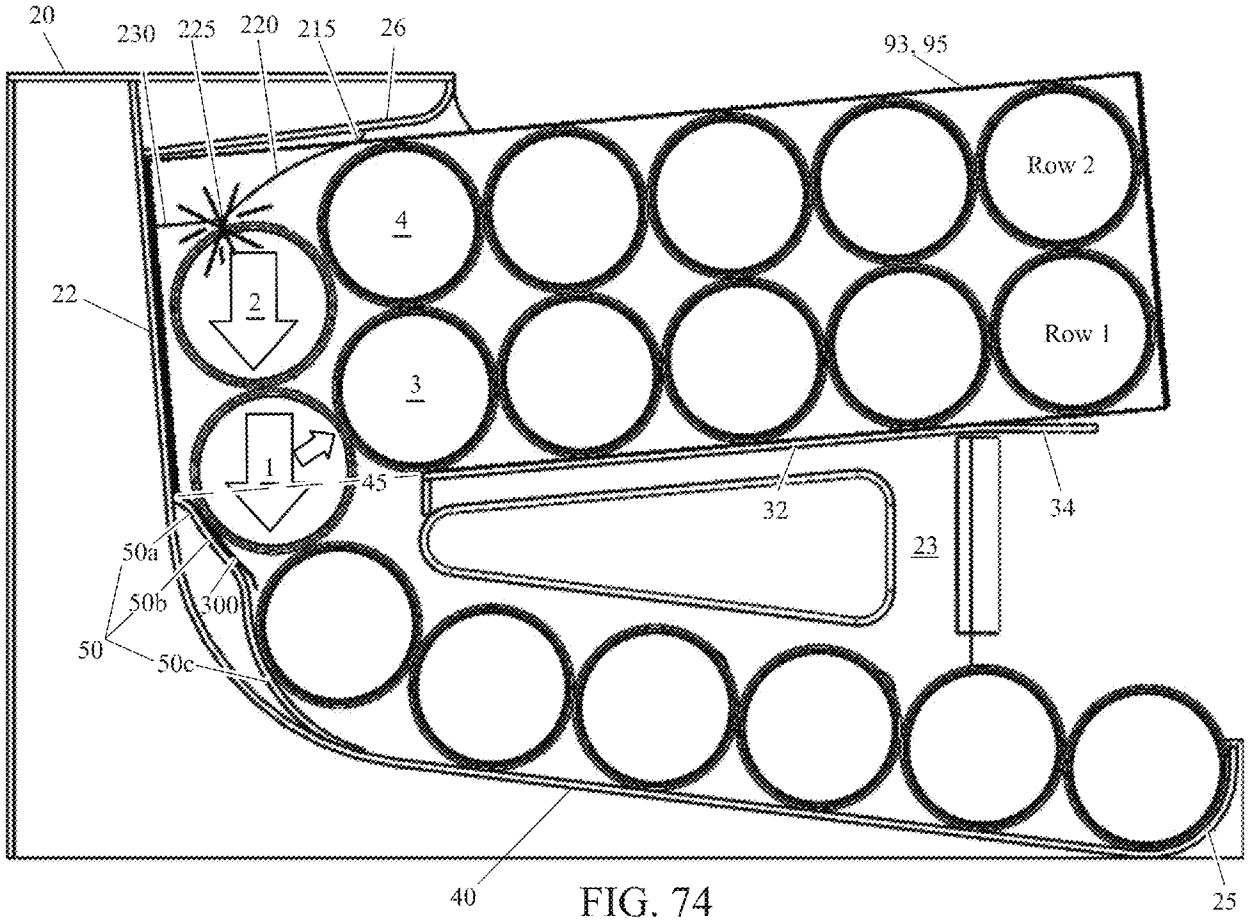
FIG. 74 shows an open side view of a cartridge having an always open or fully openable slot after it has been inserted into a partially filled dispenser having a cartridge opening wedge and an S-shaped down ramp.
Figure 75:
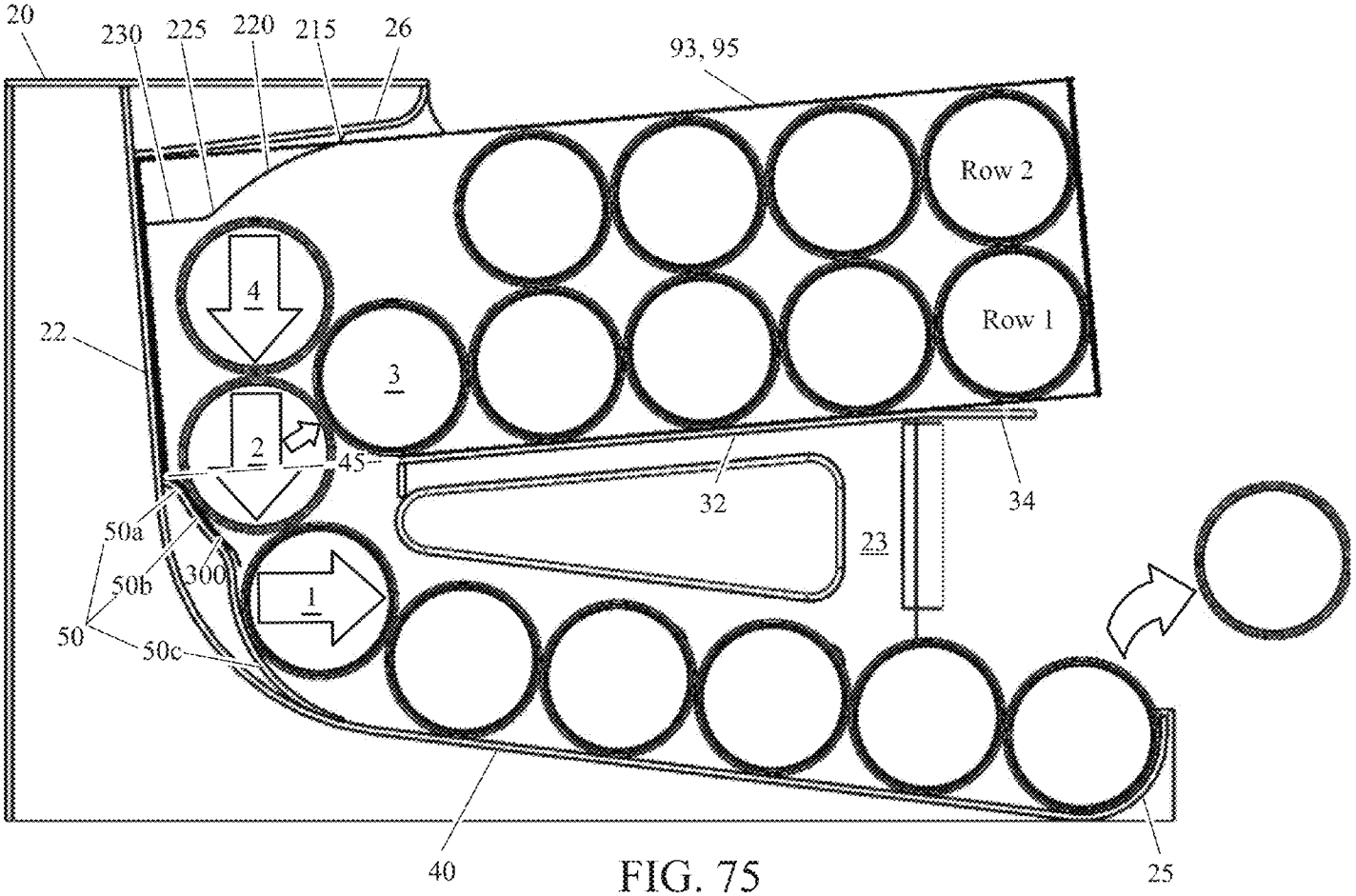
FIG. 75 shows an open side view of the first two cans exiting a cartridge having an always open or fully openable slot after it has been inserted into a partially filled dispenser having a cartridge opening wedge and an S-shaped down ramp.
Figure 83:
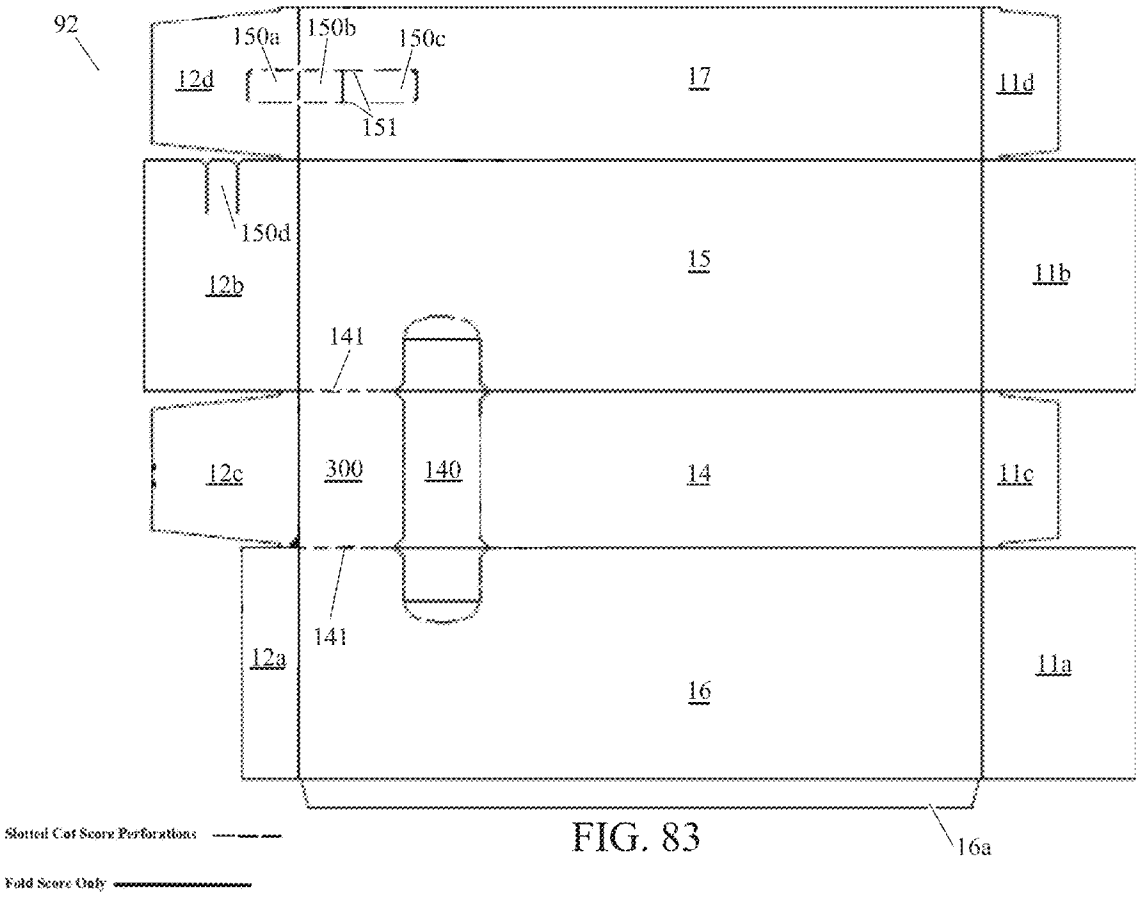
FIG. 83 shows a die cut flat blank lay out of a cartridge having a perforated slot and bridge, a perforated removable priming flap, and a perforated retaining flap.
Figure 90:
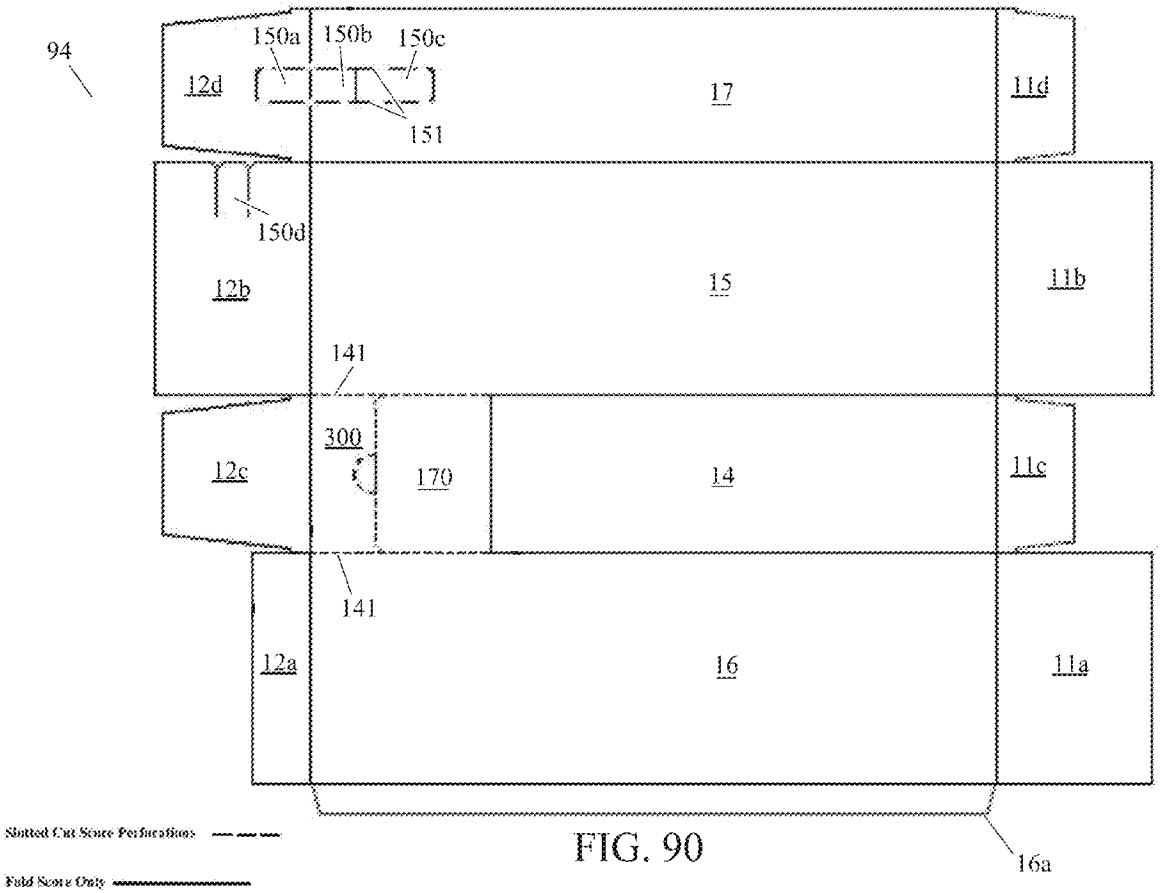
FIG. 90 shows a die cut flat blank lay out of a cartridge having a perforated slot and bridge and alternative priming flap with perforations and a fold score.

The dispenser 20 and cartridge 92, 94 embodiments shown in FIGS. 60-73 may be implemented in alternate embodiments as well. If the cartridge 92, 94 is die cut with a slot and bridge 105*a*, 105*b*, 105*c*, 105*d* design, as shown in FIG. 83 and FIG. 90, can 4 will be impeded, as shown in FIGS. 69-70, by the wedge 200 and die cut bridge 105 (including 105*a*, 105*b*, 105*c*, 105*d*) once the die cut bridge 105 is deflected downward by the wedge 200 during insertion of the cartridge 92, 94. Cans in the cartridge 92, 94 are then forced to exit the cartridge in the one, two, three, four order, as shown sequentially in FIGS. 69-73. In this embodiment, a conventional dispenser 20 down chute 30 and cartridge loading ramp 32 design, as shown in FIG. 61 and FIGS. 63-73, is used as the down chute 30 and cartridge loading ramp 32 are no longer determinative in the can 1, 2, 3, 4 movements, or jams, in this embodiment.

Figure 84:
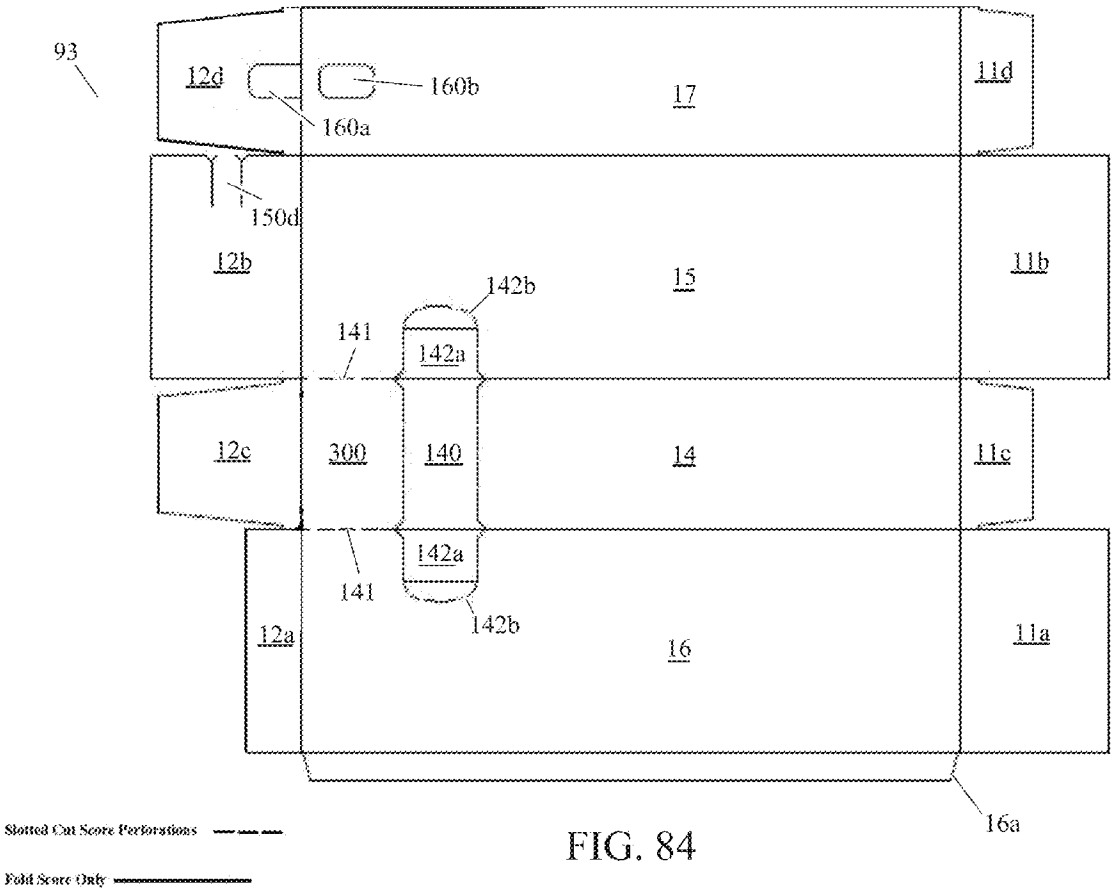
FIG. 84 shows a die cut flat blank lay out of a cartridge having an always open slot, a perforated removable opening flap, and a perforated retaining flap.
Figure 91:
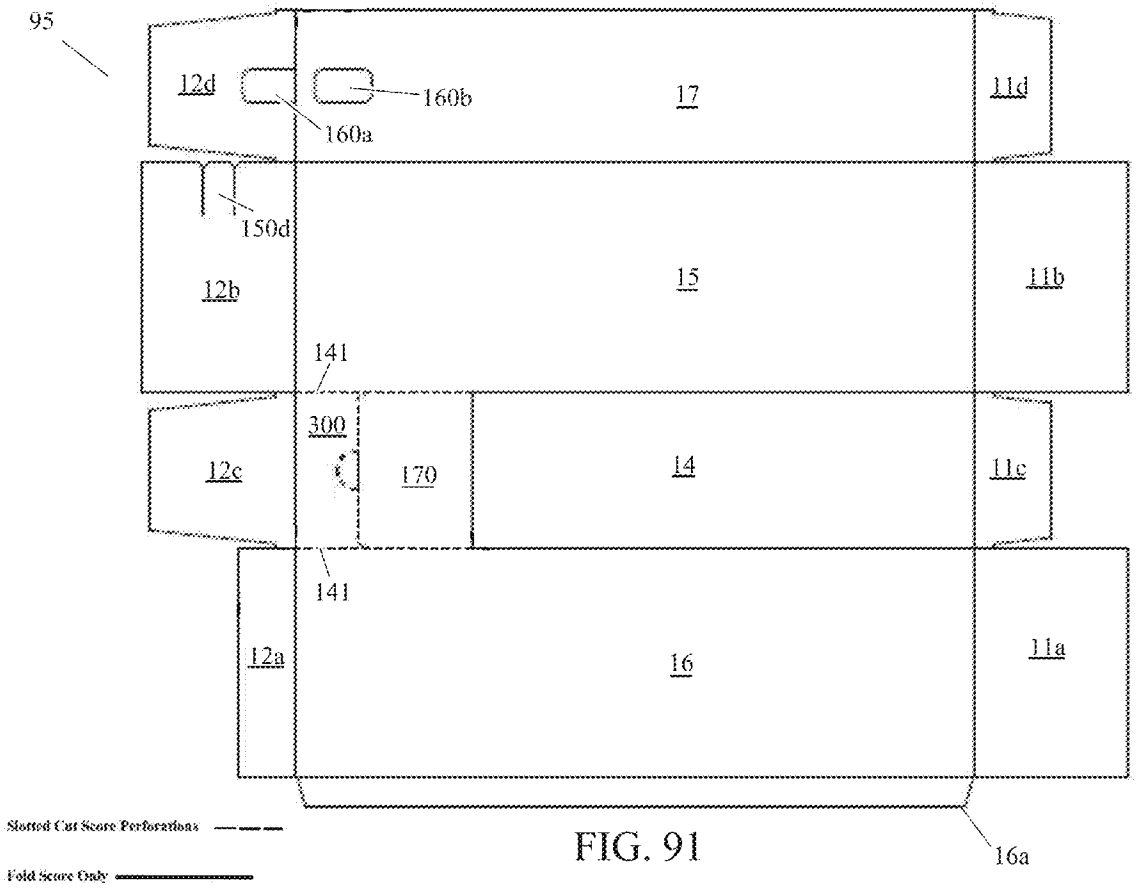
FIG. 91 shows a die cut flat blank lay out of a cartridge having an always open slot and an alternative priming flap with perforations and a fold score.

In another cartridge 93, 95 embodiment, shown in FIG. 84 and FIG. 91, the cartridge 93, 95 has an "always there" die cut opening 106*a*, or slot 106*b* that aligns with the dispenser 20 wedge 200. Alternatively, the cartridge 93, 95 may have a die cut perforation score design which enables the dispenser 20 wedge 200 to tear open an area corresponding to the "always there" slot 106*a*, 106*b* during insertion. Alternatively it may be a tear away tab and slot flap that is removed in the field by a stocking person. Both of these cartridge 93, 95 embodiments eliminate any cartridge 93, 95 wall material from deflecting into the space between the wedge 200 and the cans 2, 4. As a result, the space between the wedge 200 central arcuate section 230 and the cans 2, 4 will be empty during and after cartridge 93, 95 insertion.

Referring to FIGS. 74-78, the cartridge 93, 95 having an "always there" slot 106*a*, 106*b* (shown in FIG. 84 and FIG. 91) provides can 4 with clearance between the wedge 200 and can 3, and motion of can 4 is not impeded by the wedge 200 after cartridge 93, 95 insertion. As a result, can 4 will exit the cartridge 93, 95 after can 2 and before can 3. In this embodiment, a dispenser 20 with an impedance ridge 38, S-curved down chute 50 (as shown in FIGS. 74-78 and previously described herein), or other jam prevention improvement is preferably used. The cans 1, 2, 3, 4 will then exit the cartridge 93, 95 through the exit port 45, without jamming, in the one, two, four, three order.

Figure 79:
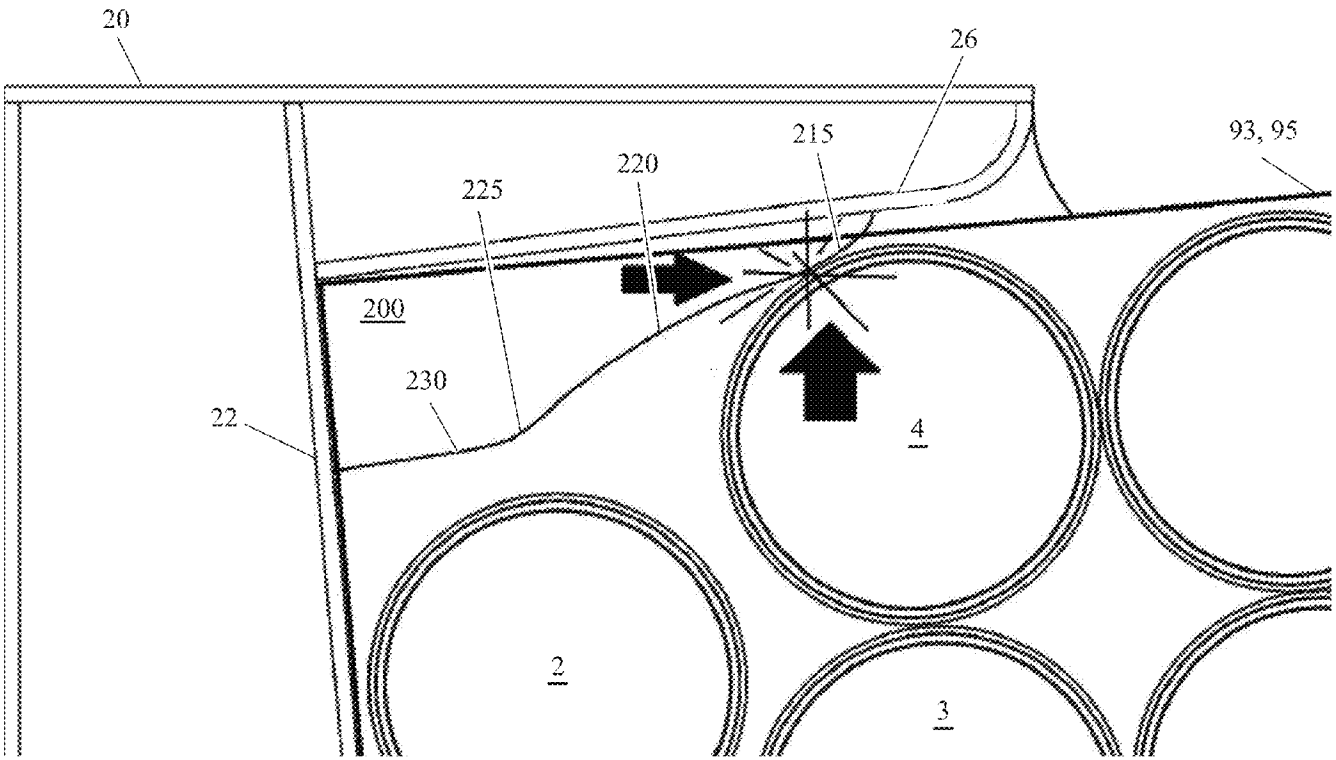
FIG. 79 shows a detail of a cartridge opening wedge interacting with a can in an upper row of a cartridge having an always open or fully openable slot.
Figure 80:
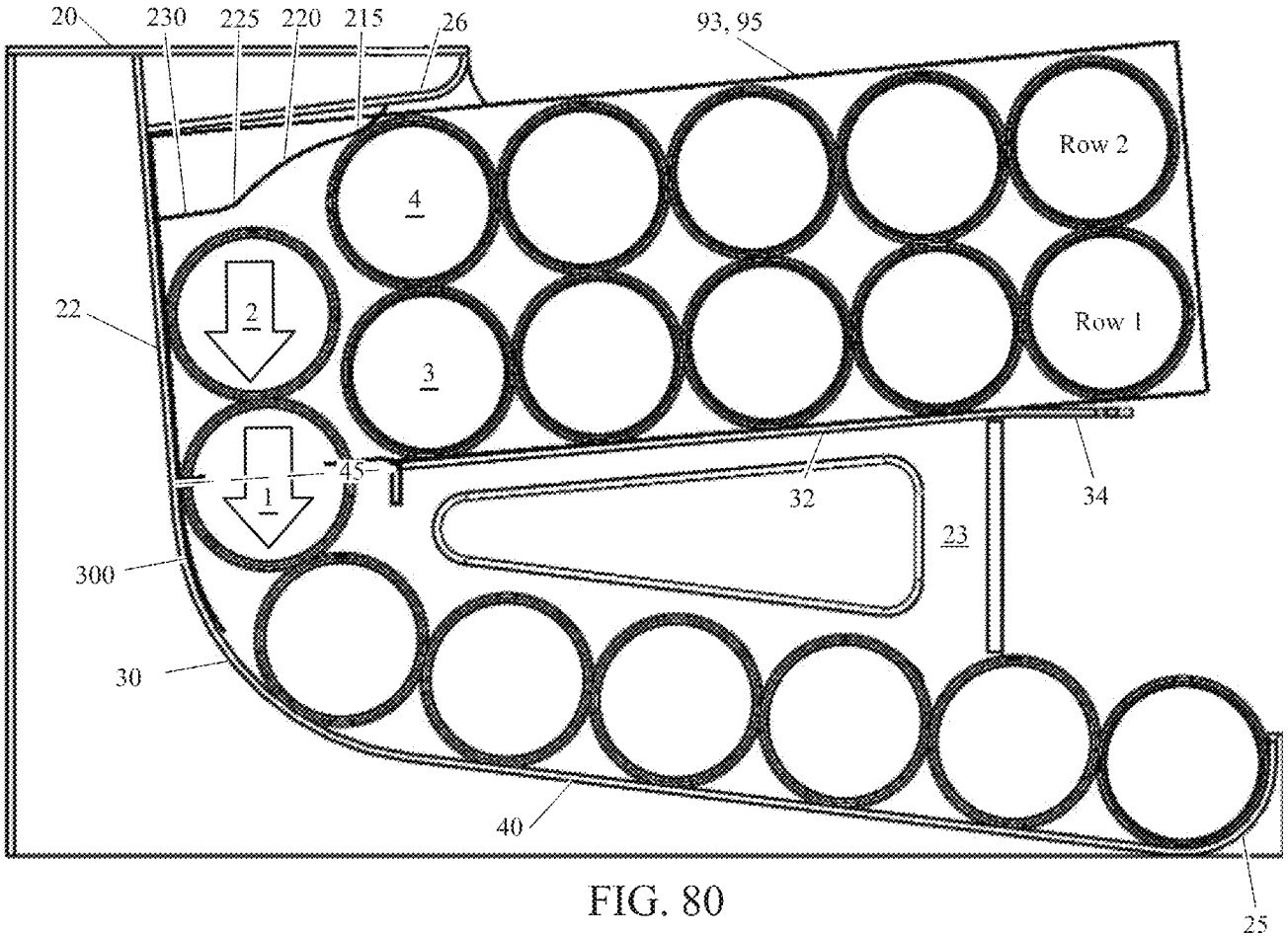
FIG. 80 shows an open side view of a cartridge having an always open or fully openable slot after it has been inserted into a partially filled dispenser having a cartridge opening wedge and an arcuate down chute.
Figure 81:
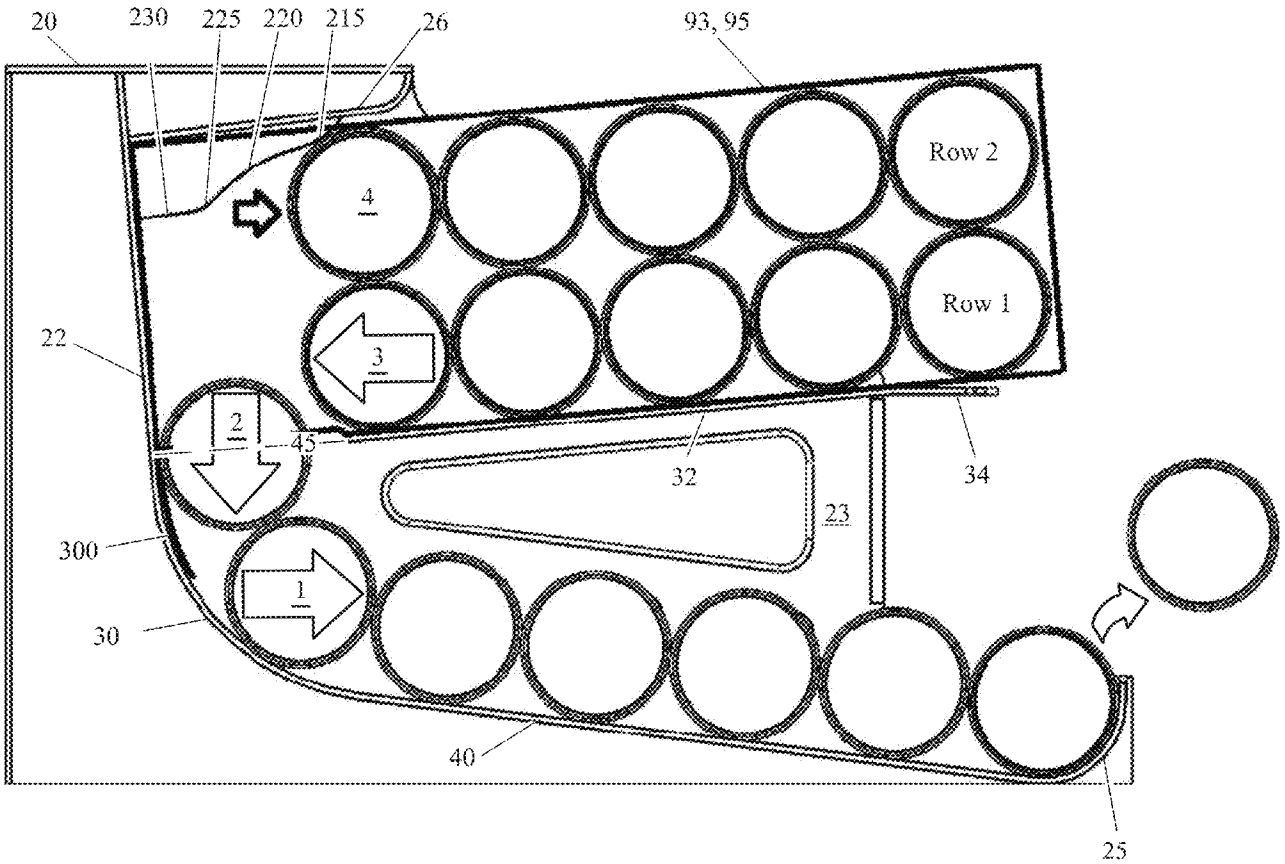
FIG. 81 shows an open side view of the first two cans exiting a cartridge having an always open or fully openable slot after it has been inserted into a partially filled dispenser having a cartridge opening wedge and an arcuate down chute.
Figure 82:
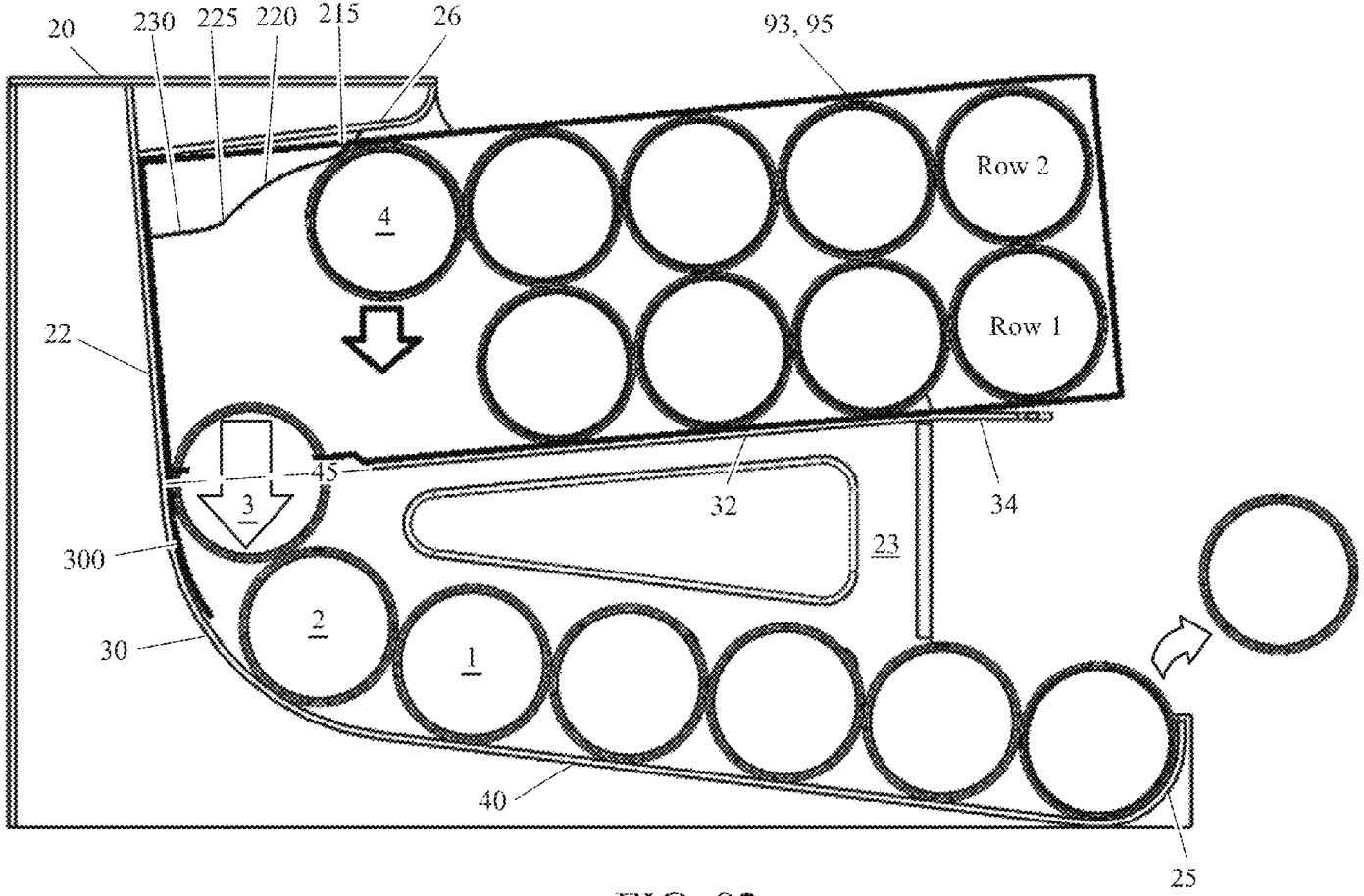
FIG. 82 shows an open side view of a third can exiting a cartridge having an always open or fully openable slot after it has been inserted into a partially filled dispenser having a cartridge opening wedge and an arcuate down chute, with the can 4 free to exit the cartridge.

Alternatively, in cartridge 93, 95 embodiments with an "always-there" slot 106*a*, 106*b* (or a die cut that allows the wedge 200 to tear open a full slot 106*a*, 106*b* during insertion) there will be no cartridge 93, 95 material in the space between the wedge 200 and the cans 2, 4 after insertion. However, the wedge 200 may also be modified to compensate for this difference. Accordingly, the wedge 200 overall length (front to rear) as defined by the base 205 may be increased, as may be the overall vertical extent of the wedge 200 first arcuate section 215, such that wedge 200 first arcuate section 215, as shown in FIG. 79, contacts can 4 upon complete insertion of the cartridge 93, 95.

Referring to FIGS. 79-82, when the wedge 200 contacts can 4, rearward and downward movement of can 4 is impeded until can 3 exits the cartridge 93, 95 before it. Therefore, this combination of cartridge 93, 95 and wedge 200 embodiments forces the cans 1, 2, 3, 4 to exit the cartridge 93, 95, and be dispensed, in the one, two, three, four order without jamming. Therefore, a conventional down chute 30 and loading ramp 32, shown in FIGS. 79-82, may be used with this wedge 200 embodiment.

Figure 92:
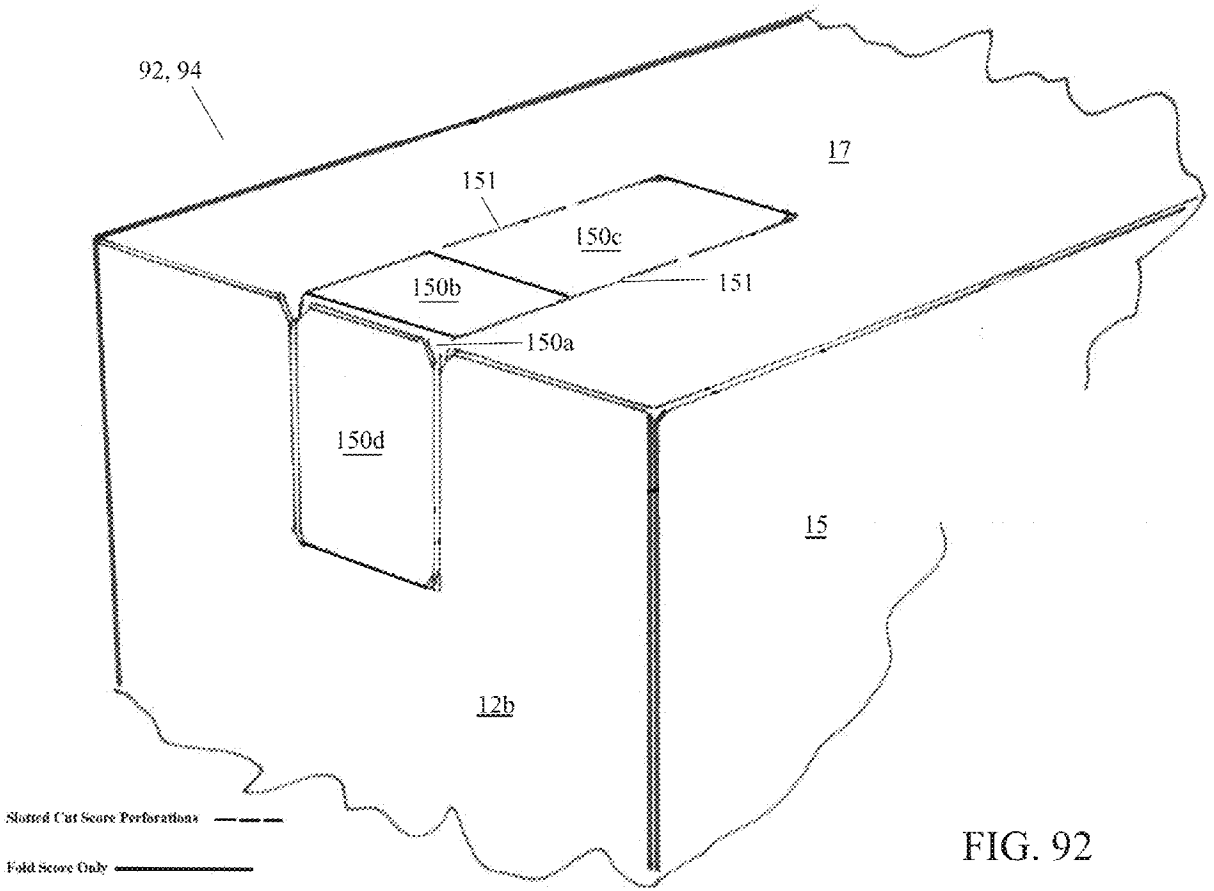
FIG. 92 shows a perspective view of a cartridge with a perforated slot and bridge.

Referring now to FIG. 83 and FIG. 90, an inwardly and downwardly formable bridge 105*a*, 105*b*, 105*c*, 105*d* may be die cut, via perforation cuts and fold scores, into the cartridge 92, 94 flat prior to assembly. The assembled cartridge 92, 94 with a bridge 105*a*, 105*b*, 105*c*, 105*d* is shown in FIG. 92. When inserted into the dispenser 20, the parallel perforations 151 on either side of the bridge 105*a*, 105*b*, 105*c*, 105*d*, in the assembled and packed cartridge 92, 94, are separated by the dispenser 20 wedge 200 pressing forcefully against them during cartridge 92, 94 insertion. The bridge 105*a*, 105*b*, 105*c*, 105*d* is thus forced inwardly and downwardly, as shown in FIGS. 66-73. In this embodiment, the paperboard forming bridge 105 (including 105*a*, 105*b*, 105*c*, 105*d*) fills the space between the wedge 200 and the cans 2, 4. When the cartridge 92, 94 is inserted in the dispenser 20, as shown in FIGS. 66-73, the paperboard fills the space between the wedge 200 and can 4, preventing can 4 from moving within the cartridge 92, 94, until after can 3 is able to roll rearward and exit the cartridge 92, 94 ahead of can 4.

A second cartridge 93, 95 embodiment, shown in FIG. 84 and FIG. 91, includes an "always there" opening 106*a*, 106*b* through which the wedge 200 directly contacts can 2 and can 4, instead of a perforated paperboard bridge 105. When the cartridge 93, 95 is assembled and packed at the point of manufacture, the die cut "always there" opening 106*a*, 106*b* creates a completely open or partially open L-shaped slot through the top rear edge of the cartridge 93, 95, extending both forwardly along the top 17 of cartridge 93, 95 and downwardly along the back 12 (including construction flaps 12*b* and 12*d*) of the cartridge 93, 95.

Figure 100:
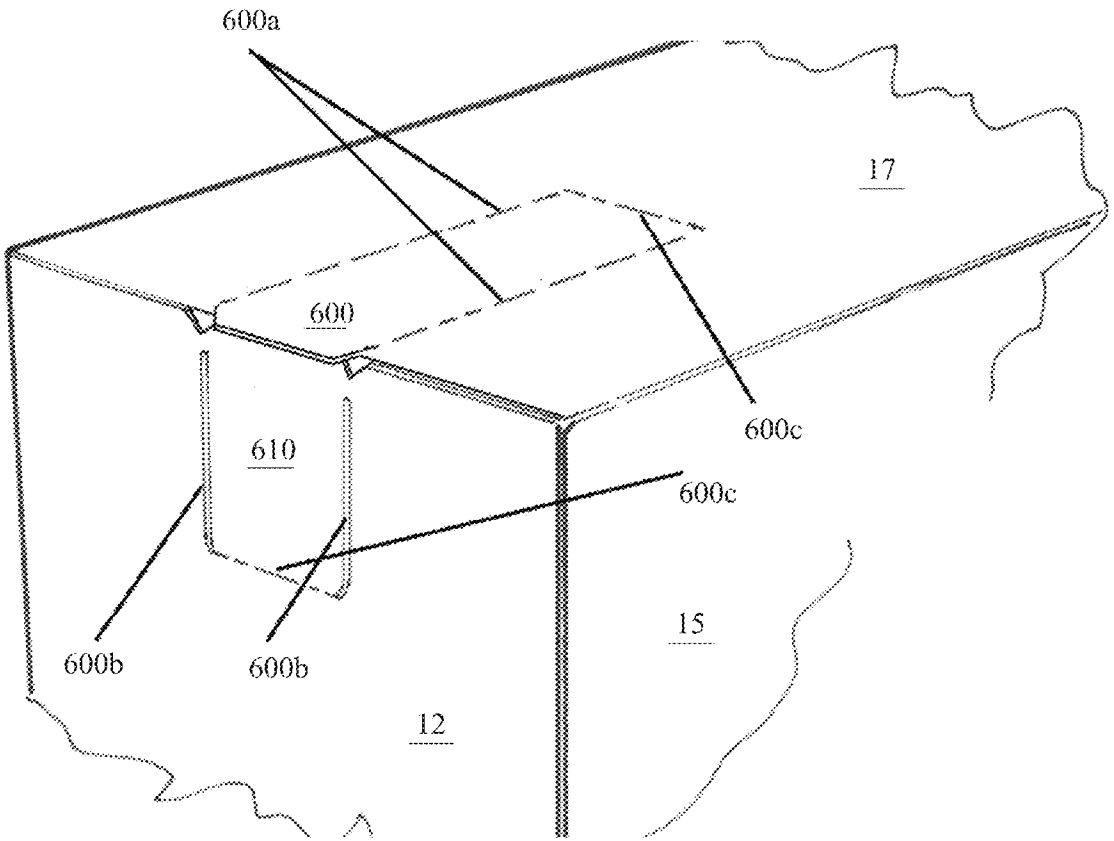
FIG. 100 shows a perspective view of a field openable slot.
Figure 101:
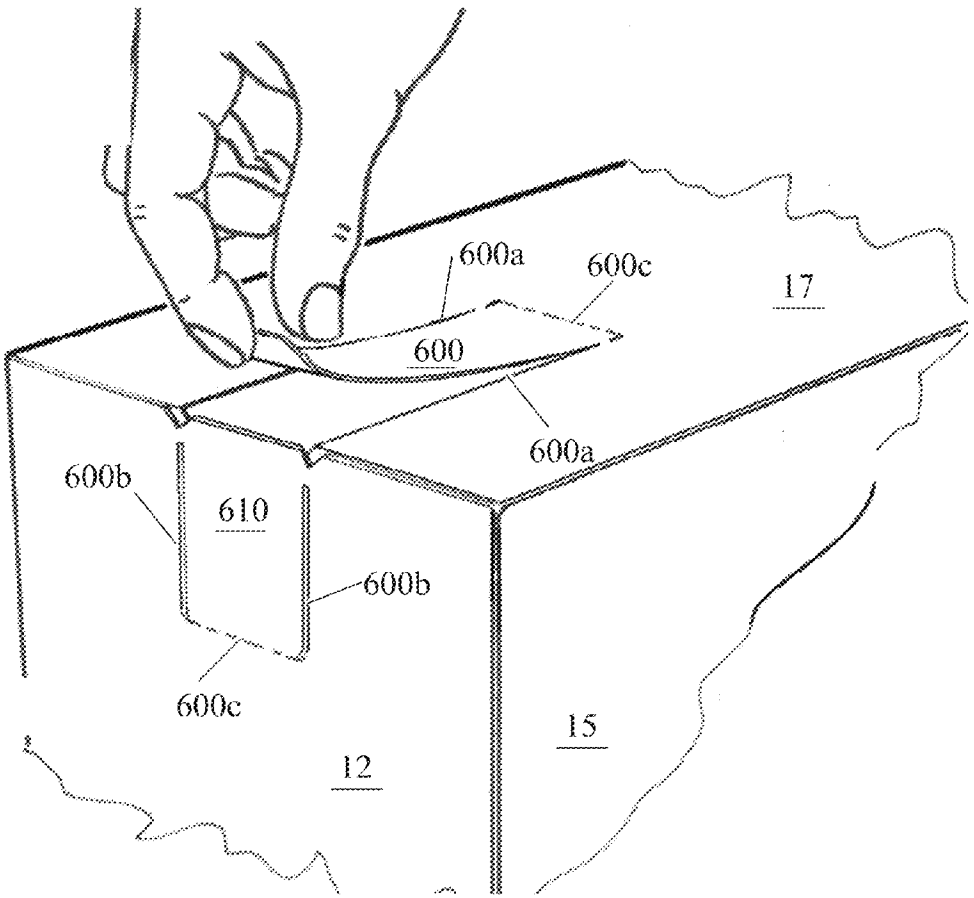
FIG. 101 shows a perspective view of a user opening a field openable slot.
Figure 102:
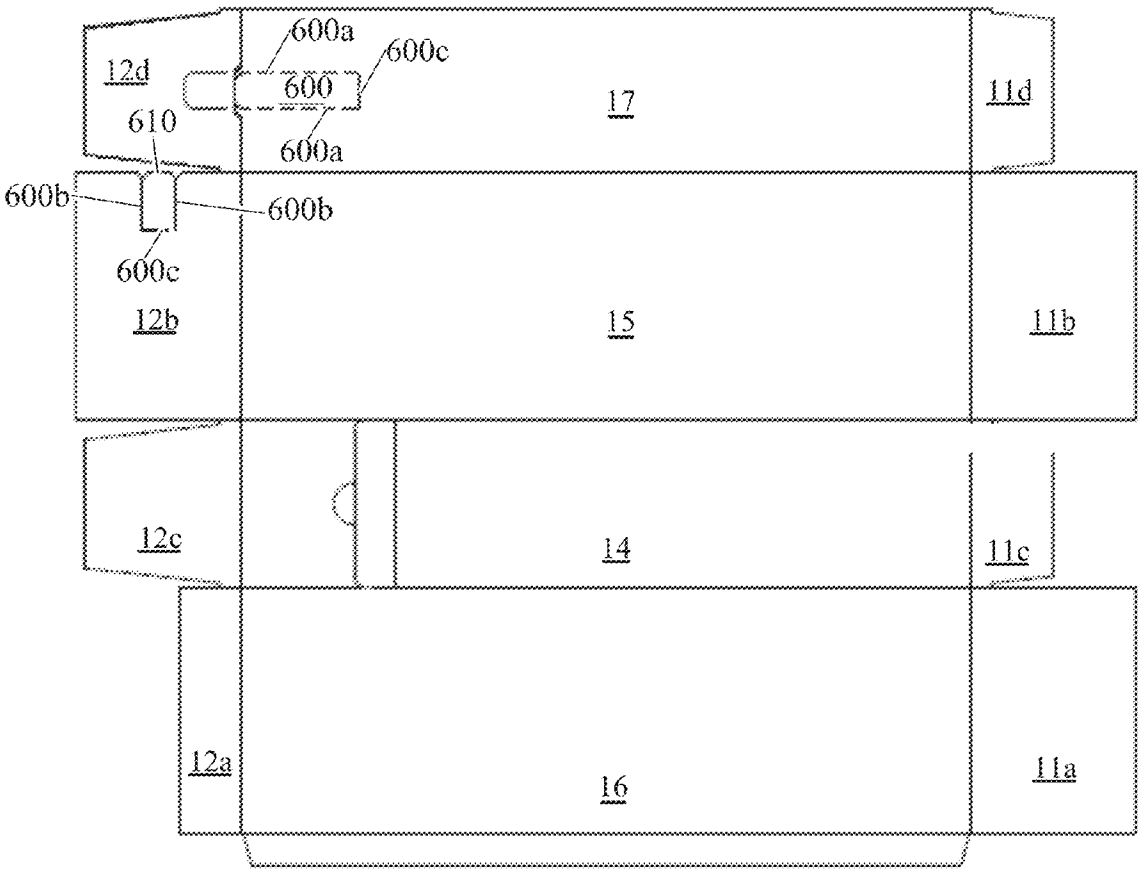
FIG. 102 shows a die cut cartridge blank layout having a field openable slot.

In some embodiments, shown for example in FIGS. 100-103, field openable slot fillers 600. 610 may be implemented. As shown in FIG. 100, a top slot filler 600 is formed by two perforations 600*a* along the top 17 of the cartridge. An end of the top slot filler 600 farthest from the back 12 of the cartridge may be formed by a fold score 600*c*, a perforation, or any other deformation known in the art that would allow the top slot filler 600 to bend forwardly and/or be removed after the perforations 600*a* on either side of the slot have been separated. A rear slot filler 610 is similarly formed at the back 12 of the cartridge and meets the top slot filler 600, but need not necessarily be a part of, or adjoined to, the top slot filler 600. The back slot filler 610 comprises a pair of permanent cut scores 600*b* and a fold score 600*c*, for example, at and end of the back slot filler 610. The die cut blank arrangement of the top slot filler 600 and back slot filler 610 is shown in FIG. 102.

Figure 103:
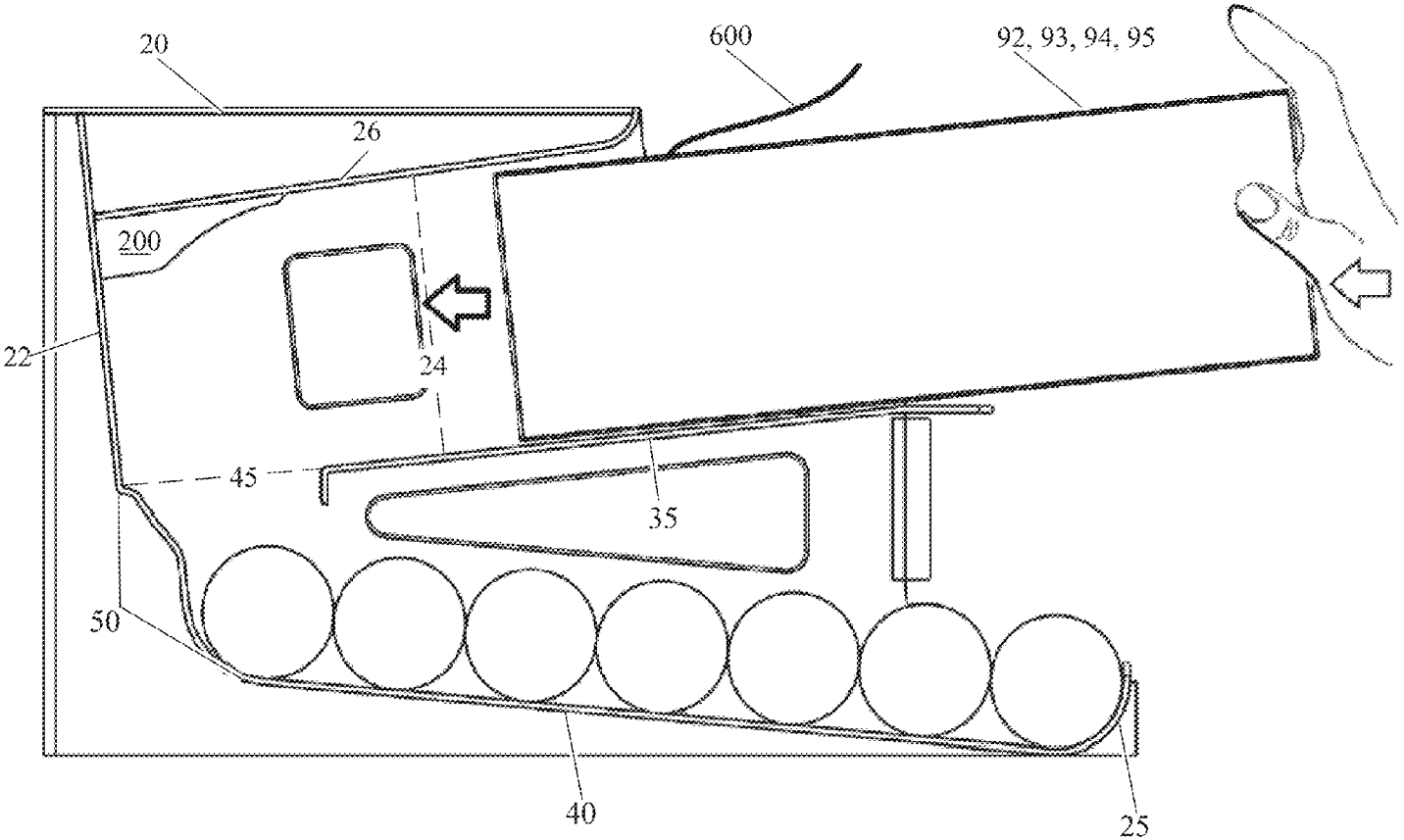
FIG. 103 shows an open sided view of a cartridge with an open field openable slot being pushed into a dispenser having an opening wedge.

When the top slot filler 600 is torn forwardly by a user, as show for example in FIG. 101, top slot filler 600 defines an opening in the top 17 of the cartridge. As shown in FIGS. 103-104, the cartridge may be pushed into a cartridge holding area 24, with the top slot filler 600 being held in an open position by the cartridge top 26. Alternatively the user may remove the top slot filler 600 completely prior to insertion into a dispenser. Similarly, the back slot filler 610 may be left in place and be pushed inwardly as the dispenser wedge 200 enters the cartridge, or the back slot filler may also be completely removed prior to insertion into a cartridge holding area 24.

During cartridge 93, 95 insertion into the dispenser 20, the wedge 200 is thus able to contact can 2 directly. Then by using sufficient clearance in the determination of "3r" (see FIG. 64), can 4 will clear the wedge 200 and exit the cartridge 93, 95 ahead of can 3, as shown in FIGS. 74-78.

In various dispenser 20 and cartridge 92, 93, 94, 95 combinations, shown in FIGS. 65-78 for example, the retaining flap 300 lays against and partially covers the upper part of the down chute 30, 50 after the retaining flap 300 is pushed downward and open by can 1. In these embodiments, extra clearance is preferably included in down chute 30, 50 dimensions to accommodate the thickness—"d"—(see FIG. 68) of the paperboard so that down chute 30, 50 function is not compromised. A small clearance constant approximately equal to cartridge 92, 94 paperboard thickness—"d"—may also be added to the wedge 200 central arcuate section 220 radius of curvature, shown in FIG. 64, to ensure proper wedge 200 operation when the cartridge 92, 94 includes a bridge 105.

Figure 76:
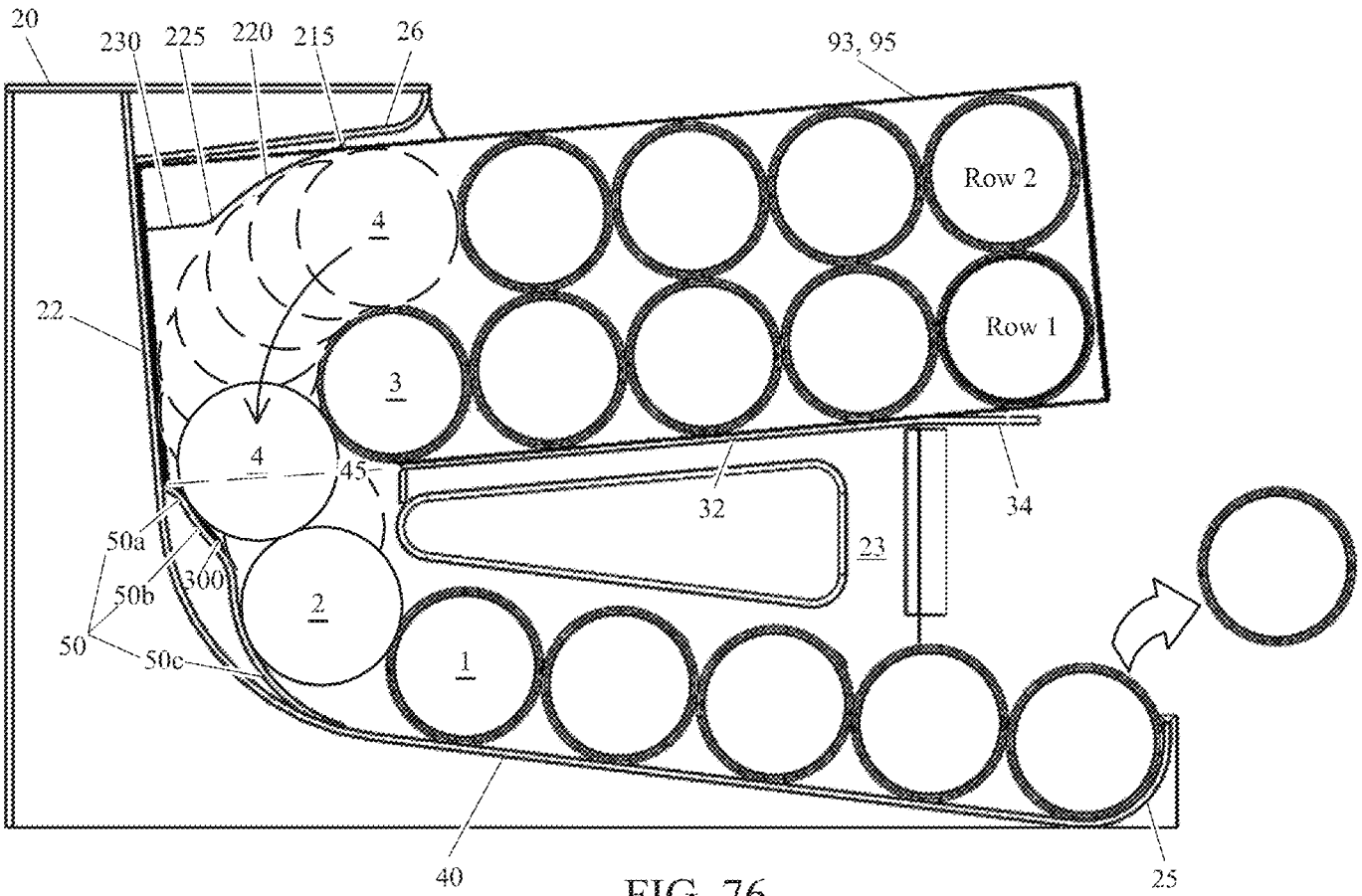
FIG. 76 shows an open side view of a third can path of motion as the third can is exiting a cartridge having an always open or fully openable slot after it has been inserted into a partially filled dispenser having a cartridge opening wedge and an S-shaped down ramp.
Figure 77:
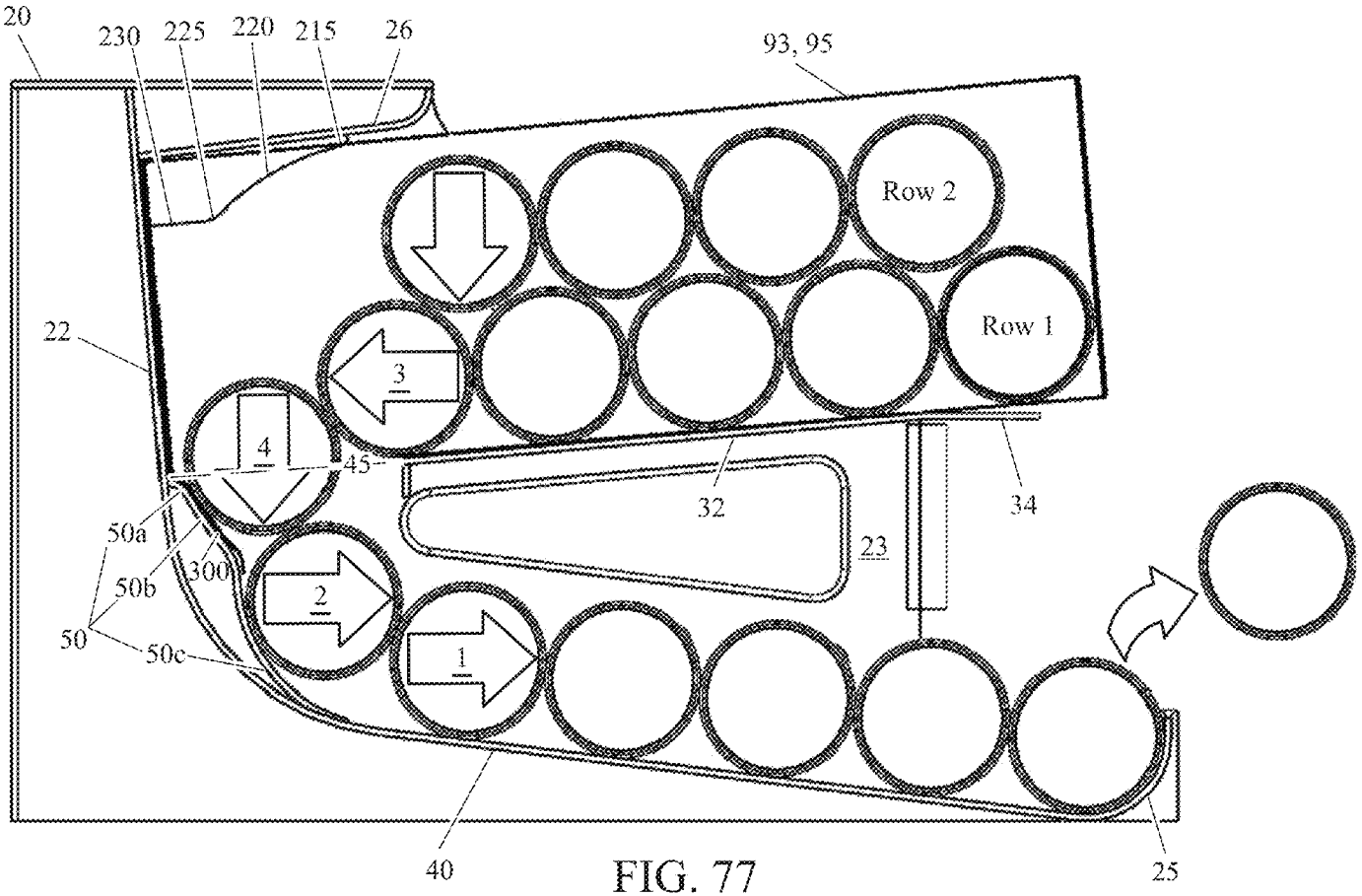
FIG. 77 shows an open side view of a cartridge having an always open or fully openable slot after it has been inserted into a partially filled dispenser having a cartridge opening wedge and an S-shaped down ramp and the first three cans in the cartridge have exited the cartridge in the sequence shown.
Figure 78:
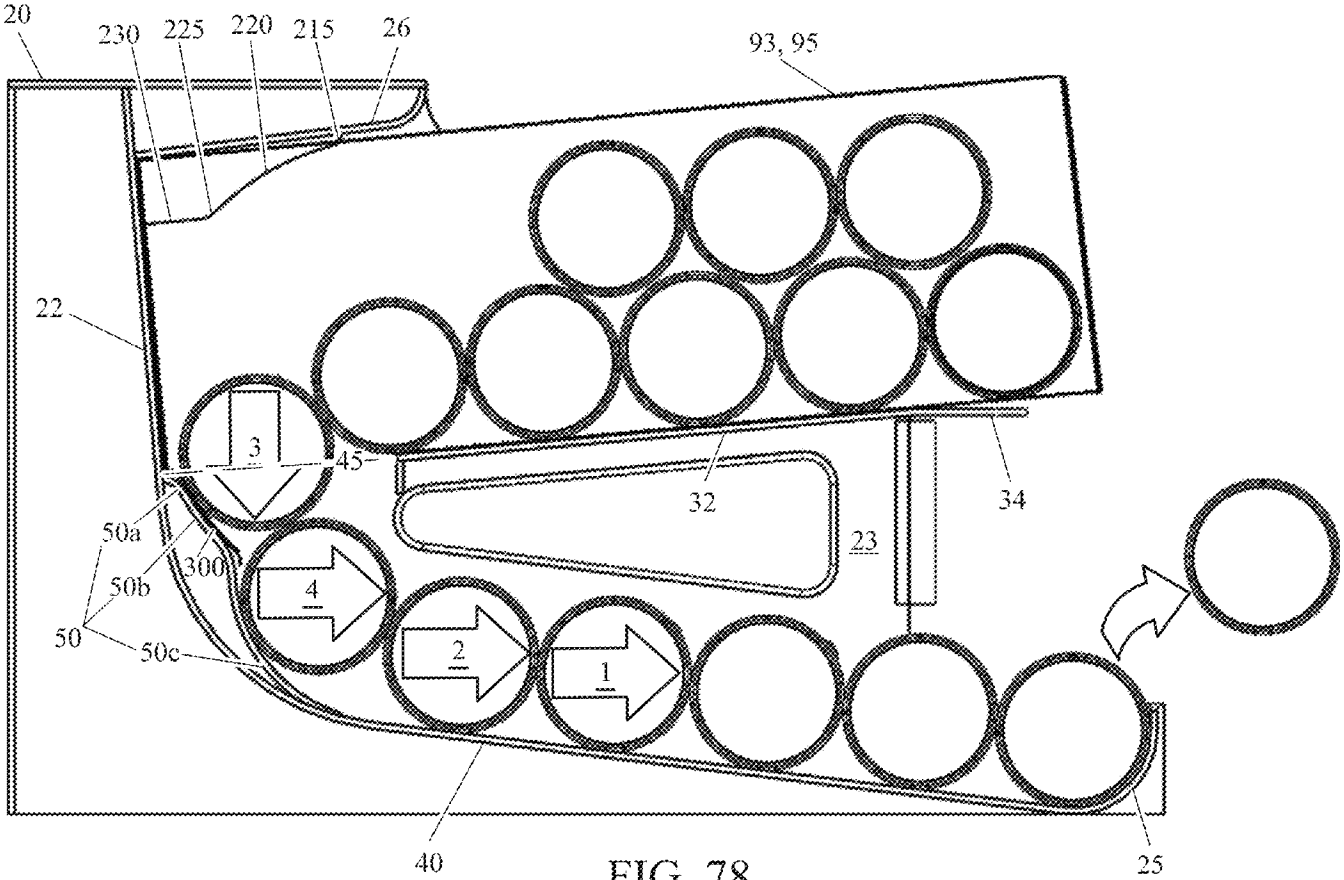
FIG. 78 shows an open side view of a cartridge having an always open or fully openable slot after it has been inserted into a partially filled dispenser having a cartridge opening wedge and an S-shaped down ramp and the first four cans in the cartridge have exited in the sequence shown.

The interaction of the wedge 200 with cartridges 93, 95 having an "always there" slot (without bridge 105 disposed between the wedge 200 and the cans 2, 4) is dependent upon whether or not the clearance wedge 200, FIG. 76, or the elongated impedance wedge 200, FIG. 79 is employed. When no bridge 105 is present, and clearance wedge 200, FIG. 76 is employed, can 4 exits the cartridge 93, 95 ahead of can 3, and therefore a loading ramp 32 with an impedance ridge 38 and spring tongue 36 improvement, an S-shaped down chute 50, or other method of controlling can 1, 2, 3, 4 dispensing order, is implemented to prevent the can 3 and can 4 jamming.

In some cartridge 92, 93, 94, 95 embodiments, alternative die cuts may be provided for the stocking person to partially or pre-open cartridges 92, 93, 94, 95 prior to insertion into a dispenser 20 in a manner that also prevent cans from prematurely falling out when the cartridge 92, 93, 94, 95 is inverted.

Figure 85:
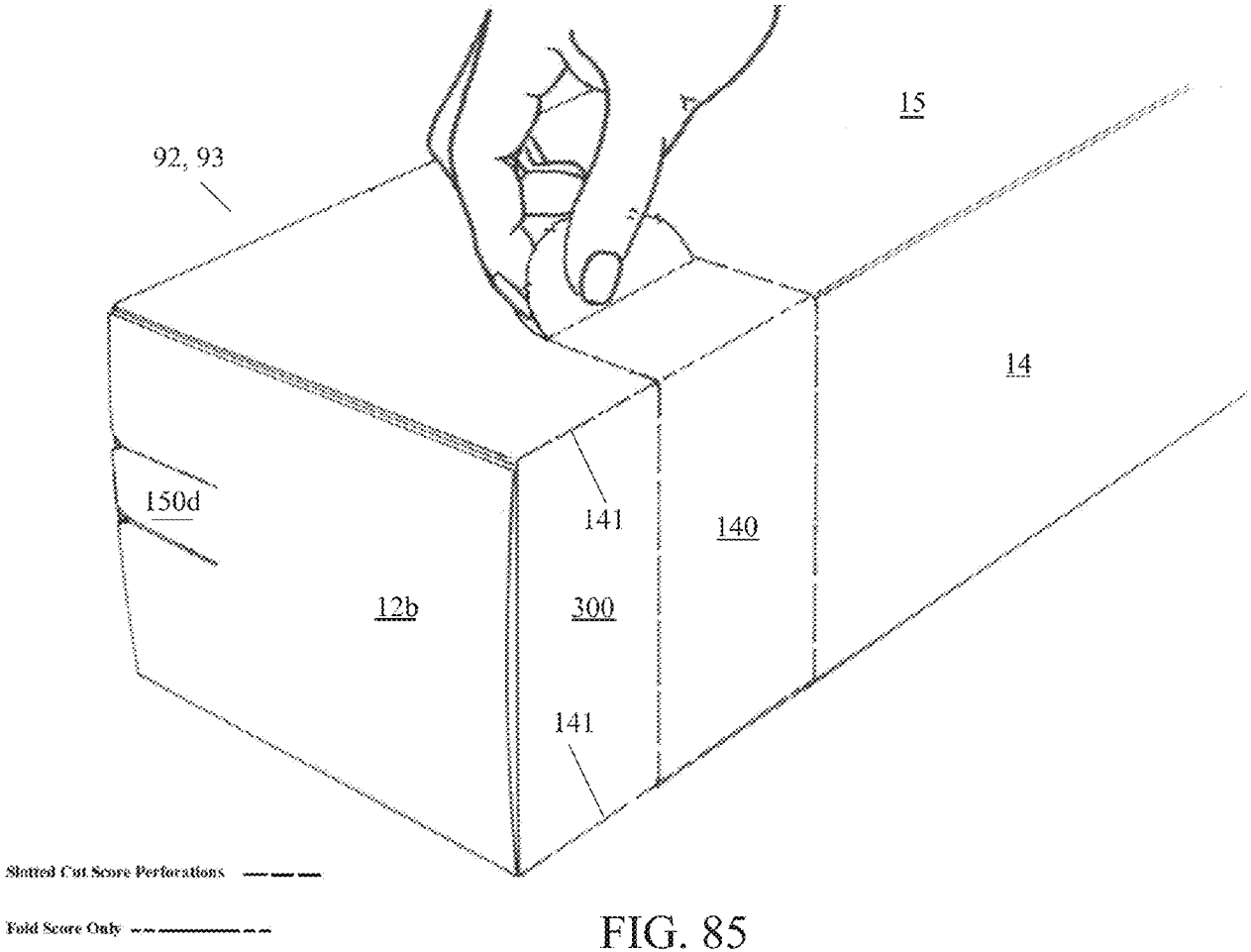
FIG. 85 shows a perspective view of a cartridge with a perforated removable priming flap and a first step of opening the priming flap.
Figure 86:
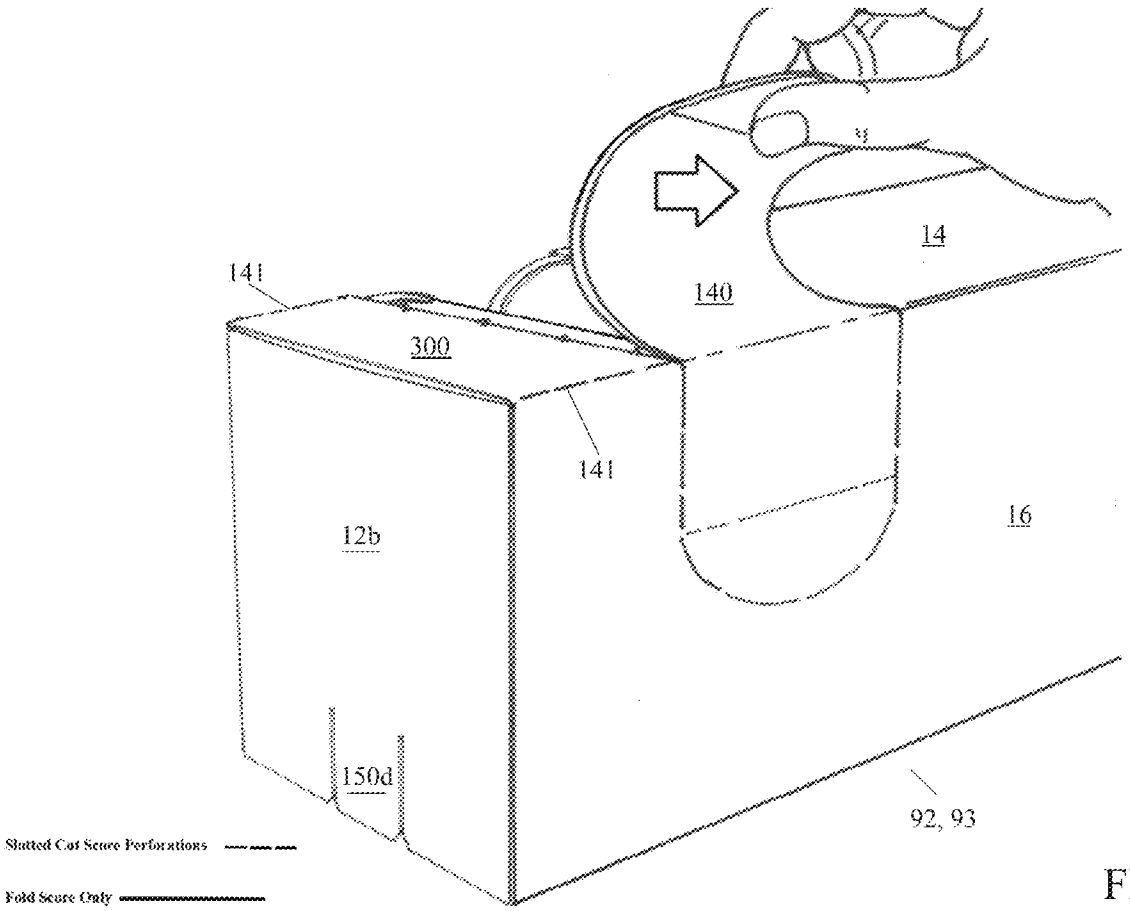
FIG. 86 shows a perspective view of a cartridge with a perforated removable priming flap that is partially opened.
Figure 87:
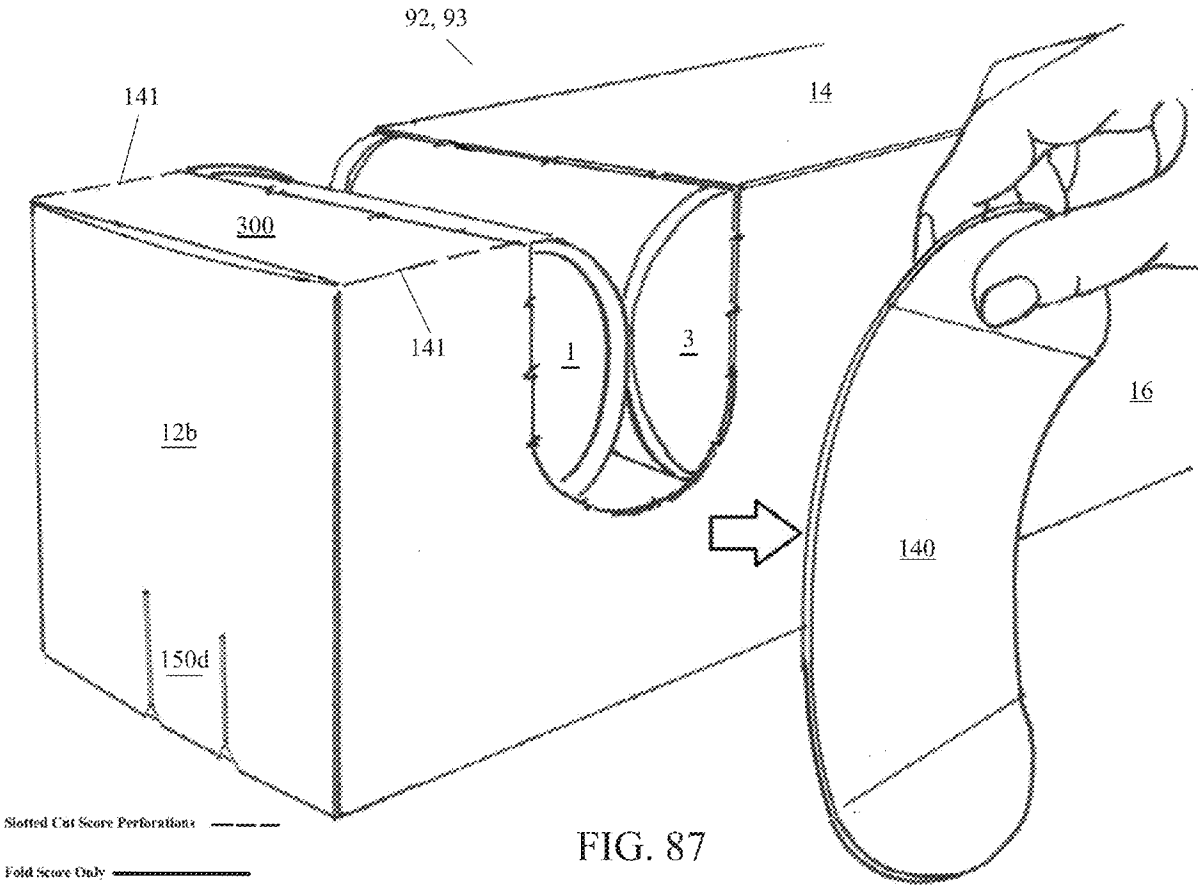
FIG. 87 shows a perspective view of a cartridge with a perforated removable priming flap that is fully opened.

Referring now to FIGS. 83-84, a cartridge 92, 93 includes a removable priming flap 140 which, when removed as shown in FIGS. 85-87, opens a large slot in the cartridge bottom 14. In this embodiment, the priming flap 140 has extensions 142 that include a portion of the sides 15, 16 of the cartridge 92, 93. In some embodiments the extensions 142*a*, 142*b* include a straight portion 142*a* and a portion with an arcuate perimeter 142*b* (see FIG. 84). In other embodiments, the straight portion 142*a* of the extension 142 may be omitted leaving only the portion 142*b* with a completely arcuate perimeter. An extension 142 with only an arcuate perimeter 142*b* may be advantageous to prevent the extension 142 from catching on elements of the dispenser 20 during stocking and restocking. Other extension 142 geometries may be substituted however, such as slanted sides that intersect the bottom of the cartridge 20 at the front and back edge of the priming flap 140, for example, eliminating corners at these locations and also preventing catching of the extensions 142.

The removable priming flap 140 (and opening created by its removal) is sized and positioned with two goals in mind First, the removable priming flap 140 is preferably large enough to facilitate easy opening of the remaining retaining flap 300 by the wedge 200. Minimizing the retaining flap 300 size reduces the wedge 200 force necessary to open retaining flap 300. The removable priming flap 140 is also preferably sufficiently small so that after it is removed and the cartridge 92, 93 is inverted, no cans will be able to fall out of the resulting opening.

Figure 88:
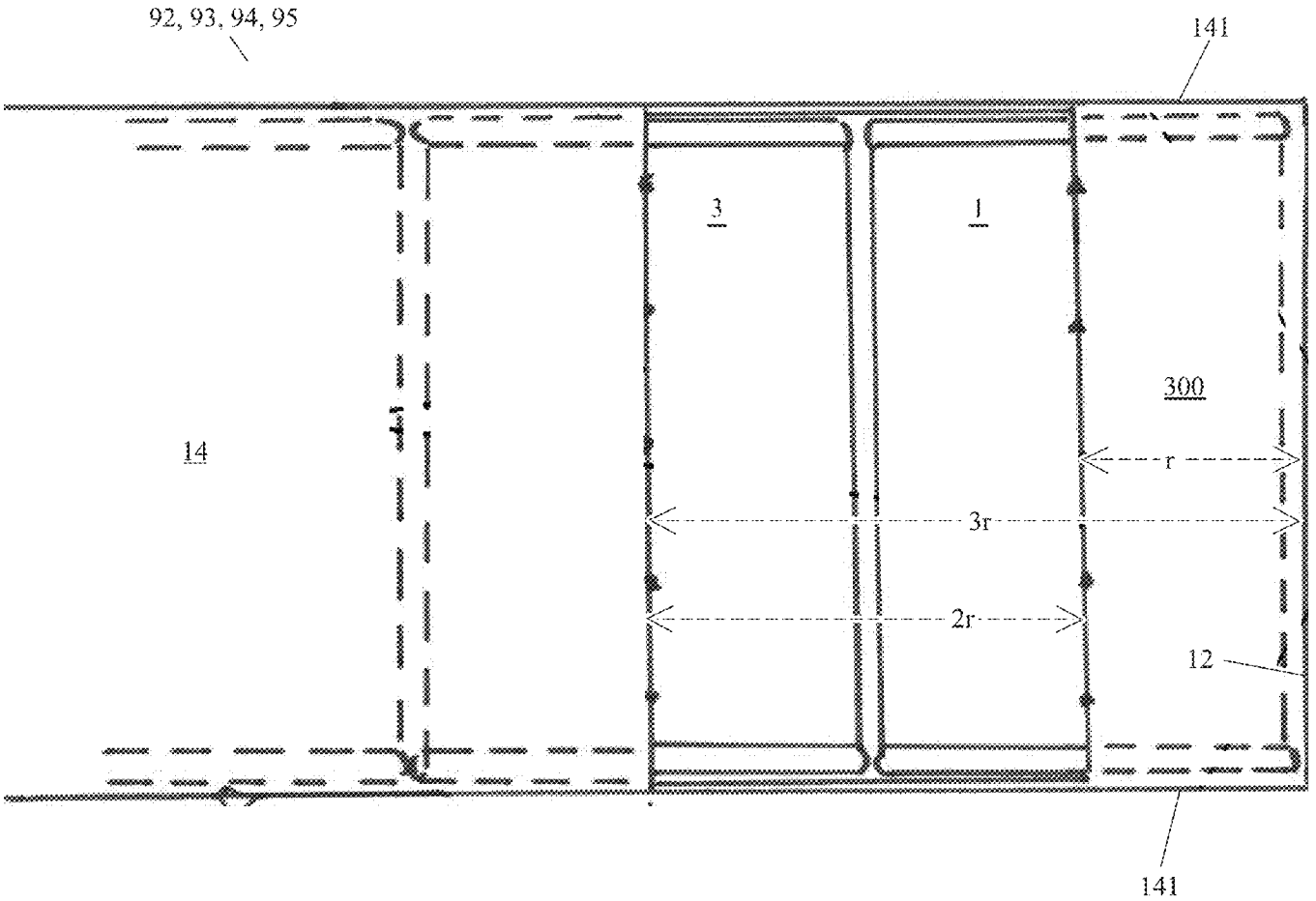
FIG. 88 shows a bottom view of a cartridge after removal of a perforated removable priming flap, with the perforated retaining flap still in place.

Second, the removable priming flap 140 is preferably positioned, as shown in FIG. 88, such that the front and rear edges of the removable priming flap 140 approximately coincide with the centerlines of can 1 and can 3, creating an opening in the cartridge 92, 93 that is approximately one can diameter (2r) wide. The removable priming flap 140 front edge over can 3 may be generally coincident with the location at which the cartridge opening normally ends, and generally coincident with the innermost end of the dispenser loading ramp 35 when the cartridge is fully inserted into the dispenser. The removable priming flap 140 rear edge over the centerline of can 1 ensures the retaining flap 300 firmly holds can 1 (and thus all other cans) in the cartridge 92, 93 when inverted, and also reduces the size of the retaining flap 300. In preferred embodiments, for a cartridge 92, 93 containing cans with a diameter—"2r"—the removable priming flap 140 rear edge is located approximately one can radius—"r"—forward of the cartridge 92, 93 back wall 12, and the removable priming flap 140 front edge is located a distance approximately 3r forward of the cartridge 92, 93 back wall 12. Thus when the removable priming flap 140 is removed, an opening in the desired location with a width of 2r results, and the goals of minimizing the retaining flap 300 size and preventing cans from falling out of the inverted cartridge 92, 93 when it may be opened are achieved.

While the locations of the priming flap 140 opening and retaining flap 300 shown in FIG. 88 are preferred, other configurations are possible, the final opening created in the bottom 14 of the cartridge 92, 93, 94, 95 after separation of both the priming flap 140 and the retaining flap 300 preferably defines a dispensing port opening that is large enough to permit a can 1, 2, 3, 4 to exit the cartridge, and cans are preferably not permitted to exit the cartridge 92, 93, 94, 95 when only the priming flap 140 is separated from the cartridge 92, 93, 94, 95 and the retaining flap remains intact. A general range of retaining flap 300 dimensions include a retaining flap 300 extension from the back 12 of the cartridge 92, 93, 94, 95 forwardly less than twice the radius of a can 1, 2, 3, 4, and one radius of a can 1, 2, 3, 4 or more. A general range of priming flap 300 dimensions include an priming flap 140 extension forwardly of the front edge of the retaining flap 300 a distance twice a can 1, 2, 3, 4 radius or less.

The left and right edges 141 of the retaining flap 300 rearward of the opening created by removing the removable priming flap 140, and coincident with the cartridge 92, 93 folded edges, may be cut scored perforations, as shown in FIGS. 83-88, to further facilitate the self-opening as described herein. Retaining flap left and right edges 131 may also be located a distance up the cartridge sidewalls, as shown in FIG. 52, to further facilitate the creation of a clear exit opening after separation.

Figure 89:
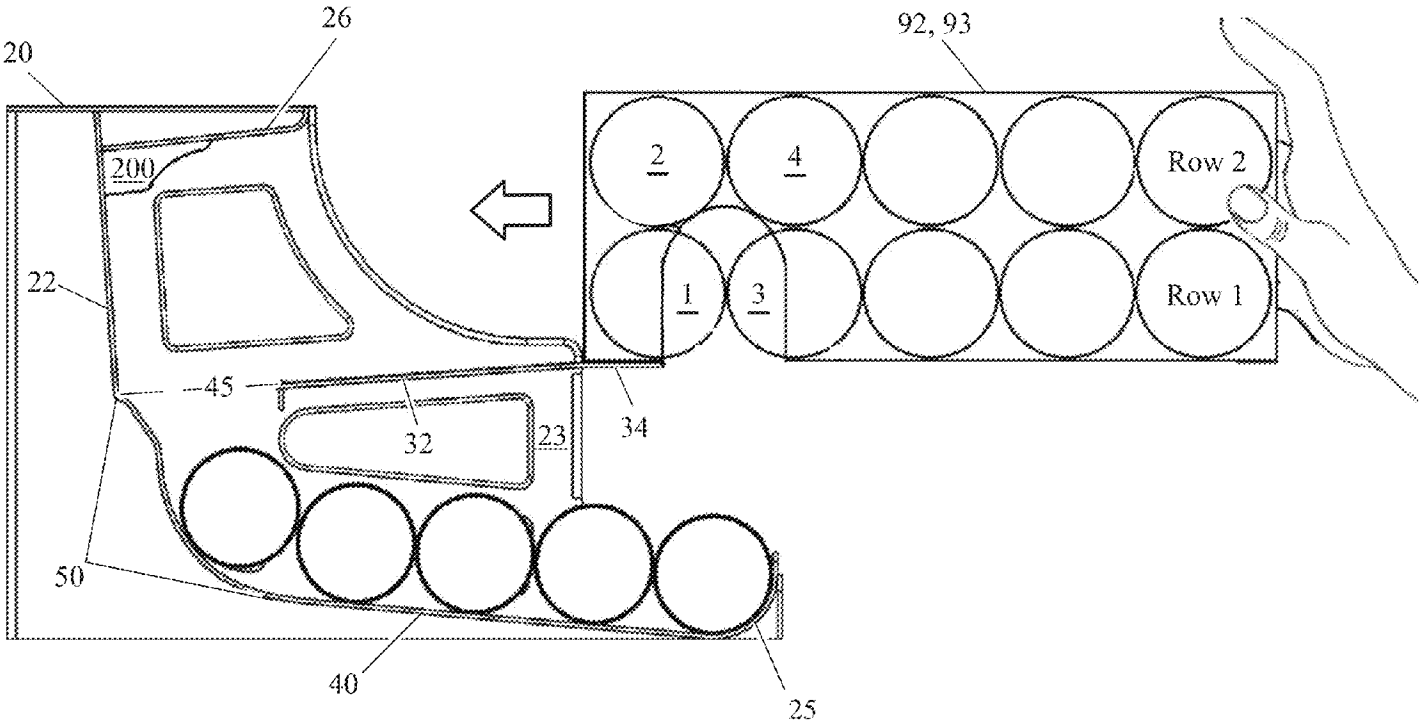
FIG. 89 shows a cartridge after removal of a perforated removable priming flap being inserted into a dispenser having a cartridge opening wedge and an S-shaped down chute.

As a result of this modification, as shown in FIG. 89, the stocker may use both hands to invert and position the cartridge 92, 93 for insertion into a dispenser 20. Once positioned on the resting surface 34, the cartridge 92, 93 enables one handed insertion, which further eases and speeds the loading process.

One concern with the self-opening cartridge 92, 93 design described above is the final disposition of the removable priming flap 140 which is removed from the cartridge 92, 93 prior to insertion, as shown in FIG. 87. The stocking person will preferably either discard or recycle the removable priming flap 140 after it is removed. However small it may be this action requires an extra step in the restocking process, and extra time and labor spent doing so.

Therefore an alternative die-cut design and pre-insertion method eliminates the discarding or recycling step, and further reduces waste or recycling time and labor. As shown in FIGS. 90-91, a cartridge 94, 95 has a folding priming flap 170 forward of the retaining flap 300 that holds can 1 in place when the cartridge 94, 95 is opened. As the folding priming flap 170 is simply folded forward after being opened, it is left in place even after insertion and throughout use and eliminates extra extra parts in hand after restocking.

Figure 93:
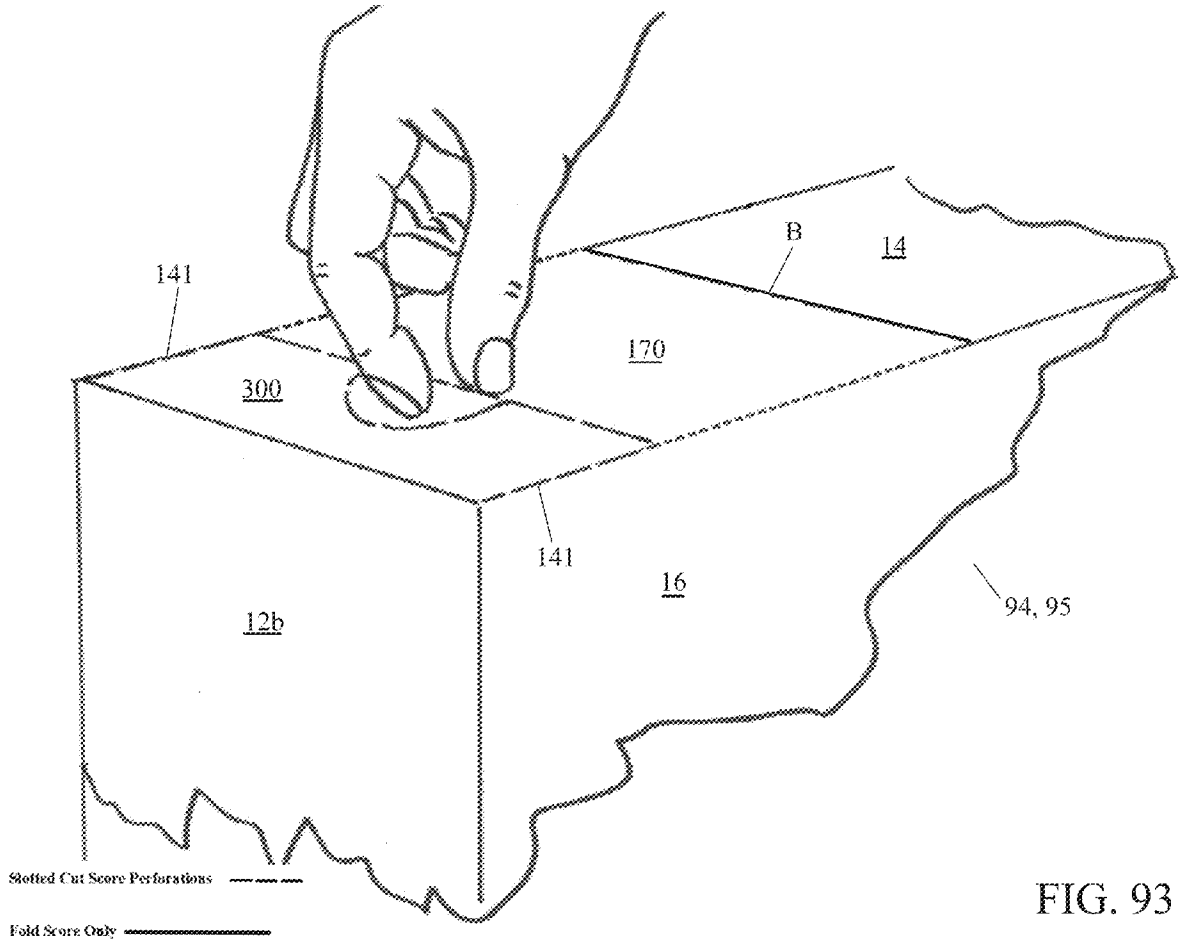
FIG. 93 show a perspective of a cartridge with an alternative priming flap with perforations and a fold score at the start of opening.
Figure 94:
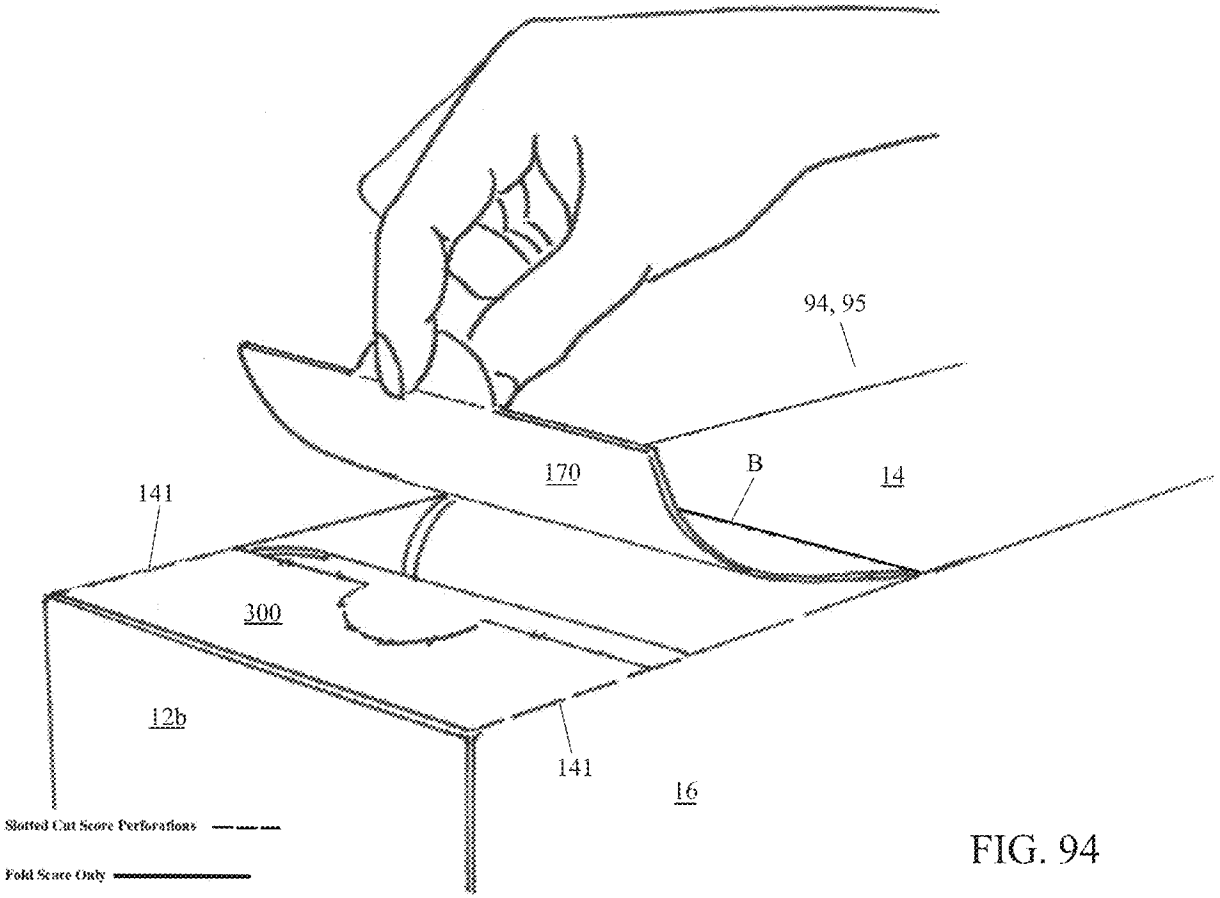
FIG. 94 shows a perspective of a cartridge with an alternative priming flap with perforations and a fold score that is partially opened.
Figure 95:
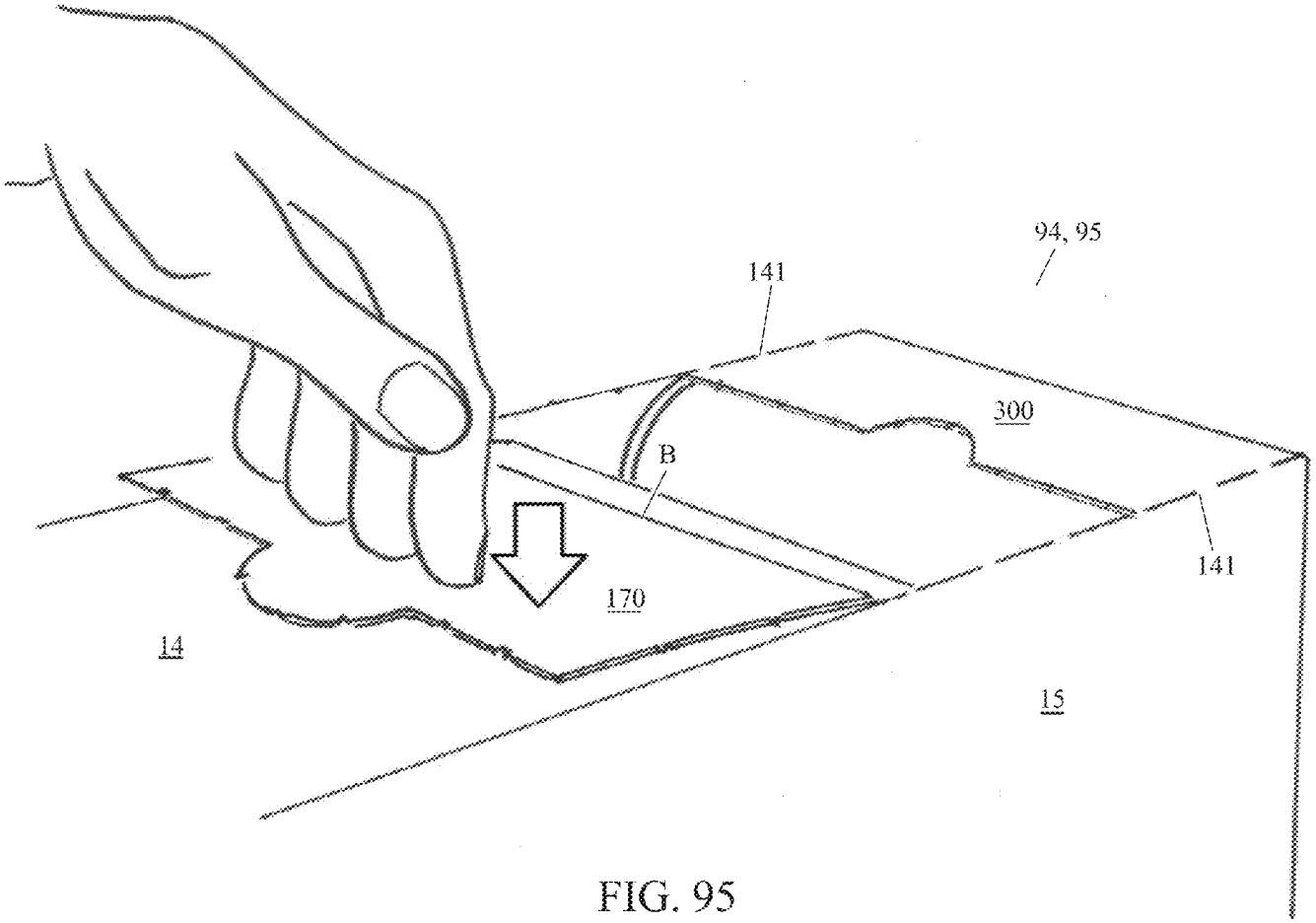
FIG. 95 shows a perspective of a cartridge with an alternative priming flap with perforations and a fold score that is fully opened.

The stocking person pierces a finger grip, common in the art, and grabs the edge of the folding priming flap 170 as shown in FIG. 93. The folding priming flap 170 is then torn forward to fold line "B", as shown in FIG. 94. The folding priming flap 170 is then folded forward along the bottom 14 of the cartridge 94, 95, as shown in FIG. 95. The opening created by tearing the folding priming flap 170 forward to line B is approximately one can diameter (2r) wide, as shown in FIG. 88 for the removable priming flap 140, extending from the centerline of can 1 to the centerline of can 3. The resulting opening is also positioned as shown in FIG. 88. Thus this pre-opening process facilitates self-opening of the retaining flap 300 when the cartridge 94, 95 is inserted in the dispenser with wedge 200, yet is small enough to prevent cans from falling out when the cartridge 94, 95 is inverted. The cartridge 94, 95 may now be inverted, as shown in FIGS. 96-97, and the stocking person may comfortably orient and position the cartridge 94, 95 on the dispenser 20 resting surface 34.

Figure 96:
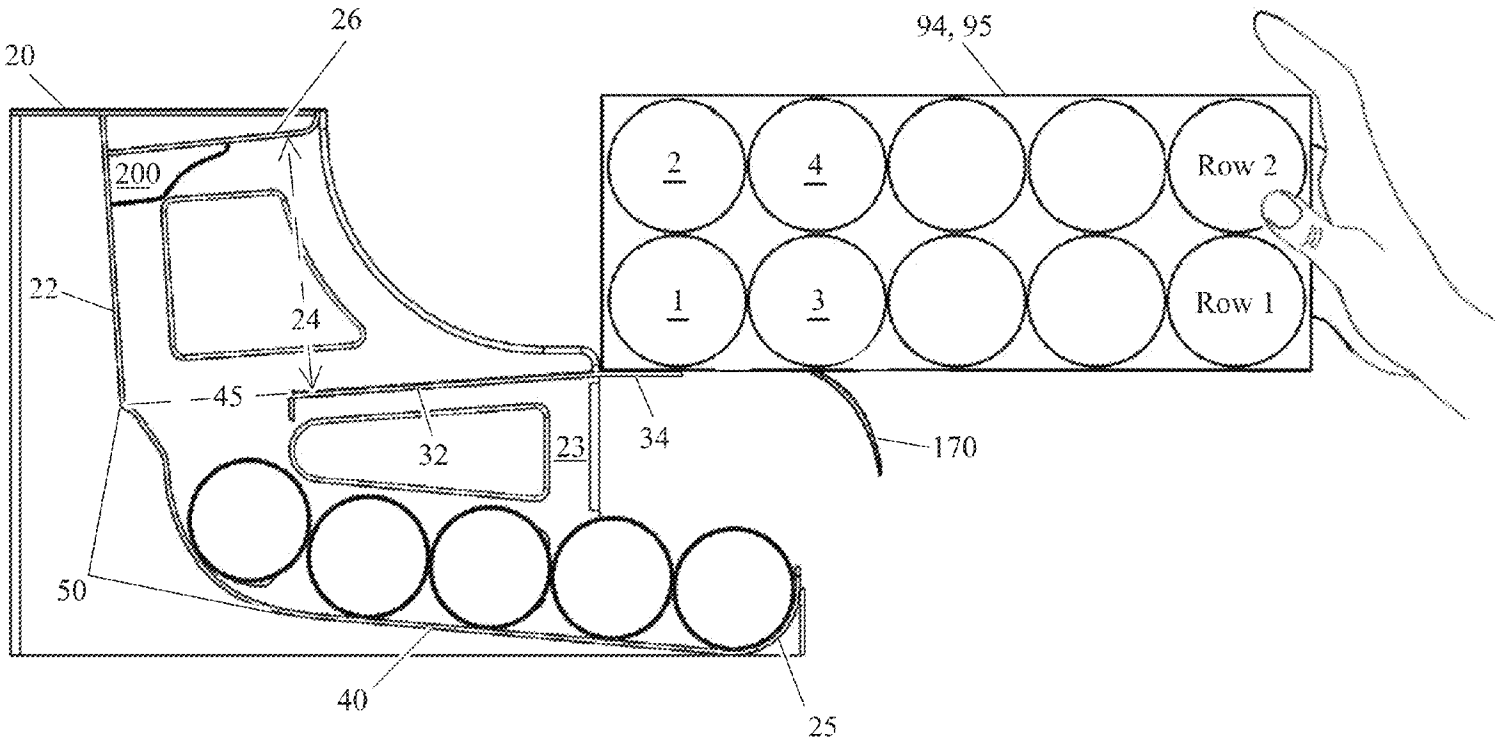
FIG. 96 shows an open side view of a cartridge, with an alternative priming flap with perforations and a fold score, inverted and positioned on a dispenser resting surface.
Figure 97:
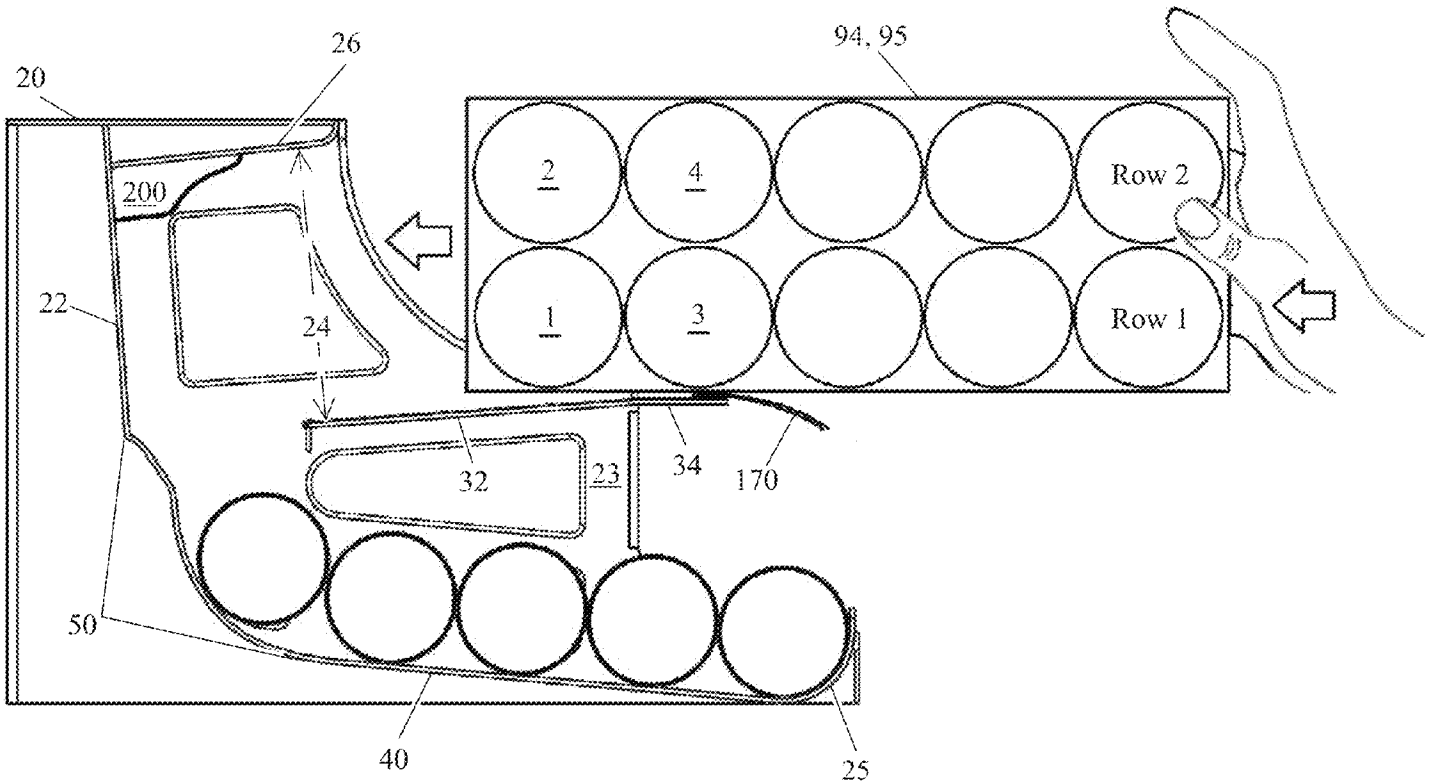
FIG. 97 shows an open side view of a cartridge with an alternative priming flap with perforations and a fold score being pushed into a dispenser having a dispenser opening wedge and an S-shaped down chute, while the priming flap folds forward beneath the cartridge and between it and the dispenser loading ramp.
Figure 98:
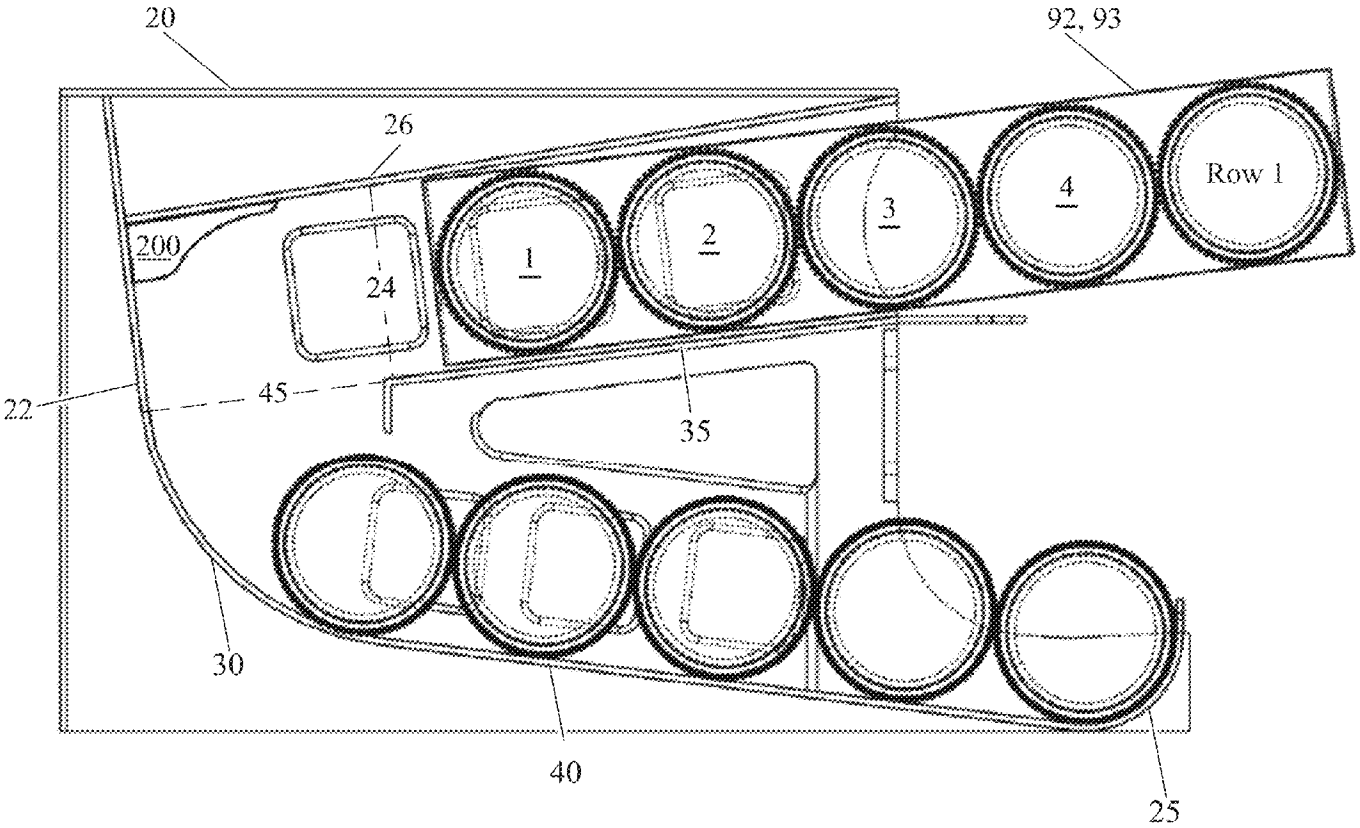
FIG. 98 shows an open side view of a single row cartridge being inserted into the cartridge holding area of a dispenser with an opening wedge.
Figure 99:
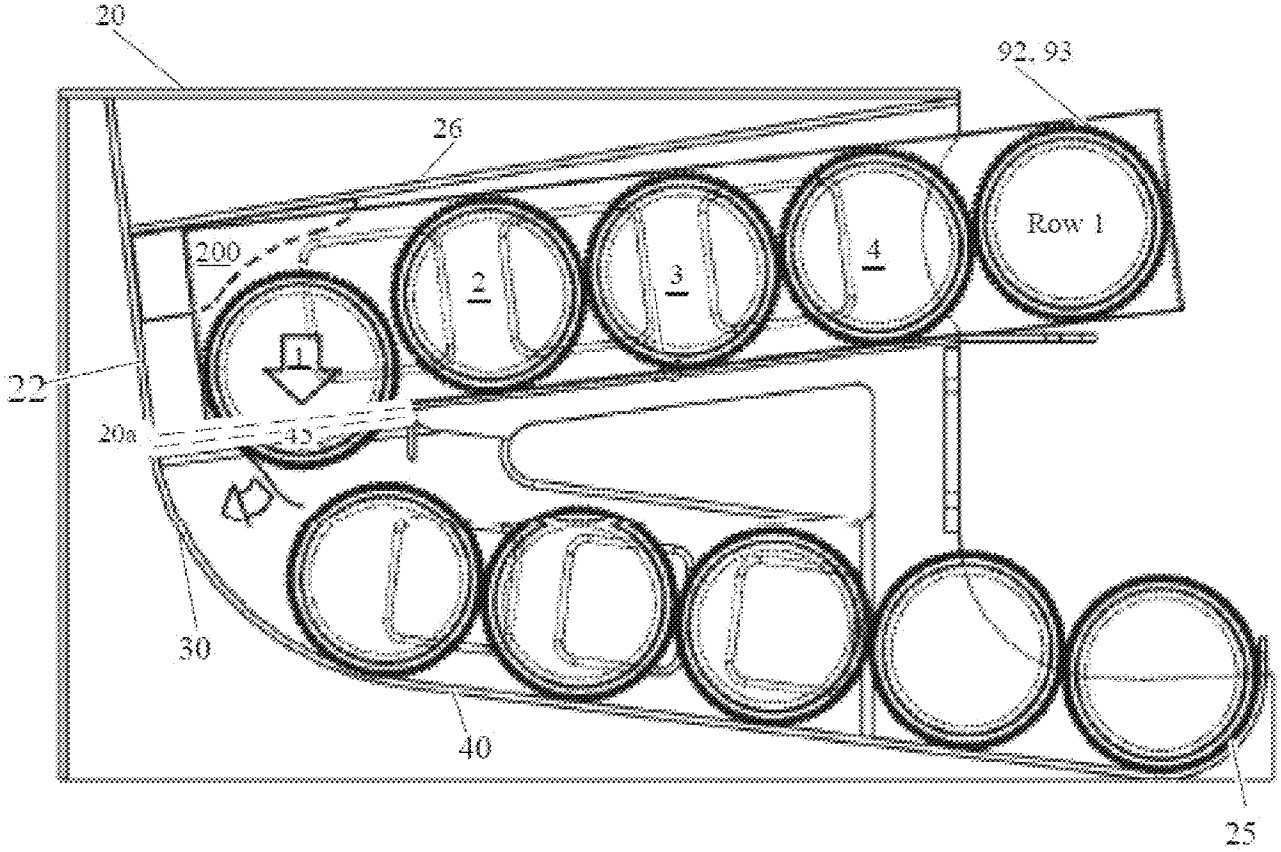
FIG. 99 shows an open side view of a single row cartridge being pressed into the cartridge holding area of a dispenser with an opening wedge with the opening wedge acting to open the cartridge.

The cartridge 94, 95 with the folding priming flap 170 still attached may be set upon the dispenser's resting surface, as in FIG. 96. However, in this opening embodiment the folding priming flap 170 remains attached to the cartridge 94, 95 and hangs in front of the resting surface 34. As the stock person pushes the cartridge 94, 95 into the cartridge holding area 24, as shown in FIG. 97, slightly lifting he cartridge to clear the resting surface edge, the priming flap 170 folds under the cartridge 94, 95 and slides into the dispenser 20 between the cartridge 94, 95 and the loading ramp 35. The folding priming flap 170 then remains underneath the cartridge 94, 95 during use and until the cartridge 94, 95 is emptied and replaced. When the cartridge 94, 95 is empty, it can be removed with the folding priming flap 170 and retaining flap 300 attached for recycling as a unit. Separate recycling or disposal of the removable priming flap 140 may thus be eliminated.

To prevent the material thickness "d" of the folding priming flap 170 beneath the cartridge 94, 95 from raising up the inner portion of the cartridge, thereby slightly decreasing the loading and preferred feed angle of loading ramp 35, it may be desirable to create a matching dropoff or recess along the top inner surface of dispenser loading ramp 35 coincident with the foldable priming flap size and location after insertion, such that the folding priming flap 170 has a niche into which it nestles after insertion.

It will be appreciated that the various wedge/slot, down chute, and priming flap embodiments described herein may be used interchangeably with each other in any useful combination, and all such combinations are within the scope of the various alternative dispenser and wedge embodiments described herein.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A cartridge for bulk stocking of a dispenser; the dispenser having a cartridge holding area for receiving the cartridge, the cartridge holding area having a top, a bottom, two sides, a back, an exit port in the bottom of the cartridge holding area at the back of the cartridge holding area, and a resting surface with a front edge at a front of the bottom of the cartridge holding area; the cartridge comprising:

a) a top, a bottom, a back, and two sides, enclosing an internal volume for containing at least one row of rolling products;

b) a retaining flap formed in the bottom of the cartridge, comprising a front edge, a back edge and two sides, the back edge of the retaining flap forming a rearmost portion of the bottom of the cartridge adjacent to the back of the cartridge, the front edge and the back edge being separated by a distance at least equal to a radius of one of the rolling products and less than twice the radius of the rolling product, the retaining flap being separable from the cartridge at the back edge and along the two sides; and c) a priming flap formed in the bottom of the cartridge, having a back edge removably coupled to the front edge of the retaining flap, a front edge, and two sides; the two sides of the priming flap being separable from the cartridge, the front edge of the priming flap and the back of the cartridge being separated by a distance of at least as large as twice the radius of the rolling product, such that when the priming flap and the retaining flap are at least partially separated from the cartridge, an opening is defined in the bottom of the cartridge equal to at least twice the radius of the rolling product, such that the rolling products may exit the cartridge through the opening;

wherein, when the priming flap is at least partially separated from the bottom of the cartridge and the cartridge is placed in the cartridge holding area with the retaining flap forming the rearmost portion of the bottom of the cartridge on the resting surface of the cartridge holding area, the priming flap is secured to the front edge of the resting surface, and the cartridge is pushed into the cartridge holding area toward the back of the cartridge holding area, the retaining flap at least partially separates from the bottom of the cartridge, permitting the rolling products in the cartridge to exit the cartridge through the exit port of the cartridge holding area.

2. The cartridge of claim 1, wherein the priming flap further comprises a slot that engages a tab at the front edge of the resting surface, such that the tab secures the priming flap to the front edge of the resting surface.

3. The cartridge of claim 1, wherein the priming flap further comprises a tear tab coupled to the front edge of the opening flap.

4. The cartridge of claim 1, wherein the distance between the front edge of the priming flap and the back edge of the priming flap is approximately twice the radius of the rolling product or less.

5. The cartridge of claim 1, wherein the two sides of the retaining flap have an extension extending upwardly along the two sides of the cartridge.

6. The cartridge of claim 1, wherein the two sides of the retaining flap comprise zipper scores.

7. A cartridge for bulk stocking of a dispenser, the dispenser having a cartridge holding area for receiving the cartridge, the cartridge holding area having a top, a bottom, two sides, a back, an exit port in the bottom of the cartridge holding area at the back of the cartridge holding area, and at least one wedge element at the top and back of the cartridge holding area; the cartridge comprising:

a) a top, a bottom, a back, and two sides, enclosing an internal volume for containing at least one row of rolling products;

b) a retaining flap formed in the bottom of the cartridge, comprising a front edge, a back edge and two sides, the back edge of the retaining flap forming a rearmost portion of the bottom of the cartridge removably coupled to the back of the cartridge; the front edge and the back edge being separated by a distance equal to at least a radius of a rolling product and less than twice the radius of the rolling product, the retaining flap being separable from the cartridge along the two sides;

c) a priming flap formed in the bottom of the cartridge, having a back edge adjacent to the front edge of the retaining flap, a front edge, and two sides; the two sides of the priming flap being separable from the cartridge and the back edge of the priming flap being separable from the front edge of the retaining flap; the front edge of the priming flap and the back of the cartridge being separated by a distance at least as large as twice the radius of the rolling product, such that when the priming flap is at least partially separated from the cartridge and the retaining flap, an opening is defined in the bottom of the cartridge;

d) at least one slot in the top and back of the cartridge for accepting the at least one wedge element of the dispenser, wherein, when the priming flap is at least partially separated from the bottom of the cartridge and the front edge of the retaining flap, the cartridge is pushed into the cartridge holding area toward the back of the cartridge holding area with the bottom of the cartridge facing downwardly, the at least one wedge element of the dispenser enters the cartridge through the at least one slot of the cartridge and applies a downward force to at least one rolling product in the cartridge and separates the retaining flap from the bottom of the cartridge at the two sides of the retaining flap, allowing the rolling products in the cartridge to exit the cartridge through the exit port of the cartridge holding area.

8. The cartridge of claim 7, wherein a distance between the front edge of the priming flap and the back edge of the priming flap is approximately twice the radius of the rolling product or less.

9. The cartridge of claim 7, wherein the two sides of the priming flap comprise an extension extending upwardly on the two sides of the cartridge with a perimeter having at least one arcuate section.

10. The cartridge of claim 7, wherein the slot is formed by at least two perforations separated by a bridge.

11. A cartridge for bulk stocking of a dispenser, the dispenser having a cartridge holding area for receiving the cartridge, the cartridge holding area having a top, a bottom, two sides, a back, an exit port in the bottom of the cartridge holding area at the back of the cartridge holding area, and at least one wedge element at the top and back of the cartridge holding area, the cartridge comprising:

a) a top, a bottom, a back, and two sides, enclosing an internal volume for containing at least one row of rolling products;

b) a retaining flap formed in the bottom of the cartridge, comprising a front edge, a back edge and two sides, the back edge of the retaining flap forming a rearmost portion of the bottom of the cartridge removably coupled to the back of the cartridge; the front edge and the back edge being separated by a distance equal to at least a radius of a rolling product and less than twice the radius of the rolling product; the retaining flap being separable from the cartridge along the two sides;

c) a priming flap formed in the bottom of the cartridge, having a back edge adjacent to the front edge of the retaining flap, a front edge, and two sides; the front edge of the priming flap being coupled to the bottom of the cartridge, the two sides of the priming flap being separable from the cartridge, the back edge of the priming flap being separable from the front edge of the retaining flap, the front edge of the priming flap and the back end of the cartridge being separated by a distance at least as large as a twice the radius of the rolling product, such that when the priming flap is at least partially separated from the cartridge along the two sides and the retaining flap, an opening is defined in the bottom of the cartridge;

d) at least one slot disposed at the top and back of the cartridge for accepting the at least one wedge element of the dispenser;

wherein, when the priming flap is at least partially separated from the bottom of the cartridge along its two sides and the retaining flap and the priming flap is folded forwardly at its front edge, the cartridge is pushed into the cartridge holding area toward the back of the cartridge holding area with the bottom of the cartridge facing downwardly, the at least one wedge element of the dispenser enters the cartridge through the at least one slot of the cartridge and applies a downward force to the at least one rolling product in the cartridge and at least partially separates the retaining flap from the bottom of the cartridge at the two sides of the retaining flap, allowing the rolling products in the cartridge to exit the cartridge through the exit port of the cartridge holding area.

12. The cartridge of claim 11, wherein the slot is formed by at least two perforations separated by a bridge.

13. The cartridge of claim 11, wherein the two sides of the priming flap comprise an extension extending upwardly on the two sides of the cartridge with a perimeter having at least one arcuate section.

14. The cartridge of claim 11, wherein the distance between the front edge of the priming flap and the back edge of the priming flap is approximately twice the radius of the rolling product or less.

* * * * *